US011649991B2

(12) United States Patent
Jacobs

(10) Patent No.: US 11,649,991 B2
(45) Date of Patent: May 16, 2023

(54) DOUBLE-ENDED THERMOACOUSTIC HEAT EXCHANGER

(71) Applicant: The Government of the United States of America, as represented by the Secretary of Homeland Security, Washington, DC (US)

(72) Inventor: Bryson Jacobs, Quaker Hill, CT (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

(21) Appl. No.: 17/737,063

(22) Filed: May 5, 2022

(65) Prior Publication Data

US 2022/0275978 A1 Sep. 1, 2022

Related U.S. Application Data

(63) Continuation-in-part of application No. 17/544,855, filed on Dec. 7, 2021.

(Continued)

(51) Int. Cl.
*F25B 9/14* (2006.01)

(52) U.S. Cl.
CPC ..... *F25B 9/145* (2013.01); *F25B 2309/1407* (2013.01); *F25B 2309/1412* (2013.01); *F25B 2309/1413* (2013.01)

(58) Field of Classification Search
CPC ..... F25B 9/145; F25B 2309/1407; F25B 2309/1412; F25B 2309/1413

(Continued)

(56) References Cited

U.S. PATENT DOCUMENTS 2,836,033 A * 5/1958 Marrison ..... H02N 11/002 60/516
4,858,441 A * 8/1989 Wheatley ..... F02G 1/0445 60/517

(Continued)

OTHER PUBLICATIONS

Antonio Piccolo et al., "Comparative Performance of Themnoacoustic Heat Exchangers with Different Pore Geometries in Oscillatory Flow Implementation-of-Experimental-Techniques", Applied Sciences, Aug. 2, 2017, 7, 784; doi: 10.3390/7080784, pp. 1-10,www.mdipi.com/journal/applsci.

(Continued)

*Primary Examiner* — Tho V Duong
*Assistant Examiner* — Raheena R Malik
(74) *Attorney, Agent, or Firm* — Lavanya Ratnam; Robert W. Busby; Kelly G. Hyndman

(57) ABSTRACT

A thermoacoustic refrigeration assembly includes a resonating tube having a first end and a second end; a first mechanical oscillator at the first end; a second mechanical oscillator at the second end; and a thermoacoustic stack sandwich disposed along a length of the resonating tube through which gas travels. The stack sandwich includes a first outboard heat exchanger on a first side of the stack sandwich facing the first mechanical oscillator, a second outboard heat exchanger on a second side of the stack sandwich facing the second mechanical oscillator, and a center heat exchanger disposed between the first outboard heat exchanger and the second outboard heat exchanger.

20 Claims, 45 Drawing Sheets

Related U.S. Application Data

(60) Provisional application No. 63/144,275, filed on Feb. 1, 2021.

(58) Field of Classification Search
USPC ..... 165/6
See application file for complete search history.

(56) References Cited

U.S. PATENT DOCUMENTS 5,813,234 A * 9/1998 Wighard ..... F02G 1/0435 62/467
5,857,340 A * 1/1999 Garrett ..... F25B 9/145 62/467
5,901,556 A * 5/1999 Hofler ..... H02K 35/06 62/467
6,032,464 A * 3/2000 Swift ..... F02G 1/02 60/520
6,164,073 A * 12/2000 Swift ..... F03G 7/002 60/517
6,385,972 B1 * 5/2002 Fellows ..... F02G 1/0435 60/517
6,415,611 B1 * 7/2002 Acharya ..... F25B 21/00 62/3.1
6,442,947 B1 * 9/2002 Mitchell ..... F25B 9/145 60/520
6,644,028 B1 * 11/2003 Swift ..... F25B 9/14 60/516
6,732,515 B1 * 5/2004 Weiland ..... F02G 1/0435 60/520
9,297,591 B1 * 3/2016 von Hack-Prestinary ..... F03G 7/04
11,371,431 B1 * 6/2022 Dyson, Jr. ..... F02C 1/05

OTHER PUBLICATIONS

Praitoon Chaiwongsa, Somchai Wongwises, "Effect of the Blockage Ratio of Circular Stack on the Performance of the Air-based Standing Wave Thermoacoustic Refrigerator using Heat Pipe", Case Studies in Thermal Engineering, Jan. 2021, https://doi.org/10.1016/j.csite.2021.100843.

Shintaro Kataoka and Shin-Ichi Sakamoto, "Measurement of temperature distribution with 3D-printer and etching meshes stack in thermoacoustic heat pump", Proceedings of Symposium on Ultrasonic Electronics, vol. 40, Nov. 25-27, 2019.

Rajwal C. Bansod, Ashish S. Raut, "Reviewon Themnoacoustic Refrigeration", International Journal of nnovations in Engineering and Science, vol. 2, No. 3, 2017, e-ISSN:2456-3463, www.ijies.net.

* cited by examiner

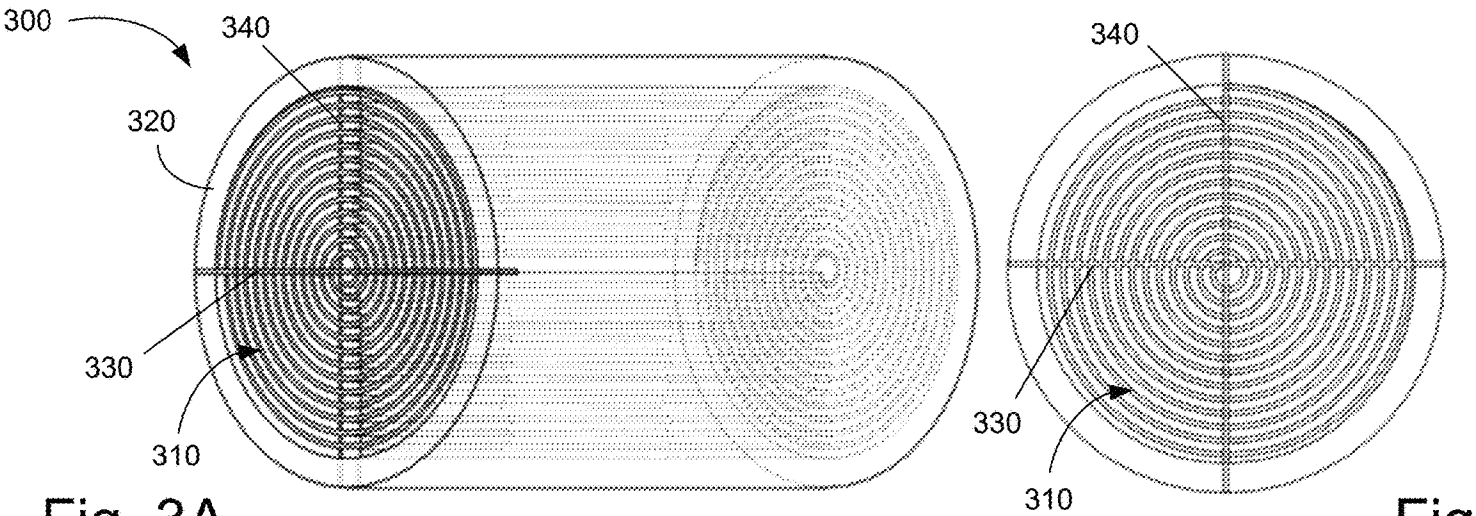
Fig. 3A
Fig. 3B
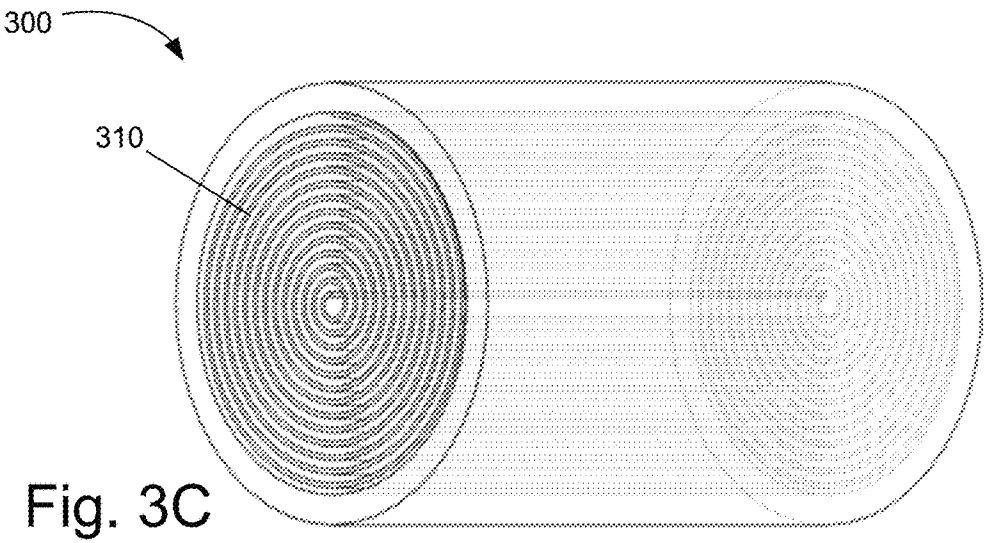
Fig. 3C
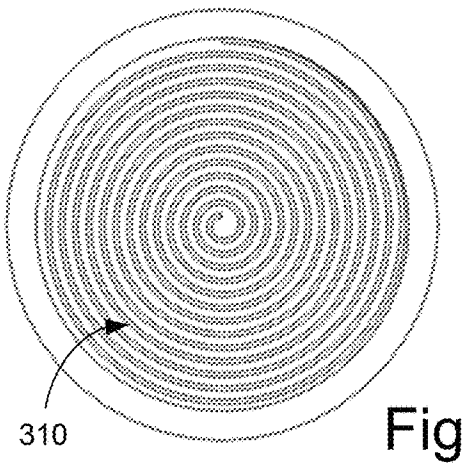
Fig. 3D

600

DOUBLE-ENDED THERMOACOUSTIC HEAT EXCHANGER

CROSS-REFERENCE TO RELATED APPLICATIONS

The application is a continuation-in-part of U.S. patent application Ser. No. 17/544,855, filed on Dec. 7, 2021, entitled THERMOACOUSTIC 3D PRINTED STACK AND HEAT EXCHANGER, which claims the benefit of priority from and is a non-provisional of U.S. Provisional Patent Application No. 63/144,275, filed on Feb. 1, 2021, entitled THERMOACOUSTIC 3D PRINTED STACKS AND HEAT EXCHANGERS, the entire disclosures of which are incorporated by reference.

STATEMENT OF GOVERNMENT INTEREST

The present invention was made by employees of the United States Department of Homeland Security in the performance of their official duties. The U.S. Government has certain rights in this invention.

FIELD

The discussion below relates generally to thermoacoustic refrigeration systems and assemblies and, more particularly, to double-ended symmetric standing wave thermoacoustic refrigeration systems and assemblies including thermoacoustic stacks and heat exchangers which may have configurations designed for additive manufacturing with low thermal conductivity and relatively high heat capacity.

BACKGROUND

Thermoacoustic heat pumps and refrigerators use acoustic energy to force heat transfer from lower-temperature sources to higher-temperature sinks by employing a porous medium to maintain a continuous temperature gradient. In thermoacoustic refrigerators, environmentally friendly gases are used as the thermodynamic working fluid. In addition to providing a clean technology, thermoacoustic technology has other interesting advantages, including a system with no moving parts, a simple structure, highly scalable components and requiring less equipment. Therefore, it has a longer estimated operating life than conventional refrigerators and requires less manufacturing and maintenance costs.

A thermoacoustic refrigerator of the standing wave variety typically includes a quarter-wavelength resonator (an open-closed tube) driven by an acoustic energy, typically from a loudspeaker or a thermoacoustic heat engine being run by a separate thermal energy source (solar or process waste heat is common). An important part of the thermoacoustic refrigerator is the stack, which has a large number of closely spaced adjacent surfaces aligned parallel to the length of the resonator tube. The stack may be constructed by winding a roll of 35-mm photographic film in an example. Lengths of a nylon fishing line may be used to separate adjacent layers of the spirally wound film stack so that air could oscillate longitudinally between the layers along the length of the stack parallel to the length of the resonator tube. The thermoacoustic effect (i.e., the formation of a longitudinal temperature gradient) is created along the porous structure of the stack.

SUMMARY

Embodiments of the present invention are directed to apparatuses and methods for providing thermoacoustic heating and cooling systems. A thermoacoustic stack permits the formation and maintenance of a thermal temperature gradient in the way of a sustained acoustic disturbance, permitting the forced movement of thermal energy from a region of lower temperature to a region of higher temperature. Specific embodiments provide thermoacoustic stacks of unique geometry and construction specifically designed for additive manufacturing techniques using polymer materials with a relatively low thermal conductivity and a relatively high heat capacity. To enhance the rate at which heat is "pumped" through the stack by the acoustic work energy, heat exchangers have been designed and fabricated to extract thermal energy from the warm end of the stack to be discharged to a heat sink and to transfer thermal energy from a refrigerated space to the cooler end of the stack. The warmer end of the stack must be at higher temperature than the environment to which heat is being rejected and the cooler end of the stack must be at lower temperature than the refrigerated space in order for the refrigerative effect to be realized.

A double-ended thermoacoustic refrigeration assembly has two opposed mechanical oscillators such as acoustic drivers with a symmetric stack sandwich in the center of the resonating tube. The stack sandwich has two hot side outboard heat exchangers and a cold heat exchanger in the middle of the stack sandwich. By having two adjustable mechanical oscillators the pressure and displacement waveform profiles can be more finely manipulated by adjusting the relative phase displacement and/or frequency of the two oscillators. This potentially allows the device to be more compact, as it is no longer limited to the geometrically determined resonant frequency of the tube.

An aspect is directed to a thermoacoustic refrigeration assembly comprising: a resonating tube having a first end and a second end; a first mechanical oscillator at the first end; and a second mechanical oscillator at the second end. A first thermoacoustic stack is disposed along a length of the resonating tube through which gas travels. The first thermoacoustic stack has a first outboard side heat exchanger disposed on a first outboard side facing away from the first mechanical oscillator and a first inboard side heat exchanger disposed on a first inboard side facing toward the first mechanical oscillator. The first inboard side heat exchanger is disposed between the first outboard side heat exchanger and the first mechanical oscillator. A second thermoacoustic stack is disposed along the length of the resonating tube and between the first thermoacoustic stack and the second mechanical oscillator. The second thermoacoustic stack has a second outboard side heat exchanger disposed on a second outboard side facing away from the second mechanical oscillator and a second inboard side heat exchanger disposed on a second inboard side facing toward the second mechanical oscillator. The second inboard side heat exchanger is disposed between the second outboard side heat exchanger and the second mechanical oscillator.

Another aspect is directed to a thermoacoustic refrigeration assembly comprising: a resonating tube having a first end and a second end; a first mechanical oscillator at the first end; and a second mechanical oscillator at the second end. A thermoacoustic stack sandwich is disposed along a length of the resonating tube through which gas travels. The stack sandwich includes a first outboard heat exchanger on a first side of the stack sandwich facing the first mechanical oscillator, a second outboard heat exchanger on a second side of the stack sandwich facing the second mechanical oscillator, and a center heat exchanger disposed between the first outboard heat exchanger and the second outboard heat exchanger.

Yet another aspect is directed to a thermoacoustic method for a resonating tube having a first end and a second end and a thermoacoustic stack sandwich disposed along a length of the resonating tube through which gas travels, the stack sandwich including a first outboard heat exchanger on a first side of the stack sandwich facing the first end, a second outboard heat exchanger on a second side of the stack sandwich facing the second end, and a center heat exchanger disposed between the first outboard heat exchanger and the second outboard heat exchanger. The method comprises driving first compressible gas parcels from the first end of the resonating tube toward the second end through the stack sandwich and driving second compressible gas parcels from the second end of the resonating tube toward the first end through the stack sandwich.

Other features and aspects of various embodiments will become apparent to those of ordinary skill in the art from the following detailed description which discloses, in conjunction with the accompanying drawings, examples that explain features in accordance with embodiments. This summary is not intended to identify key or essential features, nor is it intended to limit the scope of the invention, which is defined solely by the claims.

BRIEF DESCRIPTION OF THE DRAWINGS

The attached drawings disclose the embodiments.

FIG. 3A is an oblique front elevational view of a spiral-channel stack according to another embodiment, FIG. 3B is a left end view thereof, FIG. 3C is an oblique rear elevational view thereof, and FIG. 3D is a right end view thereof.

DETAILED DESCRIPTION

A number of examples or embodiments of the present invention are described and disclosed herein. The present invention provides many applicable inventive concepts that have been disclosed and can be embodied in a variety of ways. Rather, as will be appreciated by one of skill in the art, the teachings and disclosures herein can be combined or rearranged with other portions of this disclosure along with the knowledge of one of ordinary skill in the art.

Mechanical and Thermal Interactions in Thermoacoustic Stack

Figure 1:
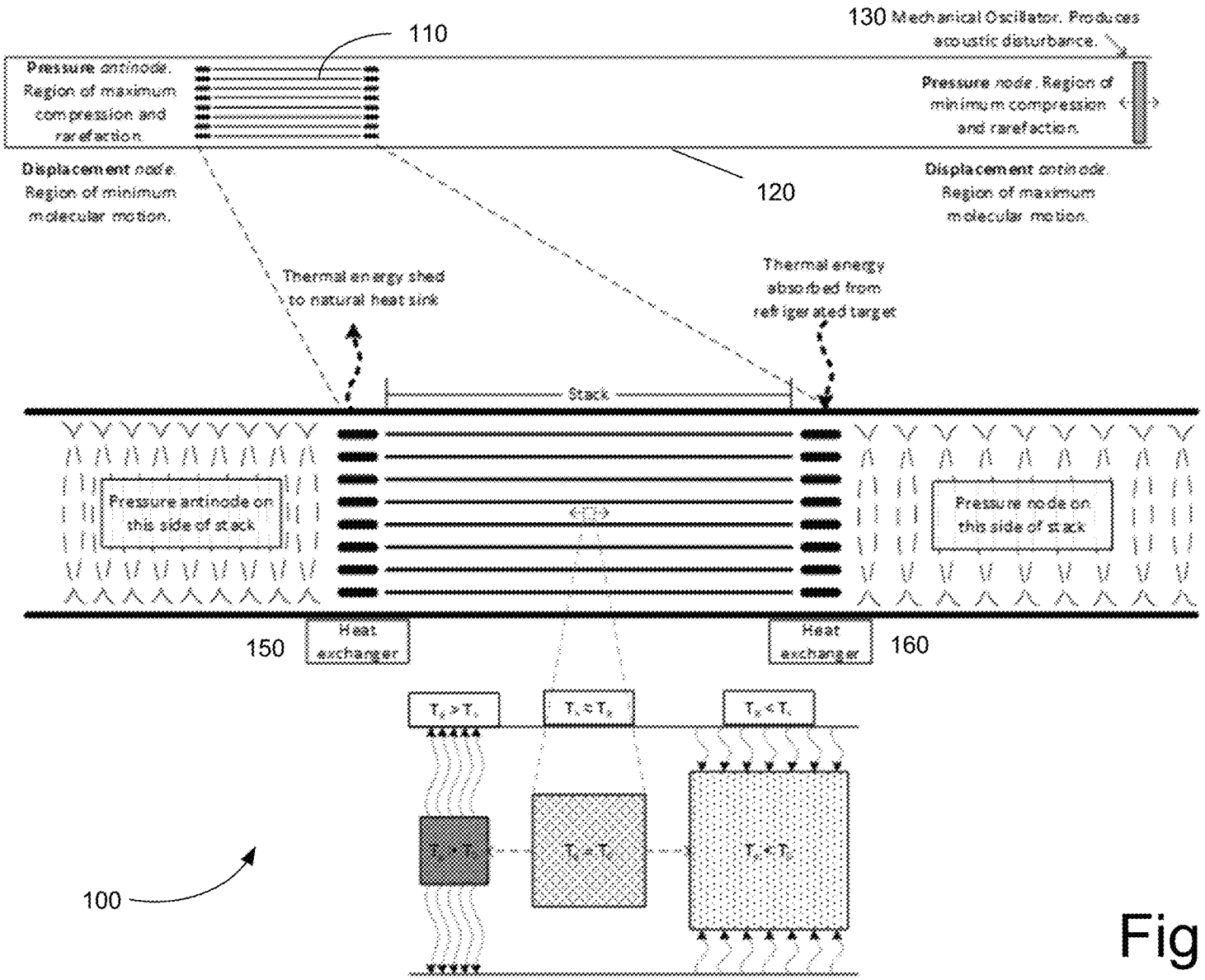
FIG. 1 schematically illustrates a thermoacoustic refrigeration apparatus which includes a thermoacoustic stack with heat exchangers wherein compressible gas parcels oscillate longitudinally through the thermoacoustic stack due to an acoustic standing wave.

FIG. 1 schematically illustrates a thermoacoustic refrigeration apparatus which includes a thermoacoustic stack with heat exchangers wherein compressible gas parcels oscillate longitudinally through the thermoacoustic stack due to an acoustic standing wave. The schematic view of FIG. 1 illustrates the basic theory of a thermoacoustic refrigeration apparatus 100 by showing mechanical and thermal interactions. A thermoacoustic stack 110 is disposed along a length of a resonating tube 120 through which gas travels (leftward and rightward in the example shown). On the right side of the resonating tube is a mechanical oscillator 130 that can be used to produce acoustic disturbance.

Compressible gas "parcels" oscillate longitudinally through the stack due to an acoustic standing wave. When moving toward the pressure antinode (leftward, as shown), the parcel encounters higher pressure and its temperature rises as a result of nearly adiabatic compression, allowing it to shed thermal energy to the relatively cooler local portion of the stack surface. As seen in the example of FIG. 1, the pressure antinode on the left side is a region of maximum compression and rarefaction. It is also referred to as a displacement node which is a region of minimum molecular motion.

Next, the parcel travels toward the pressure node (rightward, as shown) and experiences rarefaction, causing its temperature to drop as a result of nearly adiabatic expansion, permitting the absorption of thermal energy from the relatively warmer local stack surface. As seen in FIG. 1, the pressure node on the right side is a region of minimum compression and rarefaction. It is also referred to as a displacement antinode which is a region of maximum molecular motion.

In this way, adjacent gas parcels incrementally "pump" a net positive amount of thermal energy toward the pressure antinode (leftward). Removal of the aggregate thermal energy at the warm end (left side as shown) of the stack via a warm side heat exchanger 150 permits continued absorption of low-temperature thermal energy from a refrigerated target at the cool end (right side as shown) of the stack 110 via a cool side heat exchanger 160.

Embodiments

The thermoacoustic stack provides narrow longitudinal channel(s) between adjacent wall surfaces oriented parallel to the propagation of directionally bound acoustic disturbances in a standing-wave resonating chamber or tube. Due to oscillatory movement of the thermoacoustic medium (e.g., compressible gas in a tested embodiment) and position-based oscillatory pressurization, the microscopically scaled constituent "parcels" of the medium simultaneously travel longitudinally toward one end of the stack and experience greater pressure (leftward travel toward the left end in FIG. 1). As such, they experience polytropic compression, with a polytropic exponent nearing the value yielding adiabatic compression. This compression causes each constituent to experience a rise in temperature.

A main function of the stack is to create a temperature gradient by absorbing a large amount of heat. The spacing between adjacent wall surfaces of the stack is determined by the thermal penetration depth, $\delta_k$. The thermal penetration depth is the distance over which effective heat transfer may occur between the gas parcel and an adjacent surface. On the one hand, the spacing should be as small as possible so that more gas is available within this region to increase the heat interaction between the working gas and the stack surface along with an increase in the heat transfer area. On the other hand, a spacing that is very small may create pressure disturbance near the stack and restrict the oscillatory displacement of the gas through viscous influence. In an embodiment, the stack wall spacing is typically between 2& and 4 $\delta_k$ (e.g., 3 $\delta_k$).

Figure 9A:
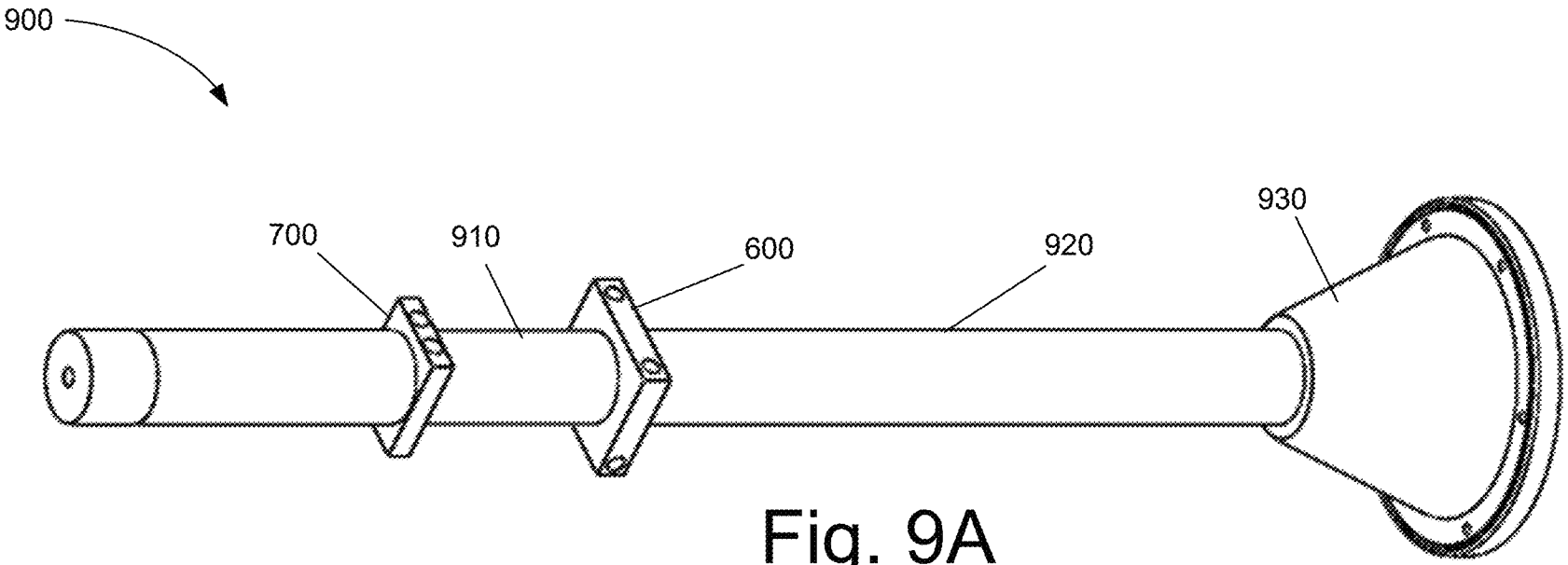
FIG. 9A is a perspective view of a constructed refrigeration assembly and FIG. 9B is a perspective view thereof with internal features shown in broken lines, illustrating, in the circled portion, the recessed-type fluid-enhanced heat exchanger on the right side of the stack, a spiral-type stack, and a protruding-type fluid-enhanced heat exchanger on the left side.
Figure 9B:
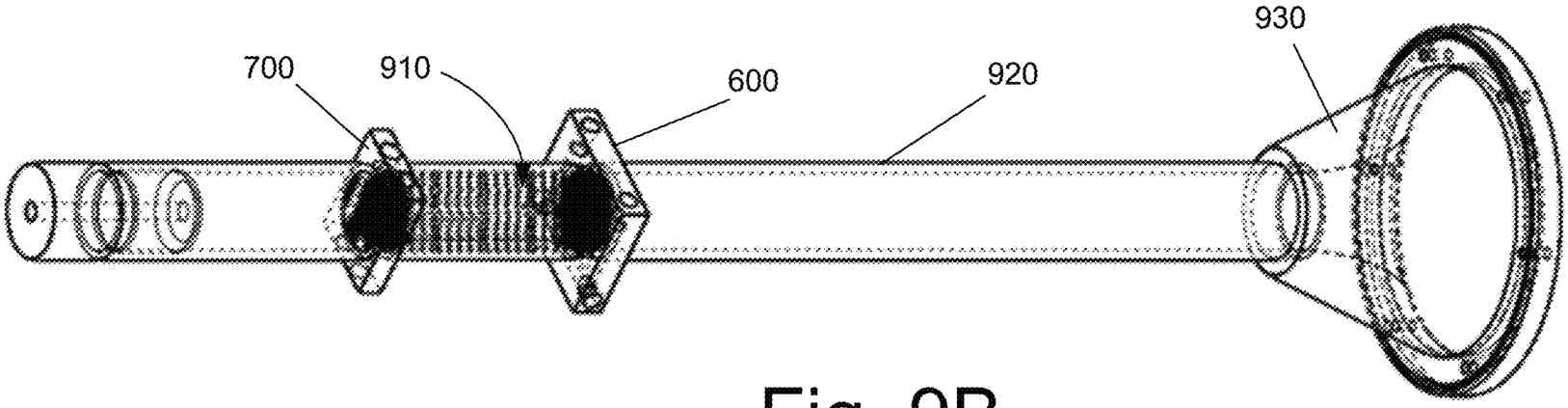

FIG. 1 illustrates the theory behind the thermoacoustic apparatus while FIGS. 9A and 9B illustrate a prototyped embodiment. Because each constituent is within the thermal penetration depth region of the stack channel's walls, the higher-temperature compressed medium is able to transfer thermal energy to the stack whenever its temperature exceeds the stack material's temperature. Conversely, when the acoustic standing wave causes movement of the medium toward the other end of the stack (rightward travel toward the right end in FIG. 1), the pressure decreases and the constituent parcel expands polytropically (again, nearing the adiabatic threshold); its temperature decreases accordingly. Since the parcel had just relinquished some of its thermal energy to the warmer end (left end in FIG. 1) of the stack, its temperature now drops further and, in aggregate, provides a refrigerative effect. If heat exchangers are placed at either end of the stack, with the warmer (i.e., compressively heated) end of the stack shedding its heat to the ambient environment and the cooler (i.e., expanded) end connected to a refrigerated environment, the stack allows the mechanically induced acoustic standing wave to act as a refrigerator. The stack "pumps" thermal energy from the cooler end to the warmer end via mechanically induced longitudinal motion of the thermoacoustic medium within the stack.

In one embodiment, the stack is manufactured by 3D printing additively with PLA (polylactic acid) filament. 3D printing provides an effective technique for creating the flow path shape of the stack. Polylactic acid can easily be fabricated into the desired geometries via extruded additive manufacturing techniques, has a relatively high heat capacity, and has a relatively low thermal conductivity to discourage the longitudinal migration of thermal energy within the stack itself, which maintains the desired thermal gradient. When a tighter tolerance is desired, stereolithographic techniques using resin may be ideal, as it also possesses low thermal conductivity. Maintenance of the longitudinal thermal gradient can be further enhanced via microscopic conduction disruption effects inherent of very thin geometries.

$$\text{General polytropic process: } Pv^n = \text{Constant} \Longrightarrow P_1 v_1^n = P_2 v_2^n$$

$$n_{adiabatic} = \gamma = \frac{c_p}{c_v} = \frac{1.005\frac{\text{kJ}}{\text{kg}\cdot\text{K}}}{0.718\frac{\text{kJ}}{\text{kg}\cdot\text{K}}} = 1.4 \text{ (for air at room temperature)}$$

$$\text{Adiabatic process: } P_1 v_1^{1.4} = P_2 v_2^{1.4}$$

where P is pressure and v is volume of the thermoacoustic system.

A thermoacoustic system may comprise the thermoacoustic stack, a first heat exchanger connected with the outer wall at the first end, and a second heat exchanger connected with the outer wall at the second end. At least one of the first heat exchanger and the second heat exchanger may have a perforated core region including a plurality of parallel longitudinal openings and may be of a recessed construction to form a female socket into which a resonating tube recesses to make a male-to-female connection. At least one of the first heat exchanger and the second heat exchanger may have a channel to receive a fluid passing therethrough to absorb or discharge heat.

The following describes examples of three different channel configurations: 1) single-channel bound by a spiral wall (e.g., spiral stack geometry), 2) multi-channel "slots" bound by linear walls (e.g., parallel stack geometry), and 3) multi-channel square tubes arranged in a grid (e.g., pin array stack geometry).

Figure 2B:
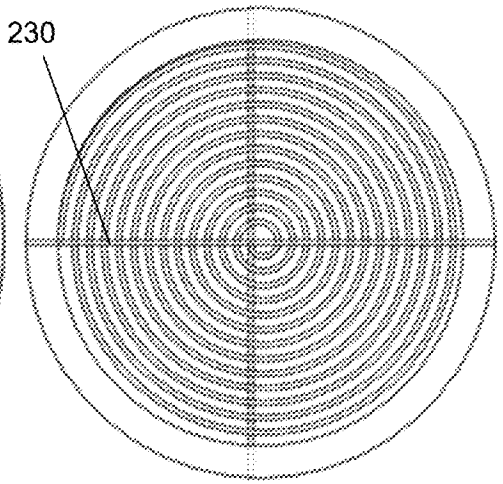
FIG. 2B is a left end view thereof.
Figure 2A:
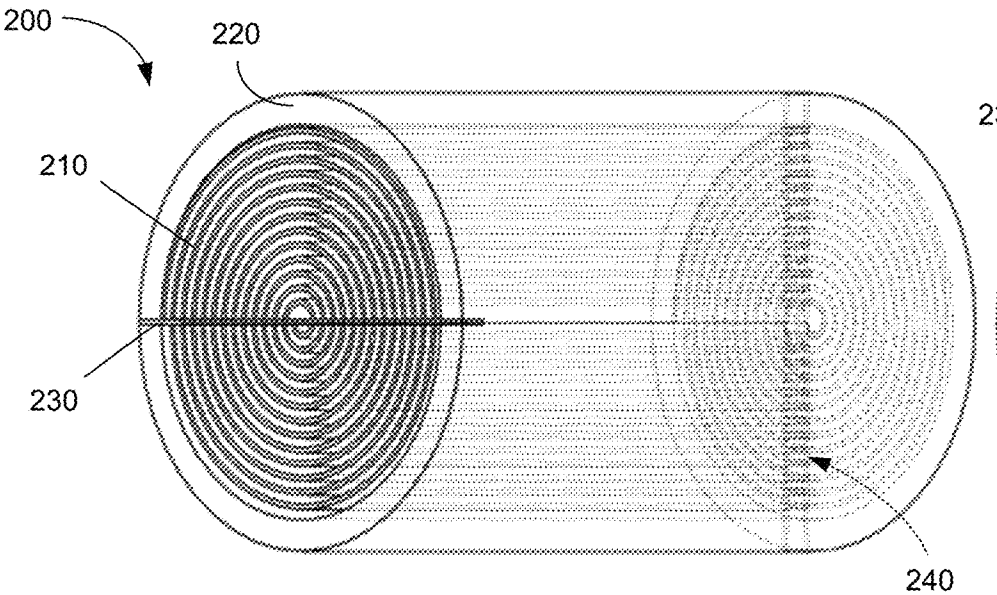
FIG. 2A is an oblique front elevational view of a spiral-channel stack according to an embodiment.
Figure 2C:
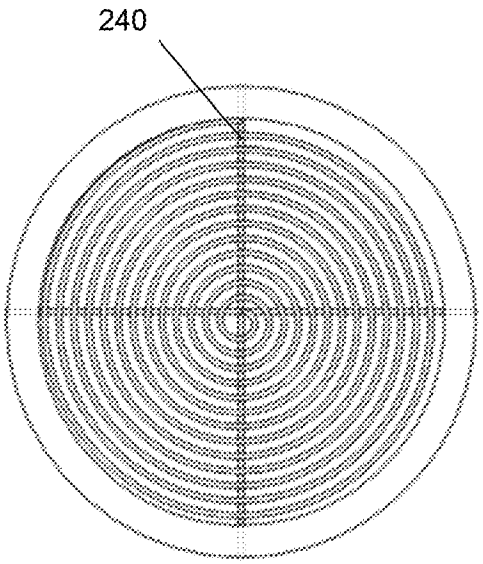
FIG. 2C is a right end view thereof.

FIG. 2A is an oblique front elevational view of a spiral-channel stack according to an embodiment, FIG. 2B is a left end view thereof, and FIG. 2C is a right end view thereof. The spiral-channel stack 200 includes a spiral wall 210 disposed inside an outer wall 220. The outer wall 220 has a length extending between a first end and a second end. In the embodiment shown, the outer wall 220 is a circular cylindrical wall, but other geometrical shapes may be used in other embodiments (e.g., elliptical or polygonal).

An internal wall structure is disposed inside the outer wall and may extend between the first end and the second end. The internal wall structure includes a plurality of spaced adjacent wall surfaces extending along the length of the outer wall between the first end and the second end to provide open flow passages between the spaced adjacent wall surfaces. The open flow passages may extend between the first end and the second end. In general, the internal wall structure may include a plurality of adjacent wall surfaces that are substantially parallel to the length of the outer wall (e.g., parallel ±5° or parallel ±1°). In embodiments, the inner wall structure may have one or more through passages between interior walls allowing flow between inner wall surfaces.

In this embodiment, the internal wall structure includes a spiral wall. The spiral wall 210 has an outer edge connected to an interior surface of the outer wall 220 and an inner edge spiraling circumferentially outward to the outer edge. The inner edge may be disposed at a center of the cross-sectional opening provided by the outer wall 220. The spiral wall 210 may extend parallel to the length of the outer wall 220 between the first end and the second end to provide a spiral-shaped open flow passage between adjacent wall surfaces of the spiral wall.

The spiral wall 210 has closely spaced adjacent surfaces aligned parallel to the length of the resonator tube 120. The stack may be constructed by 3D printing additively with PLA resin. 3D printing provides an effective technique for creating the flow path shape of the stack. PLA can be fabricated easily into the desired geometries via extruded additive manufacturing techniques, has a relatively high heat capacity, and has a relatively low thermal conductivity to discourage the longitudinal migration of thermal energy within the stack itself, which maintains the desired thermal gradient. When a tighter tolerance is desired, stereolithographic techniques using resin may be employed to provide a relatively low thermal conductivity.

3D printing generates closely spaced surfaces of the spiral wall 210 having a uniform spacing (e.g., a deviation of less than ±20%, or less than ±10%, or less than ±5%). The spiral stack layers are a few thermal penetration depths apart (e.g., 2 to 4); in some cases, 4 thermal penetration depths may be the optimum layer separation. In one example, the thermal penetration depth is the square root of ((thermal conductivity)/(pi*standing wave frequency*density*isobaric specific heat per unit mass)). If the stack layers are too far apart, the gas cannot effectively transfer heat to and from the stack walls. If the stack layers are too close together, viscous effects hamper the motion of the gas particles.

To maintain the structural integrity or stability of the spiral wall 210 and the uniform stack spacing, one or more cross bars or cross members are provided at or near the two ends of the spiral-channel stack 200. FIGS. 2A to 2C show a first cross member 230 at the first end of the stack 200 and a second cross member 240 at the second end of the stack 200 opposite from the first end. The first cross member 230 extends across the spiral wall 210 of the stack 200 at the first end between the outer wall 220 and is connected to the spiral wall 210 at the first end. The second cross member 240 extends across the spiral wall 210 of the stack 200 at the second end between the outer wall 220 and is connected to the spiral wall 210 at the second end. The cross members may be formed integrally with the outer wall 220 and the spiral wall 210 by 3D printing or the like.

In the embodiment shown, the first cross member 230 and the second cross member 240 are circumferentially spaced from one another by an angle. The angle may be about 45 to 135 degrees, or about 60 to 120 degrees, or about 75 to 105 degrees, or about 90 degrees (e.g., 90°±5%).

FIG. 3A is an oblique front elevational view of a spiral-channel stack according to another embodiment, FIG. 3B is a left end view thereof, FIG. 3C is an oblique rear elevational view thereof, and FIG. 3D is a right end view thereof. The spiral-channel stack 300 includes a spiral wall 310 disposed inside an outer wall 320. The spiral-channel stack 300 is similar to the spiral-channel stack 200 of FIGS. 2A-2C.

The spiral-channel stack 300 has two cross members 330, 340 at a first end of the stack to stabilize the spiral wall structure and no cross members at the second end of the stack. The cross members 330, 340 each extend across the spiral wall 310 of the stack 300 at the first end between the outer wall 320 and are connected to the spiral wall 310 at the first end. The cross members may be formed integrally with the outer wall 320 and the spiral wall 310 by 3D printing or the like. The first cross member 330 and the second cross member 340 are circumferentially spaced from one another by a circumferential angle. The angle may be about 45 to 135 degrees, or about 60 to 120 degrees, or about 75 to 105 degrees, or about 90 degrees (e.g., 90°±5%).

When the first cross member (230, 330) and/or the second cross member (240, 340) are connected to the first end or the second end of the stack, they cover a portion of an area of an outer wall opening surrounded by the outer wall (220, 320) at the first end or the second end. The covered portion is generally kept to a minimum. For example, the covered portion but the cross members may be less than about 5% or less than about 1% of the area of the outer wall opening.

Figure 4B:
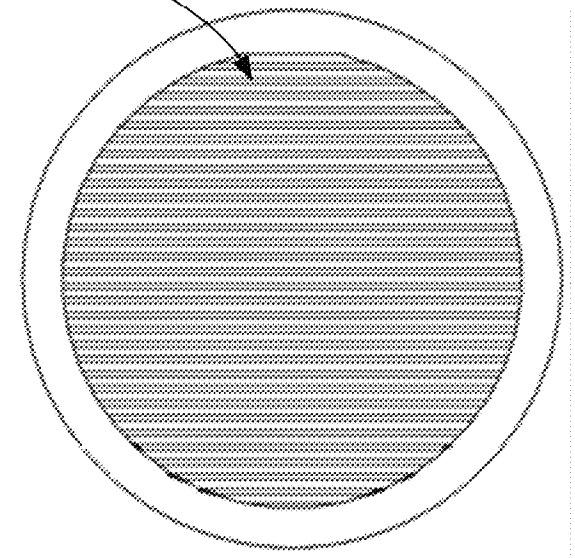
FIG. 4A is a perspective view of a slot-channel stack according to another embodiment and FIG. 4B is an end view thereof.
Figure 4A:
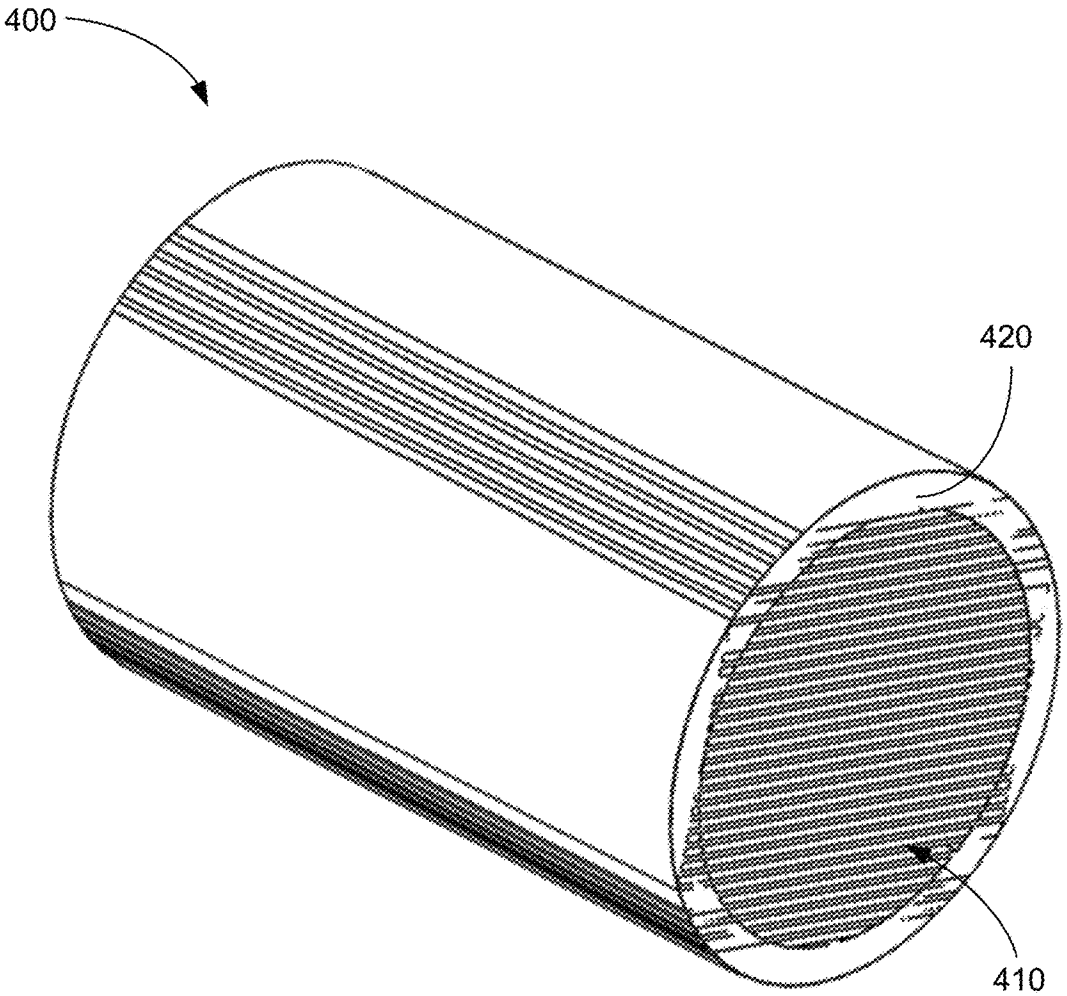

FIG. 4A is a perspective view of a slot-channel stack according to another embodiment and FIG. 4B is an end view thereof. The slot-channel stack 400 includes a plurality of parallel walls 410 disposed inside an outer wall 420. The parallel walls 410 are substantially uniformly spaced (e.g., uniform spacing ±10% deviation). In the embodiment shown, the outer wall 420 is a circular cylindrical wall, but other geometrical shapes may be used in other embodiments. The parallel walls 410 have closely spaced adjacent surfaces aligned parallel to the length of the resonator tube 120. The stack may be constructed by 3D printing additively with PLA resin. The slot-channel stack layers (i.e., parallel walls 410) are a few thermal penetration depths apart (e.g., 2 to 4).

The parallel walls 410 typically are structurally more stable than the spiral wall 310 of FIGS. 2A-3C. If additional structural stability is desired, a cross member similar to those shown in FIGS. 2A-3C may be added. In one example, a cross member may be provided at or near one end of the slot-channel stack 400 and extend between the outer wall 420 perpendicularly to the parallel walls 410. The cross member is connected to the parallel walls 410. In another example, another cross member may be provided at or near an opposite end of the slot-channel stack 400 and extend between the outer wall 420 perpendicularly to the parallel walls 410 at the opposite end. The cross member(s) may be formed integrally with the outer wall 420 and the parallel walls 410 by 3D printing or the like.

Figures 5A, 5B:
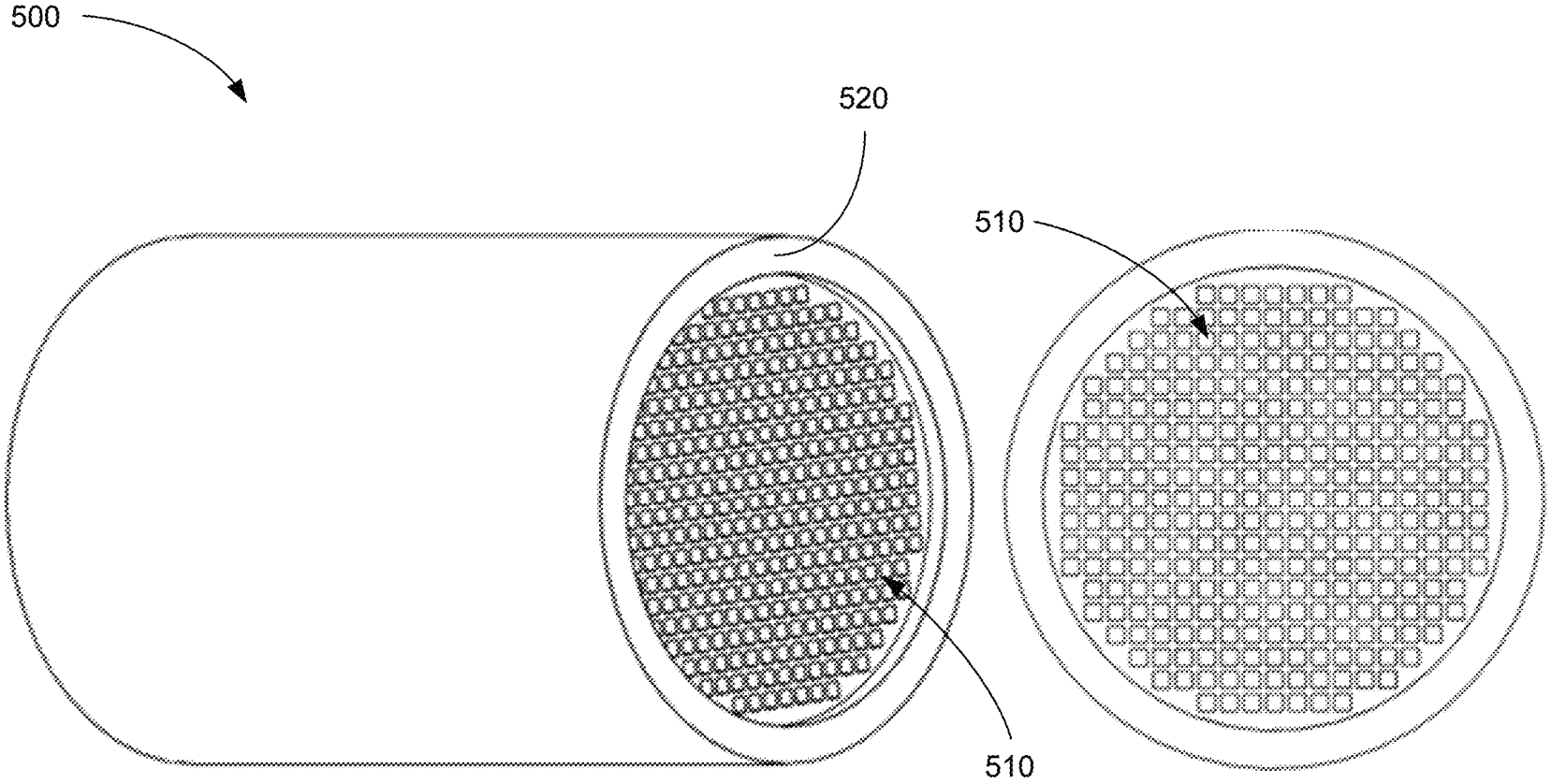
FIG. 5A is a perspective view of a tube-channel stack according to another embodiment and FIG. 5B is an end view thereof.

FIG. 5A is a perspective view of a tube-channel stack according to another embodiment and FIG. 5B is an end view thereof. The tube-channel stack 500 includes a plurality of uniformly spaced parallel and transverse walls 510 disposed inside an outer wall 520. In the embodiment shown, the outer wall 520 is a circular cylindrical wall, but other geometrical shapes may be used in other embodiments. The parallel and transverse walls 510 have closely spaced adjacent surfaces aligned parallel to the length of the resonator tube 120. The stack may be constructed by 3D printing additively with PLA resin. The tube-channel stack layers are a few thermal penetration depths apart (e.g., 2 to 4). The plurality of parallel walls are substantially uniformly spaced (e.g., uniform spacing ±10% deviation) and the plurality of transverse walls are substantially uniformly spaced (e.g., uniform spacing ±10% deviation) and substantially perpendicular to the parallel walls (e.g., 90°±10°).

The parallel and transverse walls 510 are relatively more stable structurally than the spiral wall 310 of FIGS. 2A-3C and the parallel walls 410 of FIGS. 4A-4C. If additional structural stability is desired, a cross member similar to those shown in FIGS. 2A-3C may be added. In one example, a first cross member may be provided at or near a first end of the slot-channel stack 500 and extend between the outer wall 520 at an angle of about 45° to the parallel and transverse walls 510. The first cross member is connected to the parallel and transverse walls 510. In another example, an additional second cross member may be provided at or near a second end of the tube-channel stack 500 opposite from the first end and extend between the outer wall 520 at an angle of about 45° to the parallel and transverse walls 510 at the second end. The second cross member may be parallel to or disposed at a circumferential angle relative to the first cross member. In one example, the first and second cross members may be circumferentially spaced by about 90° in a manner similar to those shown in FIGS. 2A-2C. The cross member (s) may be formed integrally with the outer wall 520 and the parallel and transverse walls 510 by 3D printing or the like.

Figure 6C:
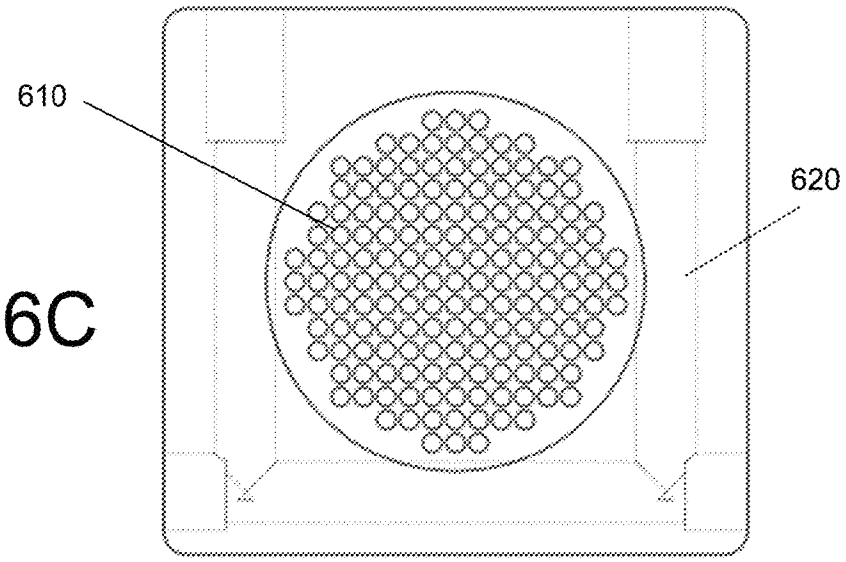
FIG. 6C is an internal end view thereof.
Figure 6B:
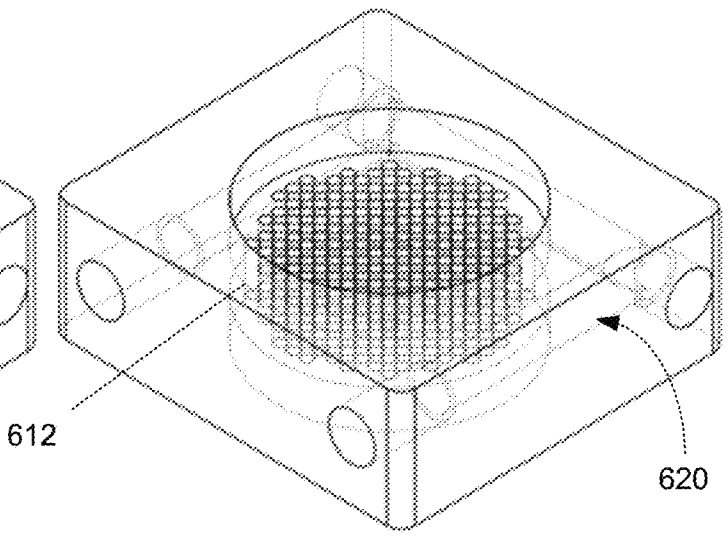
FIG. 6B is a perspective view thereof showing the external loop fluid passages.
Figure 6A:
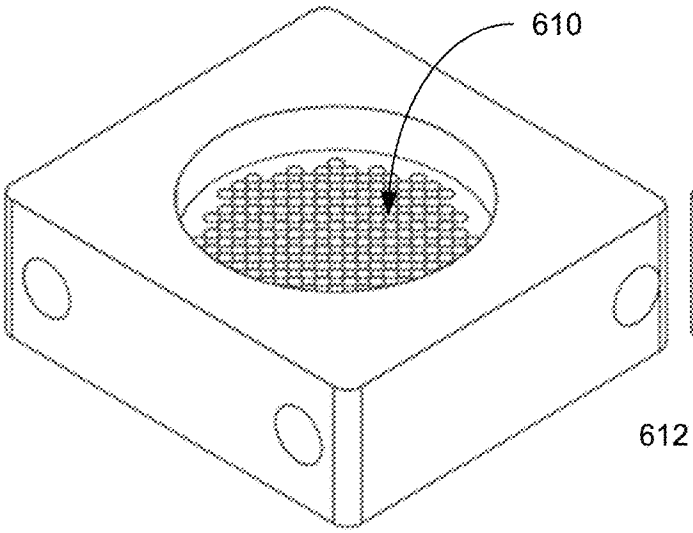
FIG. 6A is a perspective view of a recessed-type external-loop fluid-enhanced heat exchanger according to an embodiment.

FIG. 6A is a perspective view of a recessed-type external-loop fluid-enhanced heat exchanger 600 according to an embodiment, FIG. 6B is a perspective view thereof showing the external loop fluid passages, and FIG. 6C is an internal end view thereof.

This heat exchanger 600 may be constructed of a material with a large thermal conductivity (e.g., greater than about 80 W/m-K or greater than about 150 W/m-K) and a low heat capacity (e.g., lower than about 1200 J/kg-K or lower than about 900 J/kg-K). An example is aluminum alloy which was used in a prototype due to its ease of machinability and machining equipment available to the inventors. Copper would be another viable material and silver would be the best. The heat exchanger 600 has a perforated core region 610 including a plurality of parallel longitudinal openings 612 through which acoustic waves may propagate and a U-shaped channel 620 through which a thermal fluid may flow to absorb or discharge heat. The perforated core region 610 is of a recessed construction to form a female portion or socket into which the resonating tube recesses to make a male-to-female connection. When placed on the warm end of the stack, the heat exchanger solid material directly absorbs thermal energy from the warm end of the stack and passes it to the fluid, which advects it away via bulk fluid motion precipitated by a pump through the U-shaped channel 620. Similarly, at the cold end, a thermal fluid sheds thermal energy to the heat exchanger solid material, which is then absorbed by the thermoacoustic medium only to be "pumped" up the stack to the warmer end.

Figure 7C:
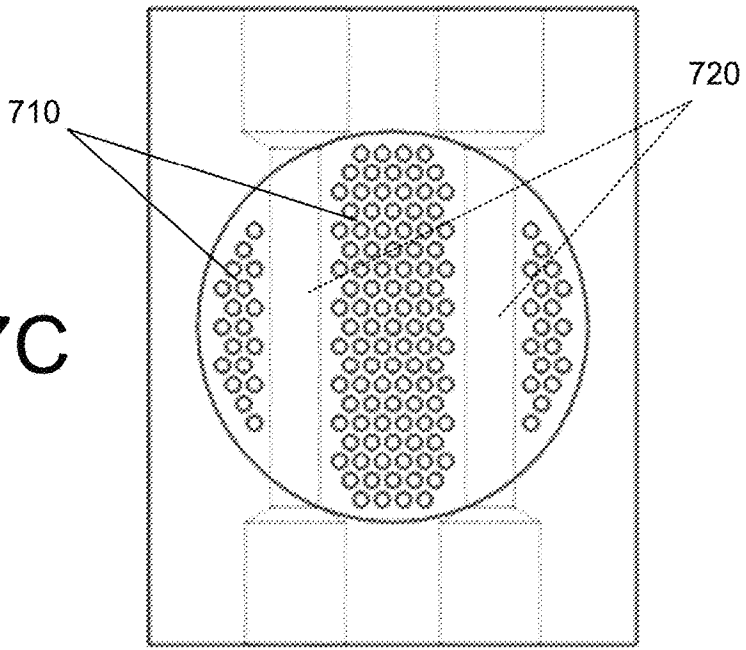
FIG. 7C is an internal end view thereof.
Figure 7B:
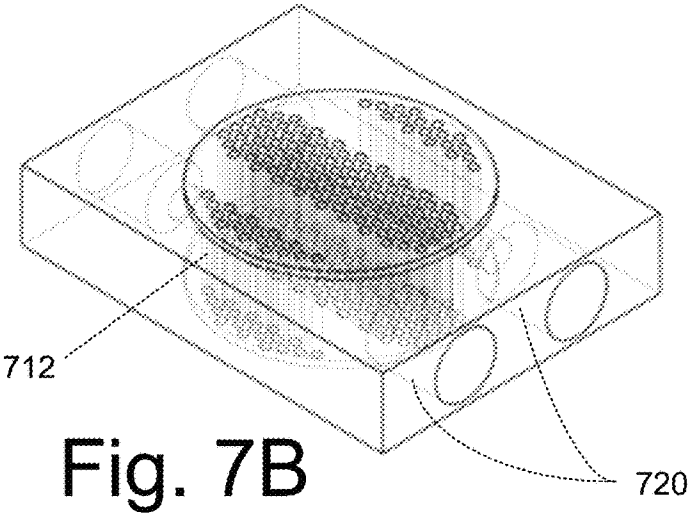
FIG. 7B is a perspective view thereof showing the fluid passages.
Figure 7A:
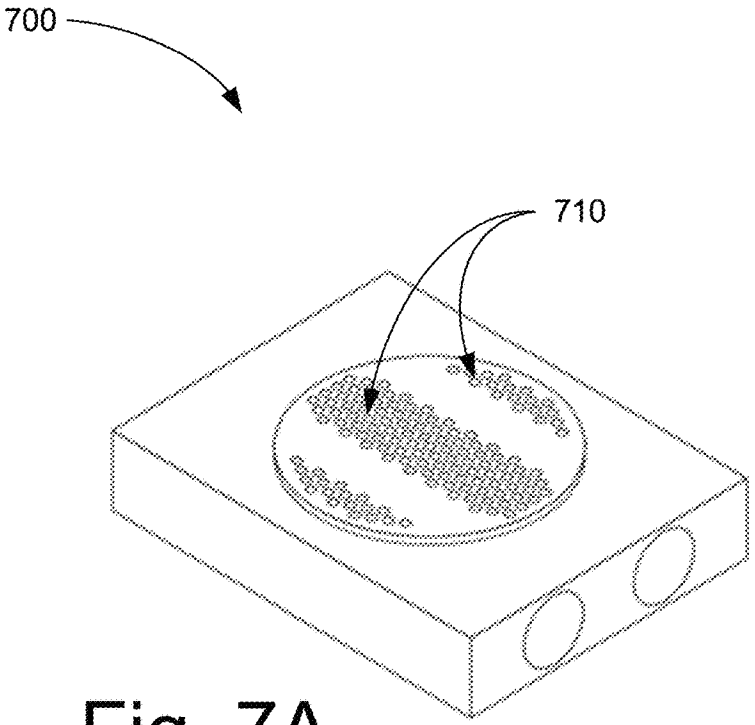
FIG. 7A is a perspective view of a protruding-type fluid-enhanced heat exchanger according to an embodiment.

FIG. 7A is a perspective view of a protruding-type fluid-enhanced heat exchanger according to an embodiment, FIG. 7B is a perspective view thereof showing the fluid passages, and FIG. 7C is an internal end view thereof.

This heat exchanger 700 may be constructed of a material with a large thermal conductivity and a low heat capacity, similar to the heat exchanger 600. An example is aluminum alloy. The heat exchanger 700 has a protruding perforated core region 710 including parallel longitudinal openings 712 through which acoustic waves may propagate and parallel channels 720 penetrating the core through which a thermal fluid may flow to absorb or discharge heat. The channels 720 displace areas where perforations could be, somewhat limiting the free area through which acoustic energy may propagate. When placed on the warm end of the stack, the heat exchanger solid material directly absorbs thermal energy from the warm end of the stack and passes it to the fluid, which advects it away via bulk fluid motion precipitated by a pump. Similarly, at the cold end, a thermal fluid sheds thermal energy to the heat exchanger solid material, which is then absorbed by the thermoacoustic medium only to be "pumped" up the stack to the warmer end. The design of the heat exchanger 700 is such that it provides a protruding male plug that recesses into the resonating tube.

Figure 8B:
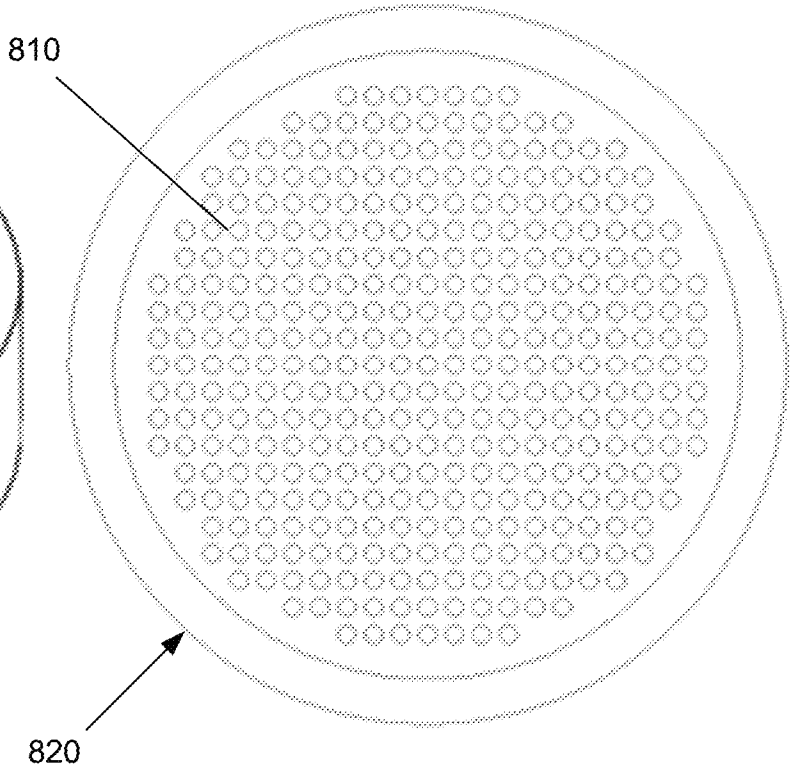
FIG. 8A is a perspective view of a protruding-type passive heat exchanger according to an embodiment and FIG. 8B is an internal end view thereof.
Figure 8A:
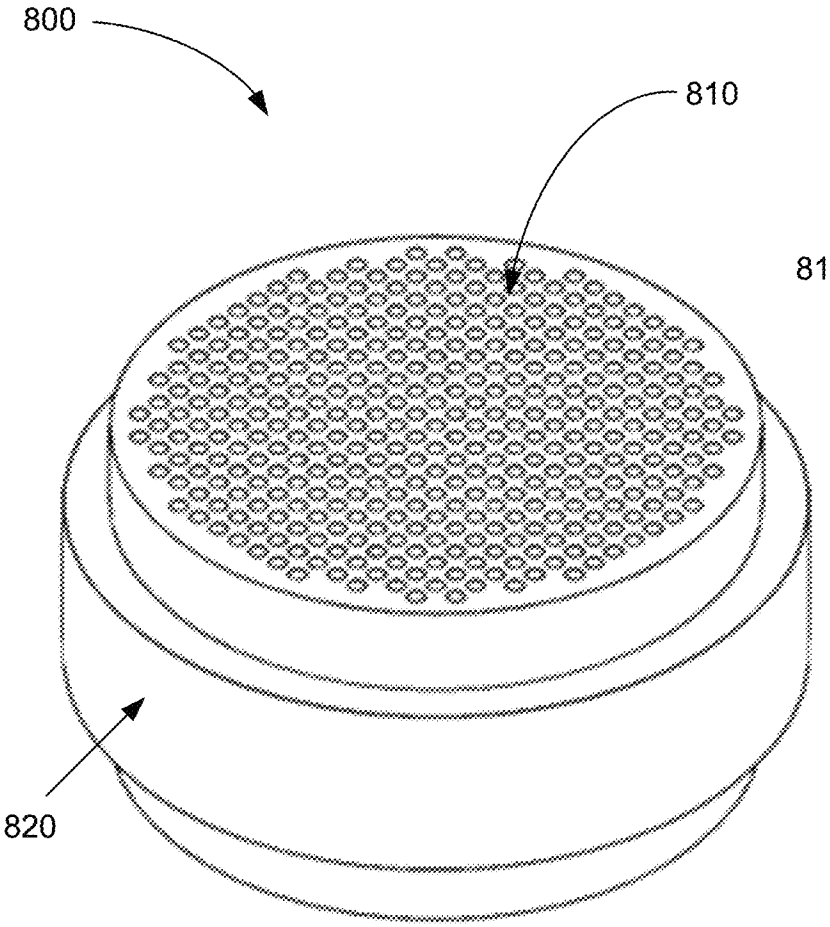

FIG. 8A is a perspective view of a protruding-type passive heat exchanger according to an embodiment and FIG. 8B is an internal end view thereof. This heat exchanger 800 may be constructed of a material with a large thermal conductivity and a low heat capacity, similar to the heat exchanger 600. An example is aluminum alloy. The heat exchanger 800 has a protruding perforated core region 810 including a plurality of parallel longitudinal openings through which acoustic waves may propagate and an external surface 820 through which heat may be transferred by convection to or from the immersed environment. When placed on the warm end of the stack, the heat exchanger solid material directly absorbs thermal energy from the warm end of the stack and passes it to the outermost surface 820, which communicates via free or forced convection with the immersed environment. Similarly, at the cold end, a relatively cooler immersed environment sheds thermal energy to the heat exchanger's outer surface 820, which is then absorbed by the thermoacoustic medium only to be "pumped" up the stack to the warmer end. The design of the heat exchanger 800 is such that it provides a male plug that recesses into the resonating tube.

FIG. 9A is a perspective view of a constructed refrigerative assembly 900 in which a thermoacoustic stack 910 is disposed along a length of a resonating tube 920 through which gas travels (leftward and rightward in the example shown). The stack 910 is a spiral-type stack in a prototype. On the right side of the resonating tube 920 is a mechanical oscillator 930 such as a loudspeaker that can be used to produce a standing wave proportional to the length of the resonating tube. The stack 910 is connected to a left-side heat exchanger at a left end or first end and is connected to a right-side heat exchanger at a right end or second end. A left portion of the resonating tube 920 is connected to the left-side heat exchanger. A right portion of the resonating tube 920 is connected to the right-side heat exchanger.

FIG. 9B is a perspective view of the refrigeration or cooling assembly 900 with internal features shown in broken lines, illustrating, in the circled portion, the recessed-type fluid-enhanced heat exchanger 600 on the right side of the stack 910 as the right-side heat exchanger and a protruding-type fluid-enhanced heat exchanger 700 on the left side of the stack 910 as the left-side heat exchanger. Other embodiments may include a different stack, different heat exchangers, and/or a different mechanical oscillator.

Double-Ended Symmetric Standing Wave Thermoacoustic Refrigerator

Figure 10:
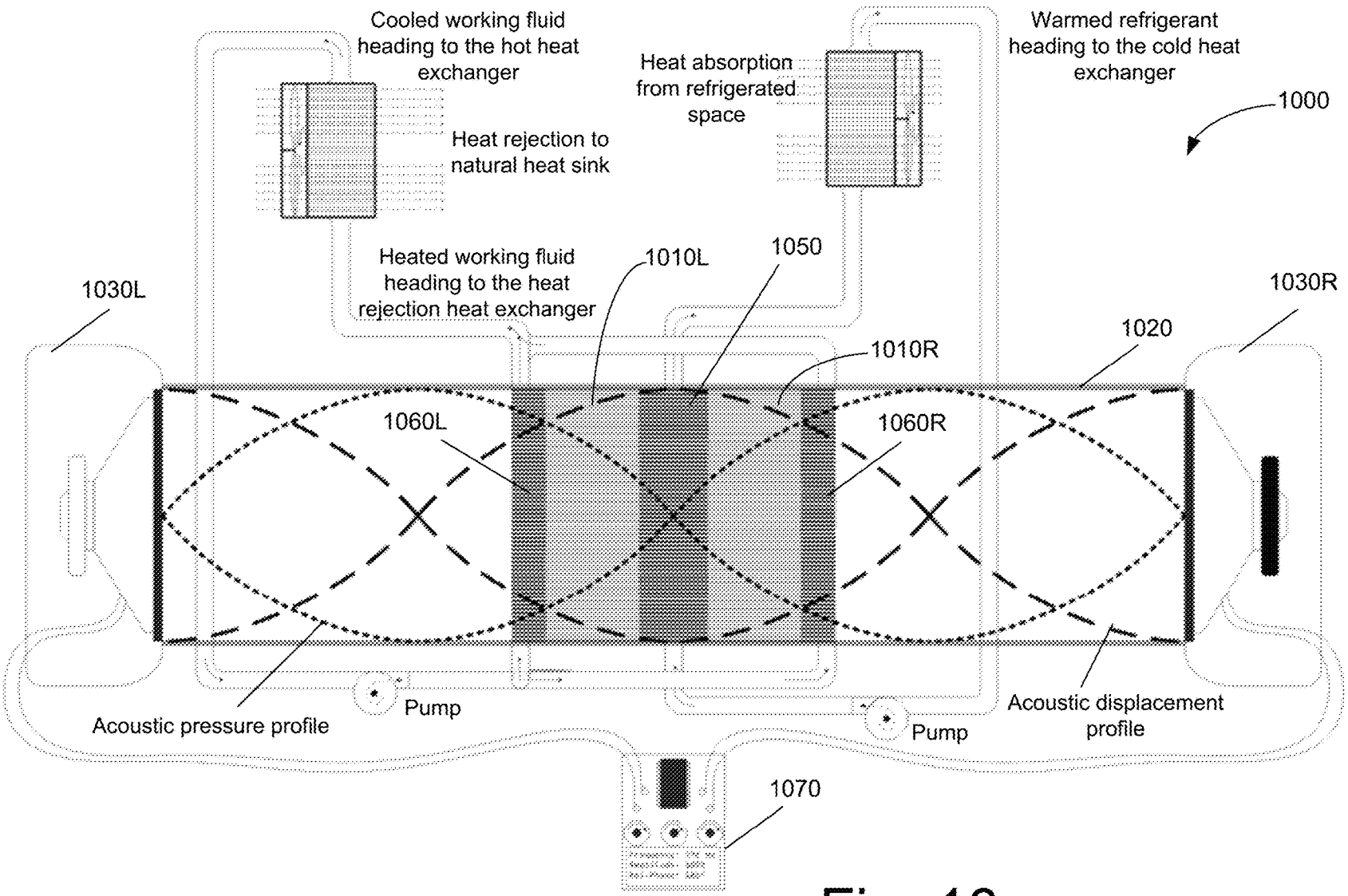
FIG. 10 is a schematic illustration of a double-ended symmetric standing wave thermoacoustic refrigerator according to an embodiment.

FIG. 10 is a schematic illustration of a double-ended symmetric standing wave thermoacoustic refrigerator 1000 according to an embodiment.

A right thermoacoustic stack 1010R is disposed along a length of a resonating tube 1020 through which gas travels (leftward and rightward as shown). On the right side of the resonating tube 1020 is a right mechanical oscillator 1030R (e.g., a right acoustic driver) that can be used to produce acoustic disturbance. A left thermoacoustic stack 1010L is disposed to the left of the right thermoacoustic stack 1010R. On the left side of the resonating tube 1020 is a left mechanical oscillator 1030L (e.g., a left acoustic driver) that can be used to produce acoustic disturbance. Compressible gas "parcels" oscillate longitudinally through the stacks 1010L & 1010R due to acoustic standing waves generated by the mechanical oscillators 1030L & 1030R, which are coupled to a mechanical oscillator controller or acoustic driver controller 1070.

For the right mechanical oscillator 1030R (first mechanical oscillator) and corresponding right stack 1010R (first stack), when a right parcel (first parcel) moves toward the pressure antinode leftward, the right parcel encounters higher pressure and its temperature rises as a result of nearly adiabatic compression, allowing it to shed thermal energy to the relatively cooler local portion of the stack surface on the right side. The pressure antinode on the left side is a region of maximum compression and rarefaction, referred to as a left displacement node which is a region of minimum molecular motion. When the right parcel travels toward the pressure node (rightward) and experiences rarefaction, it causes its temperature to drop as a result of nearly adiabatic expansion, permitting the absorption of thermal energy from the relatively warmer local stack surface on the left side. The pressure node on the right side is a region of minimum compression and rarefaction, as a right displacement antinode which is a region of maximum molecular motion. In this way, adjacent gas parcels incrementally "pump" a net positive amount of thermal energy toward the pressure antinode (leftward). Removal of the aggregate thermal energy at the warm end (left side as shown) of the right stack 1010R via a warm side heat exchanger 1050 permits continued absorption of low-temperature thermal energy from a refrigerated target at the cool end (right side as shown) of the right stack 1010R via a cool side heat exchanger on the right 1060R.

For the left mechanical oscillator 1030L (second mechanical oscillator) and corresponding left stack 1010L (second stack), when a left parcel (second parcel) moves toward the pressure antinode rightward, the left parcel encounters higher pressure and its temperature rises as a result of nearly adiabatic compression, allowing it to shed thermal energy to the relatively cooler local portion of the stack surface on the left side. The pressure antinode on the right side is a region of maximum compression and rarefaction, referred to as a right displacement node which is a region of minimum molecular motion. When the left parcel travels toward the pressure node (leftward) and experiences rarefaction, it causes its temperature to drop as a result of nearly adiabatic expansion, permitting the absorption of thermal energy from the relatively warmer local stack surface on the right side. The pressure node on the left side is a region of minimum compression and rarefaction, as a left displacement antinode which is a region of maximum molecular motion. In this way, adjacent gas parcels incrementally "pump" a net positive amount of thermal energy toward the pressure antinode (rightward). Removal of the aggregate thermal energy at the warm end (right side as shown) of the left stack 1010L via the warm side heat exchanger 1050 permits continued absorption of low-temperature thermal energy from a refrigerated target at the cool end (left side as shown) of the left stack 1010L via a cool side heat exchanger on the left 1060L.

The left stack 1010L and the right stack 1010R may combine to form a symmetric stack sandwich at the center of the resonating tube 1020. The stack sandwich includes a left (first) side outboard heat exchanger 1060R facing the left (first) mechanical oscillator 1030L and a right (second) side outboard heat exchanger 1060L facing the right (second) mechanical oscillator 1030R. It is symmetrical in geometry and dimension with respect to the center heat exchanger 1050.

Having two opposed acoustic drivers 1030L & 1030R with a symmetric stack sandwich 1010L & 1010R in the center of the resonating tube was conceptually explored via simple simulators and schematics. The basic thermoacoustic principle remains the same, but by having two acoustic drivers the pressure and displacement waveform profiles can be more finely manipulated by adjusting the relative phase displacement and/or frequency of the two adjustable acoustic drivers 1030L & 1030R using the acoustic driver controller 1070. This potentially allows the device 1000 to be more compact, as it is no longer limited to the geometrically determined resonant frequency of the tube 1020. Another advantage is the hot side outboard heat exchangers 1060L & 1060R in the stack sandwich face the acoustic drivers 1030L & 1030R; when the cold side heat exchanger does this, as in the simple resonating device shown in FIG. 1, a secondary heating effect occurs which partially negates the cooling effect. By sequestering the cold side heat exchanger 1050 in the center of the stack sandwich as the cold center heat exchanger 1050, it is shielded from this secondary heating effect and is therefore more effective at cooling the refrigerated space.

In one embodiment, the drivers 1030L & 1030R can be driven in-phase (i.e., clapping mode) with the respective left driver diaphragm and right driver diaphragm moving in opposite directions with respect to one another. In the clapping mode, the total separation distance between the left and right diaphragms widens and narrows by an amount equal to twice the driven amplitude. Conversely, in another embodiment, the drivers 1030L & 1030R can be driven out-of-phase (i.e., sloshing mode) with the respective left diaphragm and right diaphragm moving in the same direction with respect to one another. This reverses the roles of the heat exchangers on either the left side (1050 & 1060L) or the right side (1050 & 1060R). In the sloshing mode, the total separation distance between the driver diaphragms remains constant since their respective motions are identical.

Visualization of Double-Ended Symmetric Standing Wave Thermoacoustic Refrigerator Using Simple Simulator for a Resonator Length of ½ Wavelength in Clapping Mode In this clapping mode setup, the acoustic drivers 1030L & 1030R are being run in-phase with each other (both move inward/outward simultaneously) at a frequency corresponding to double the natural resonant frequency of the tube 1020. In this arrangement, the pressure antinodes include one immediately inboard of each acoustic driver 1030L, 1030R and one at the center of the assembly 1000. The pressure nodes include those at one-quarter of the resonator length inboard of each acoustic driver 1030L, 1030R. The motion antinodes include those at one-quarter of the resonator length inboard of each acoustic driver 1030L, 1030R. The motion nodes include one immediately inboard of each acoustic driver 1030L, 1030R and one at the center of the assembly 1000.

FIGS. 11A-11H show 8 diagrams depicting the instantaneous pressure distribution and longitudinal motion of gas flow in the resonating tube 1020 as influenced simultaneously by the left acoustic driver 1030L and right acoustic driver 1030R. The 8 diagrams illustrate graphs from cycle time zero advancing with increments of ⅛ cycle to ⅞ cycle. They are developed using the principle of superposition of waves without modeling wave reflections. The diagrams provide insight into the combined acoustic profile of the overall resonating tube in way of the stack sandwich 1010L & 1010R.

Figure 11A:
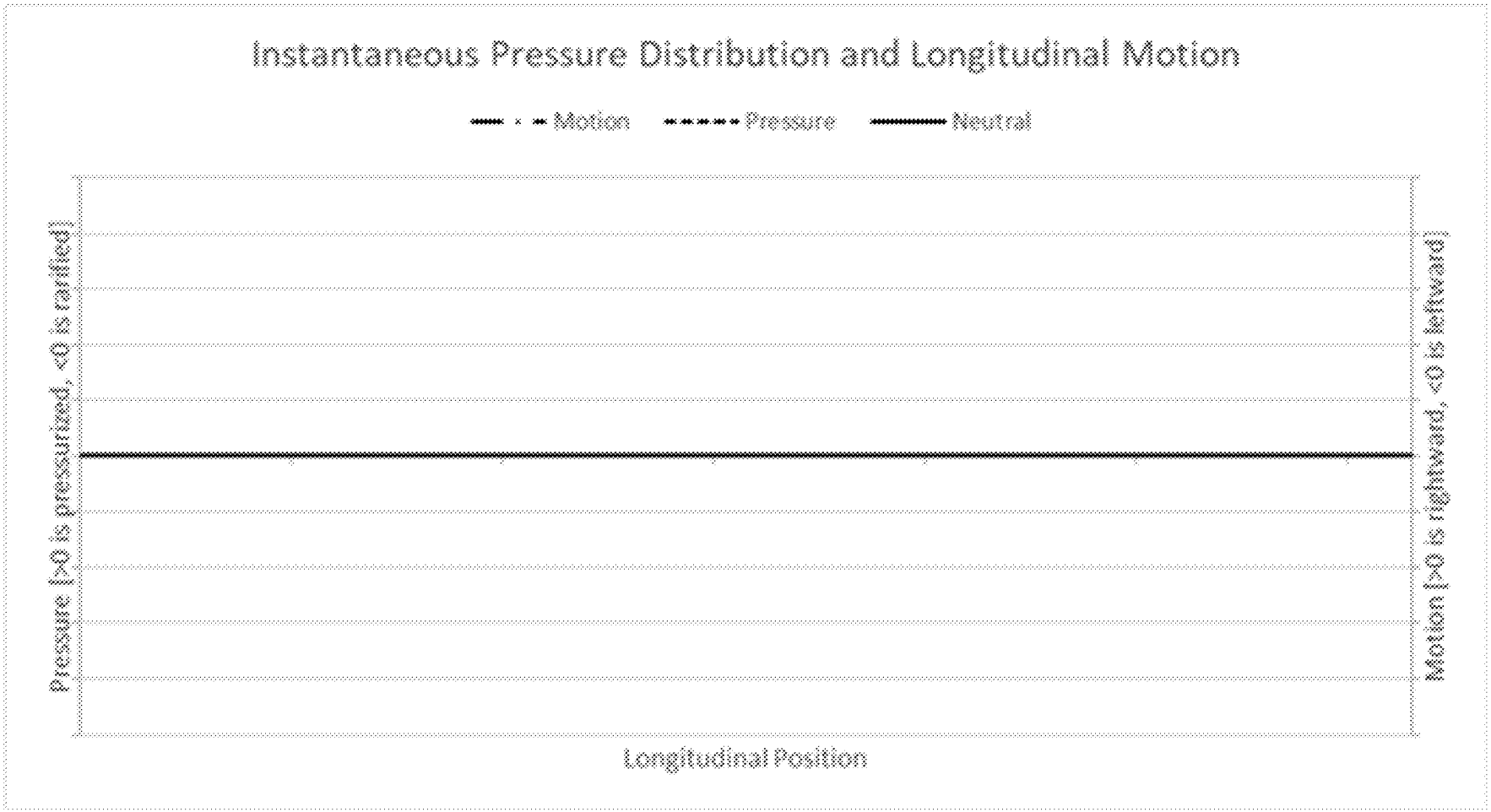
FIGS. 11A-11H show 8 diagrams depicting the instantaneous pressure distribution and longitudinal motion of gas flow in the resonating tube as influenced simultaneously by the left acoustic driver and right acoustic driver.

In FIG. 11A, starting at cycle time 0, the diaphragms of the acoustic drivers 1030L & 1030R are at their extreme or maximum inboard locations and temporarily motionless. The overall pressure throughout the tube is neutral (no gradient) and the gas is quiescent (no bulk motion). The pressure gradient induced by the left acoustic driver's previous cycle is being perfectly cancelled out by the pressure gradient induced by the right acoustic driver's precious cycle. There is no instantaneous motion of the gas (i.e., it is temporarily stationary).

Figure 11B:
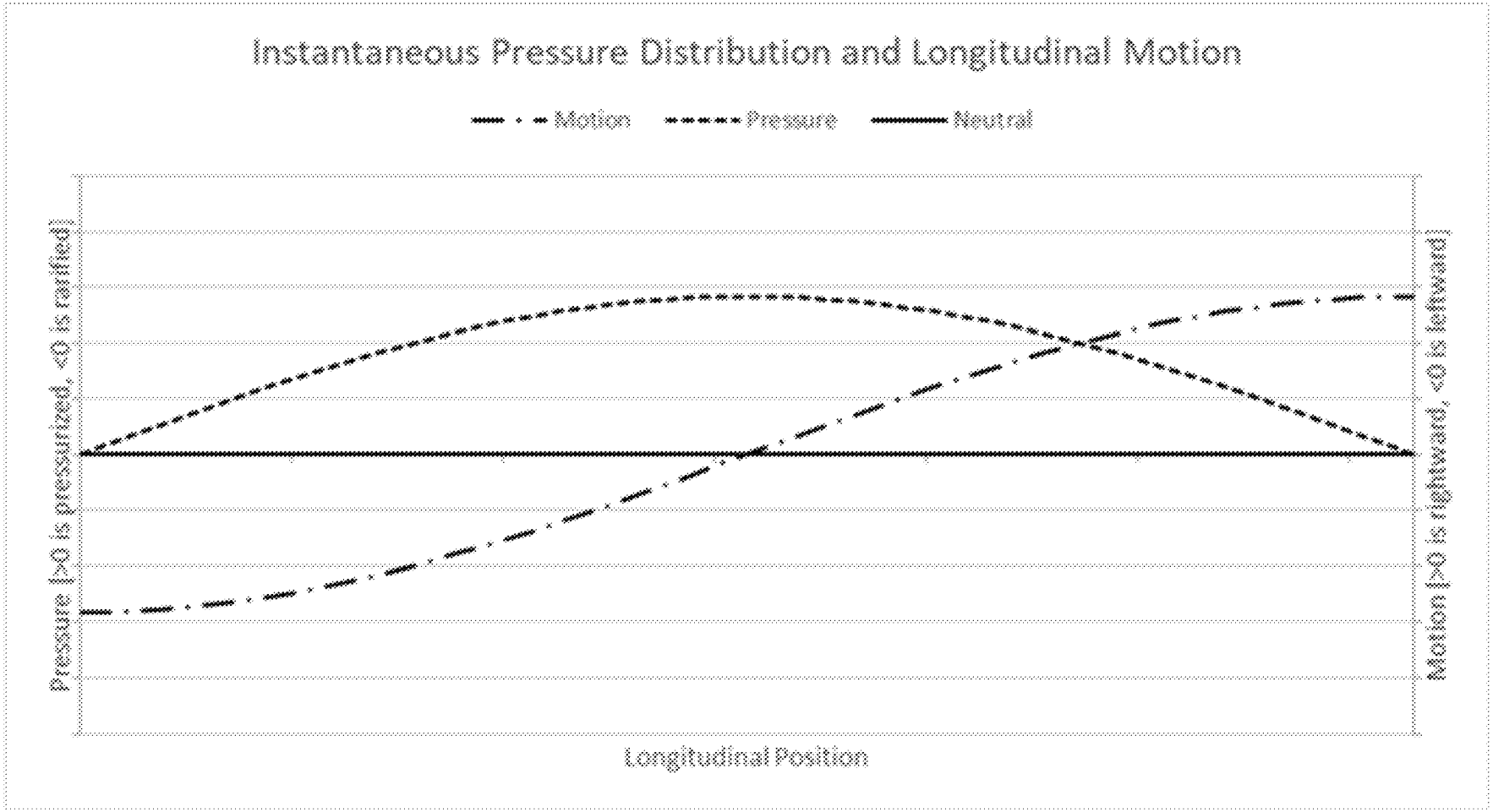

In FIG. 11B, at cycle time of ⅛ cycle, the diaphragms of the acoustic drivers 1030L & 1030R are moving away from each other and accelerating. The pressure is increasing at the center of the assembly 1000. At the left quadrant, the gas is flowing to the left and accelerating. At the right quadrant, the gas is flowing to the right and accelerating. As such, all gas is currently center-avoiding.

Figure 11C:
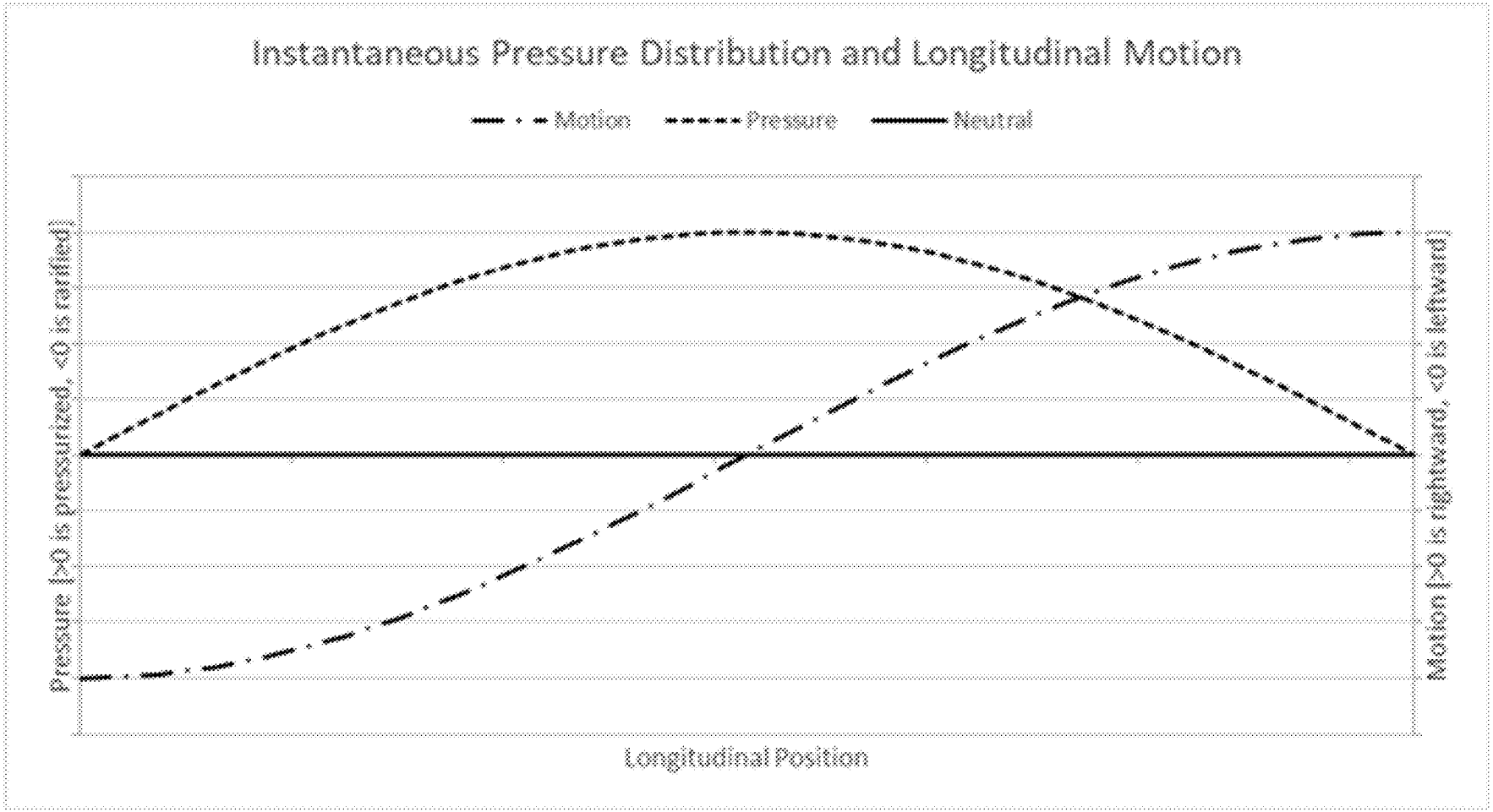

In FIG. 11C, at cycle time of ¼ cycle, the diaphragms of the acoustic drivers 1030L & 1030R have translated to their neutral positions and are moving away from each other (i.e., translating outboard) at maximum velocity. The pressure (i.e., compression) is maximum at the center of the assembly 1000. At the left quadrant, the gas is flowing to the left at maximum velocity. At the right quadrant, the gas is flowing to the right at maximum velocity. In other words, maximum velocity molecular displacement is occurring at both ends and its direction is outboard. As such, all gas is currently center-avoiding. The gas is motionless at the center. In this way, the adiabatically compressed high temperature gas at center is shedding heat to the hot center heat exchanger 1050 (i.e., some of its thermal energy is extracted for ultimate rejection to the surroundings) and as the gas displaces outward from center, it expands and cools through the stacks 1010L & 1010R. By the time it has reached the cold heat exchangers 1060L & 1060R at either end of the stack sandwich, it has expanded and cooled enough to accept heat from the refrigerated space. As such, when the device 1000 is run with zero phase difference (i.e., simultaneously converging/diverging diaphragms), the outboard heat exchangers 1060L & 1060R are colder and the center one 1050 is the hotter one, which is the opposite configuration as when the driver diaphragms run 180° out-of-phase (see FIG. 12E below).

Figure 11D:
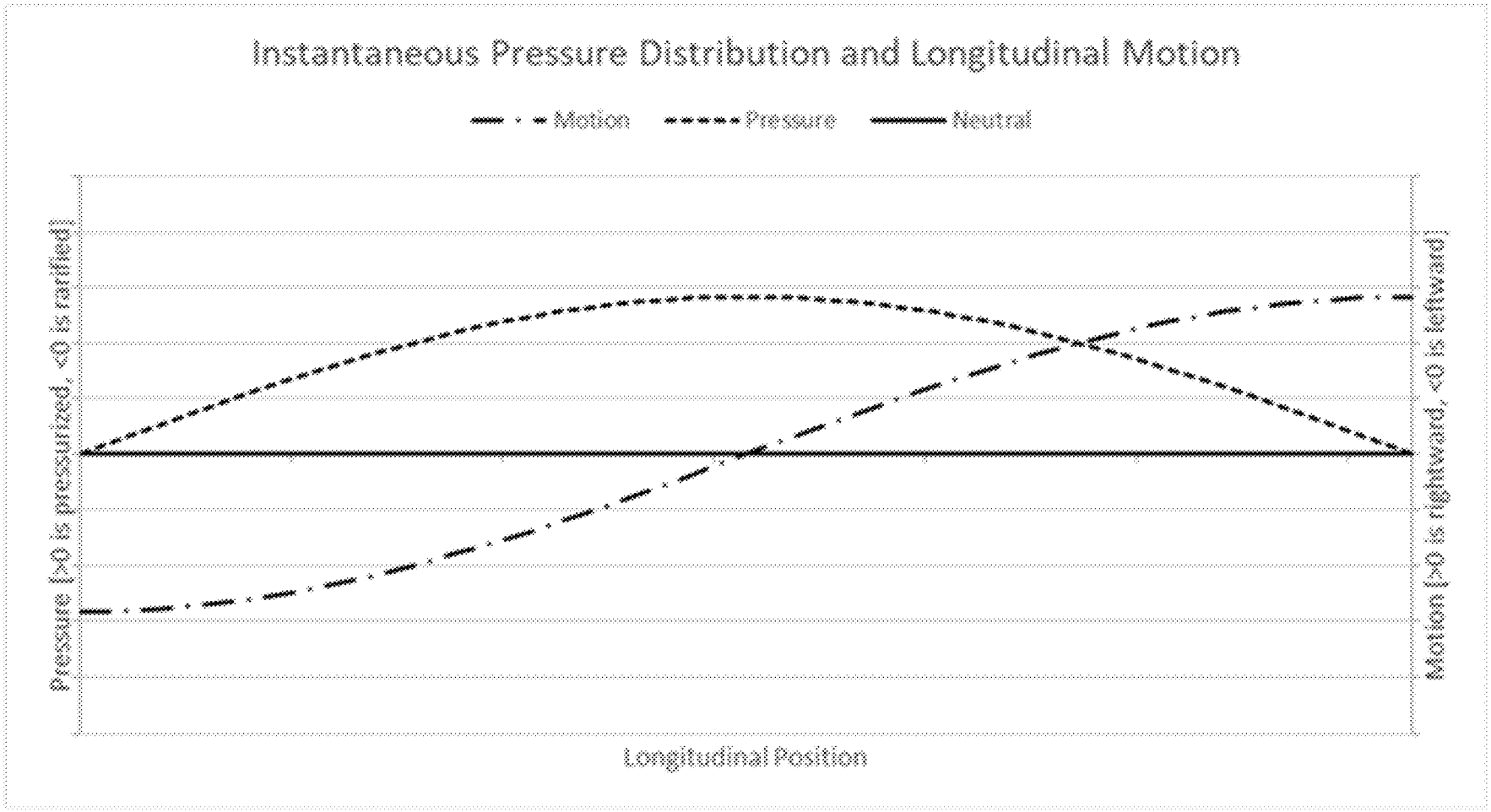

In FIG. 11D, at cycle time of ⅜ cycle, the diaphragms of the acoustic drivers 1030L & 1030R are moving away from each other and decelerating. The pressure is decreasing at the center of the assembly 1000. At the left quadrant, the gas is flowing to the left and decelerating. At the right quadrant, the gas is flowing to the right and decelerating. All gas is still center-avoiding.

Figure 11E:
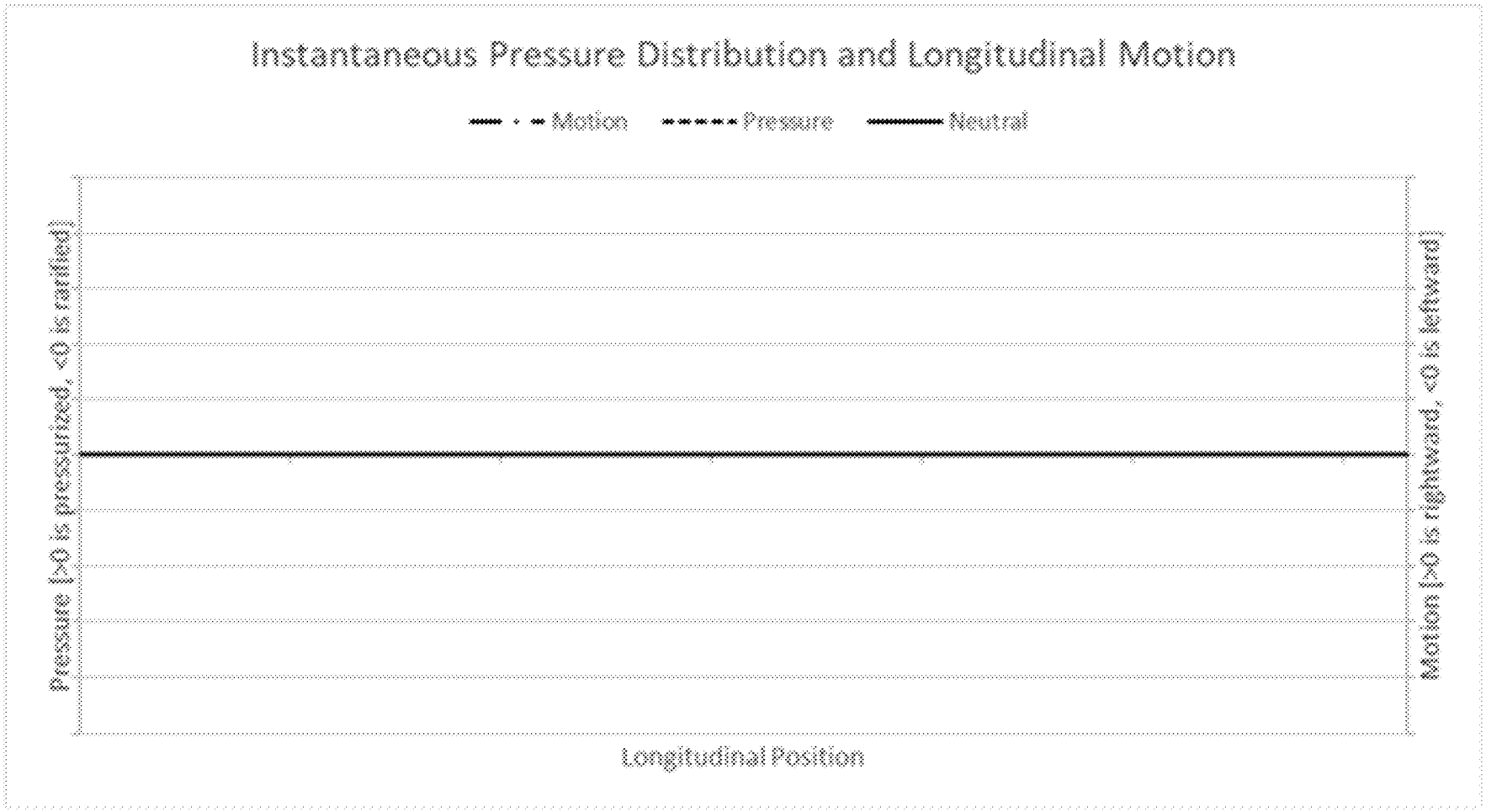

In FIG. 11E, at cycle time of ½ cycle, the diaphragms of the acoustic drivers 1030L & 1030R have translated as far outboard as they can, at their extreme outboard locations. The pressure throughout the tube 1020 is neutral (no gradient) and the gas is quiescent (no bulk motion). There is no instantaneous motion of the gas (i.e., it is temporarily stationary). The tube 1020 has no pressure gradient and no translation. This is similar to the state at cycle time 0, with the exception of the diaphragms' present position (extreme outboard in FIG. 11E as opposed to extreme inboard in FIG. 11A). Again, the respective pressure profiles of the drivers 1030L & 1030R cancel each other out due to symmetry.

Figure 11F:
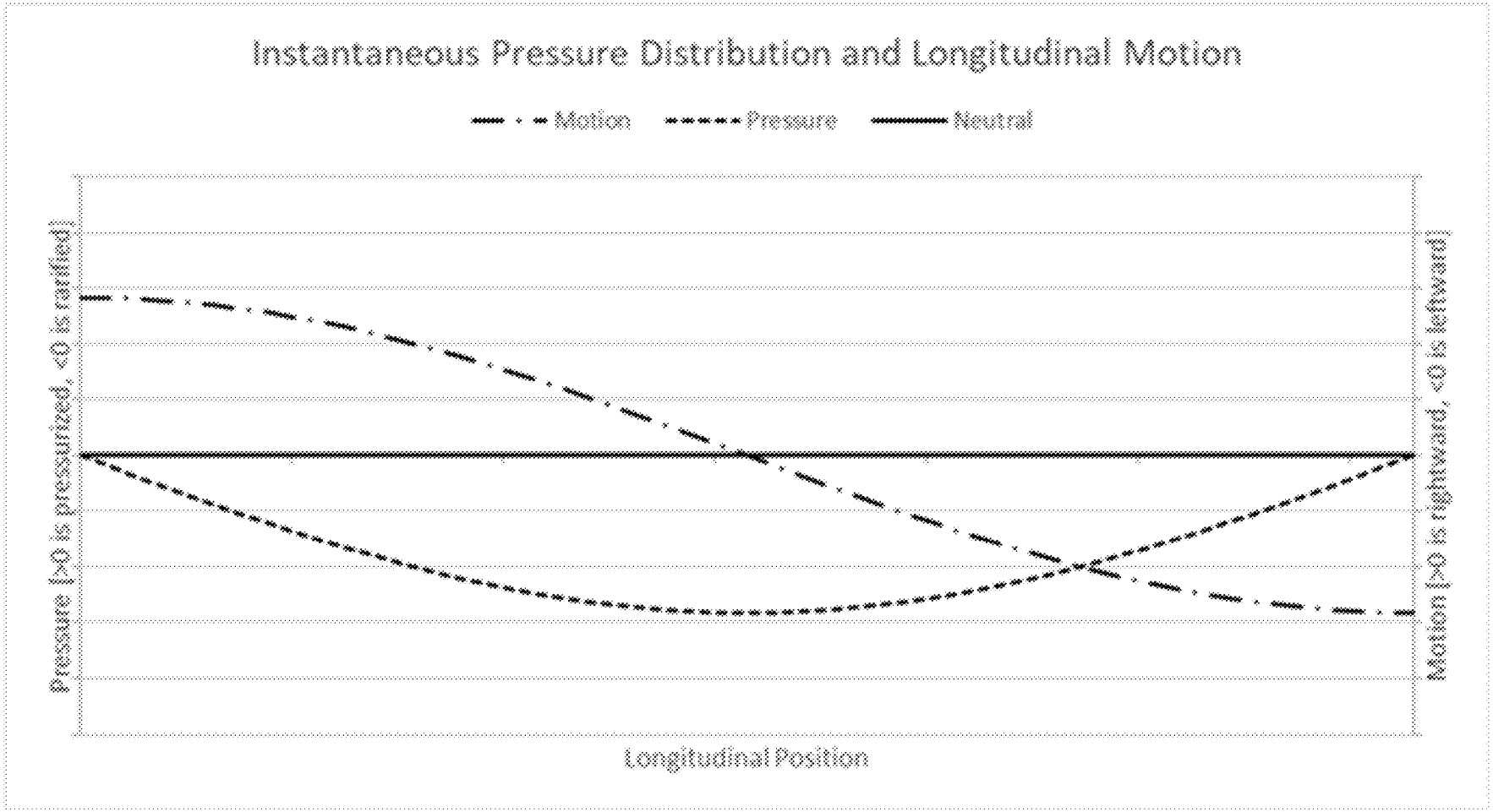

In FIG. 11F, at cycle time of ⅝ cycle, the diaphragms of the acoustic drivers 1030L & 1030R are moving toward each other and accelerating. The pressure is decreasing at the center of the assembly 1000. At the left quadrant, the gas is flowing to the right and accelerating. At the right quadrant, the gas is flowing to the left and accelerating. As such, all gas is currently center-seeking.

Figure 11G:
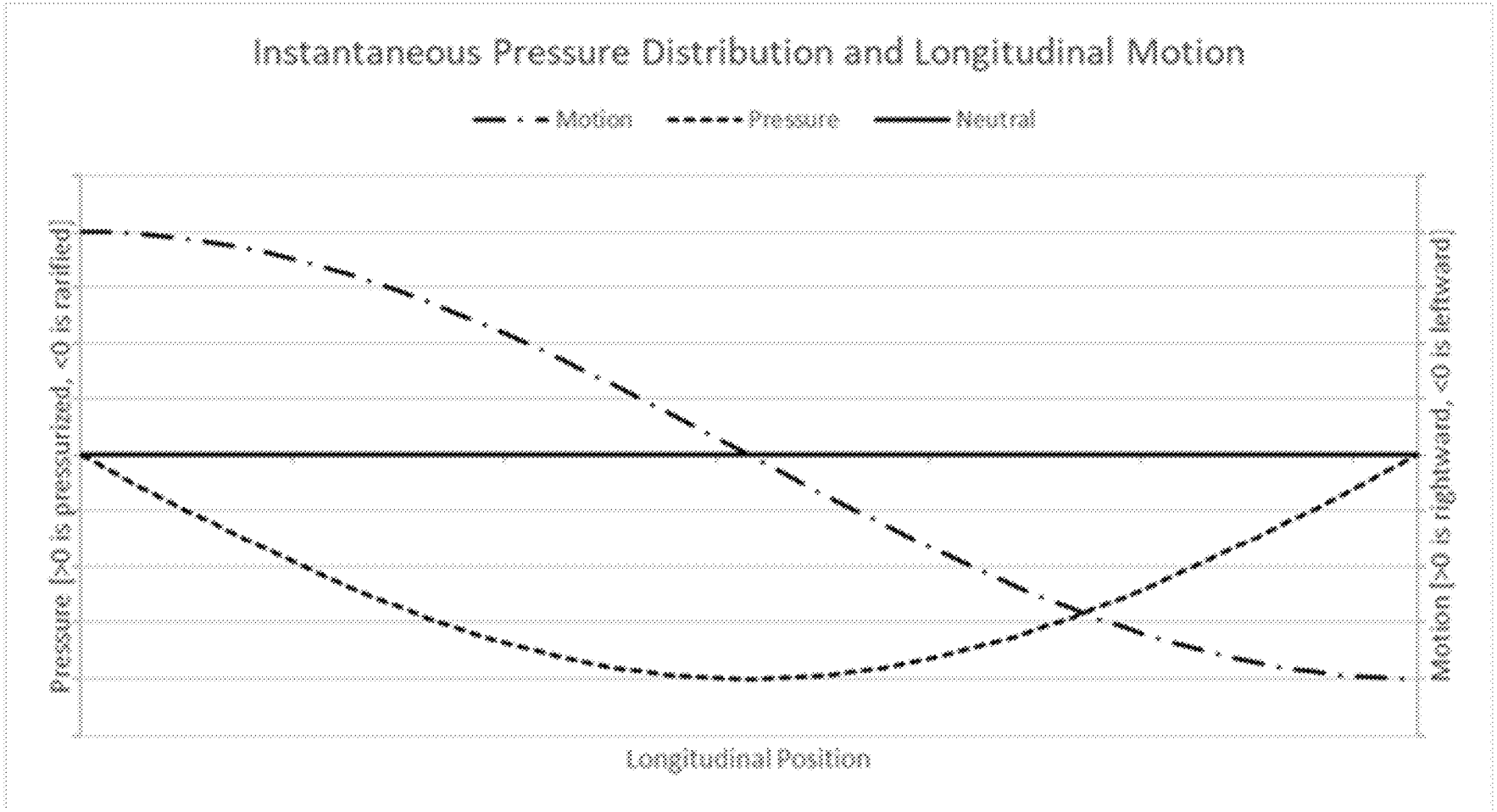

In FIG. 11G, at cycle time of % cycle, the diaphragms of the acoustic drivers 1030L & 1030R have translated to their neutral positions and are moving toward each other (i.e., translating inboard) at maximum velocity. The pressure is minimum at the center of the assembly 1000. At the left quadrant, the gas is flowing to the right at maximum velocity. At the right quadrant, the gas is flowing to the left at maximum velocity. In other words, maximum velocity molecular displacement is occurring at both ends and its direction is inboard. As such, all gas is currently center-seeking. The gas is motionless at the center. The state at % cycle in FIG. 11G is similar to the state at ¼ cycle in FIG. 11C, but now the diaphragms are at their neutral position translating at maximum velocity back toward the center (inboard). The gas is under maximum rarefaction at the center of the tube 1020 where the gas is temporarily motionless. Maximum gas velocity occurs at either end of the tube 1020 and is center-seeking to fill the void.

Figure 11H:
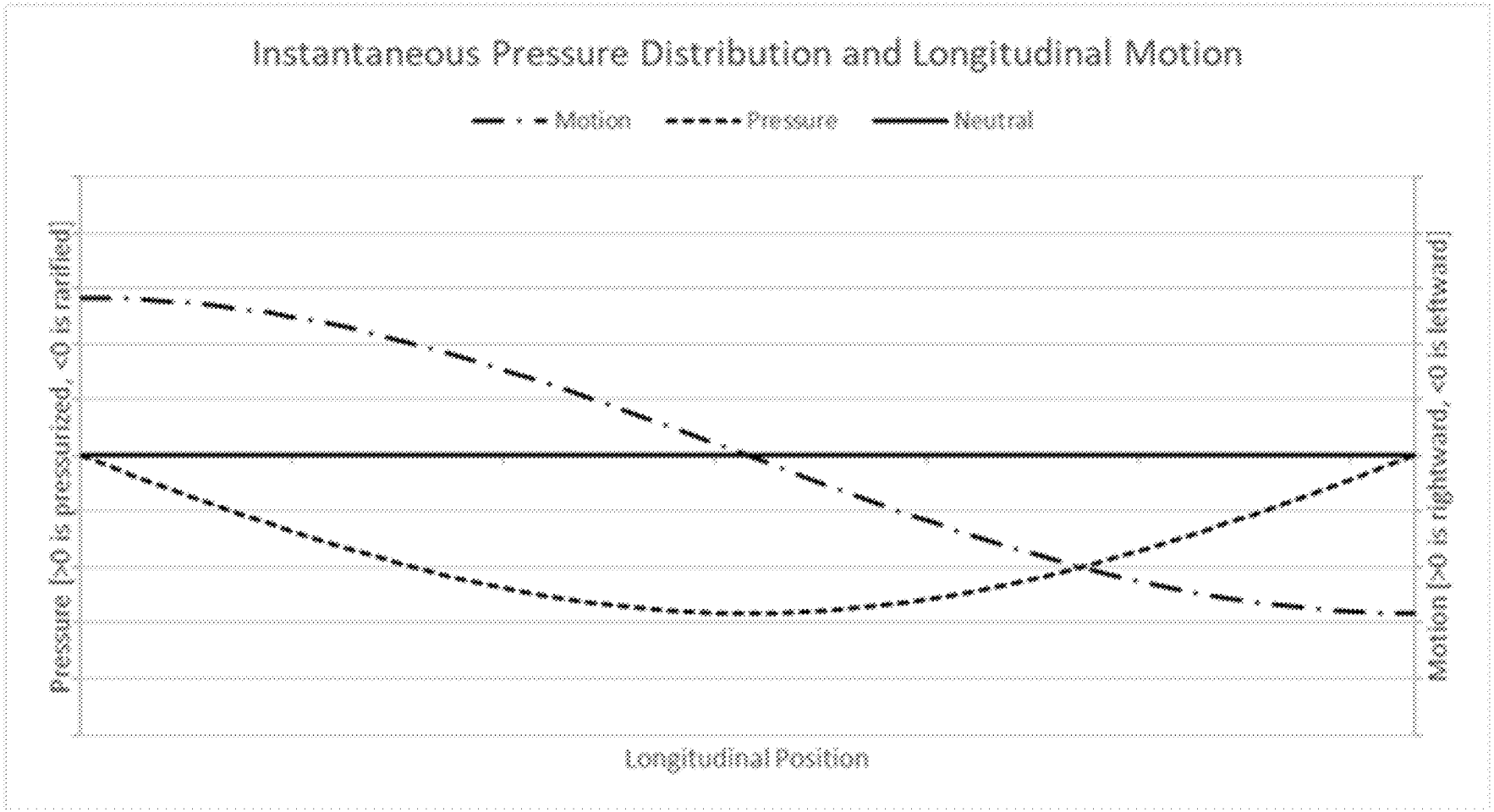

In FIG. 11H, at cycle time of ⅞ cycle, the diaphragms of the acoustic drivers 1030L & 1030R are moving toward each other and decelerating. The pressure is increasing at the center of the assembly 1000. At the left quadrant, the gas is flowing to the right and decelerating. At the right quadrant, the gas is flowing to the left and decelerating. All gas is still center-seeking. The cycle now repeats back to the 0 cycle state in FIG. 11A.

Visualization of Double-Ended Symmetric Standing Wave Thermoacoustic Refrigerator Using Simple Simulator for a Resonator Length of ½ Wavelength in Sloshing Mode In this sloshing mode setup, the acoustic drivers 1030L & 1030R are being run 180° out-of-phase with each other (both move left simultaneously or right simultaneously) at a frequency corresponding to double the natural resonant frequency of the tube. In this arrangement, the pressure antinodes include one immediately inboard of each acoustic driver 1030L, 1030R and one at the center of the assembly 1000. The pressure nodes include those at one-quarter of the resonator length inboard of each acoustic driver 1030L, 1030R. The motion antinodes include those at one-quarter of the resonator length inboard of each acoustic driver 1030L, 1030R. The motion nodes include one immediately inboard of each acoustic driver 1030L, 1030R and one at the center of the assembly 1000.

FIGS. 12A-12H show 8 diagrams depicting the instantaneous pressure distribution and longitudinal motion of gas flow in the resonating tube 1020 as influenced simultaneously by the left acoustic driver 1030L and right acoustic driver 1030R. The 8 diagrams illustrate graphs from cycle time zero advancing with increments of ⅛ cycle to ⅞ cycle. They provide insight into the combined acoustic profile of the overall resonating tube in way of the stack sandwich 1010L & 1010R.

Figure 12A:
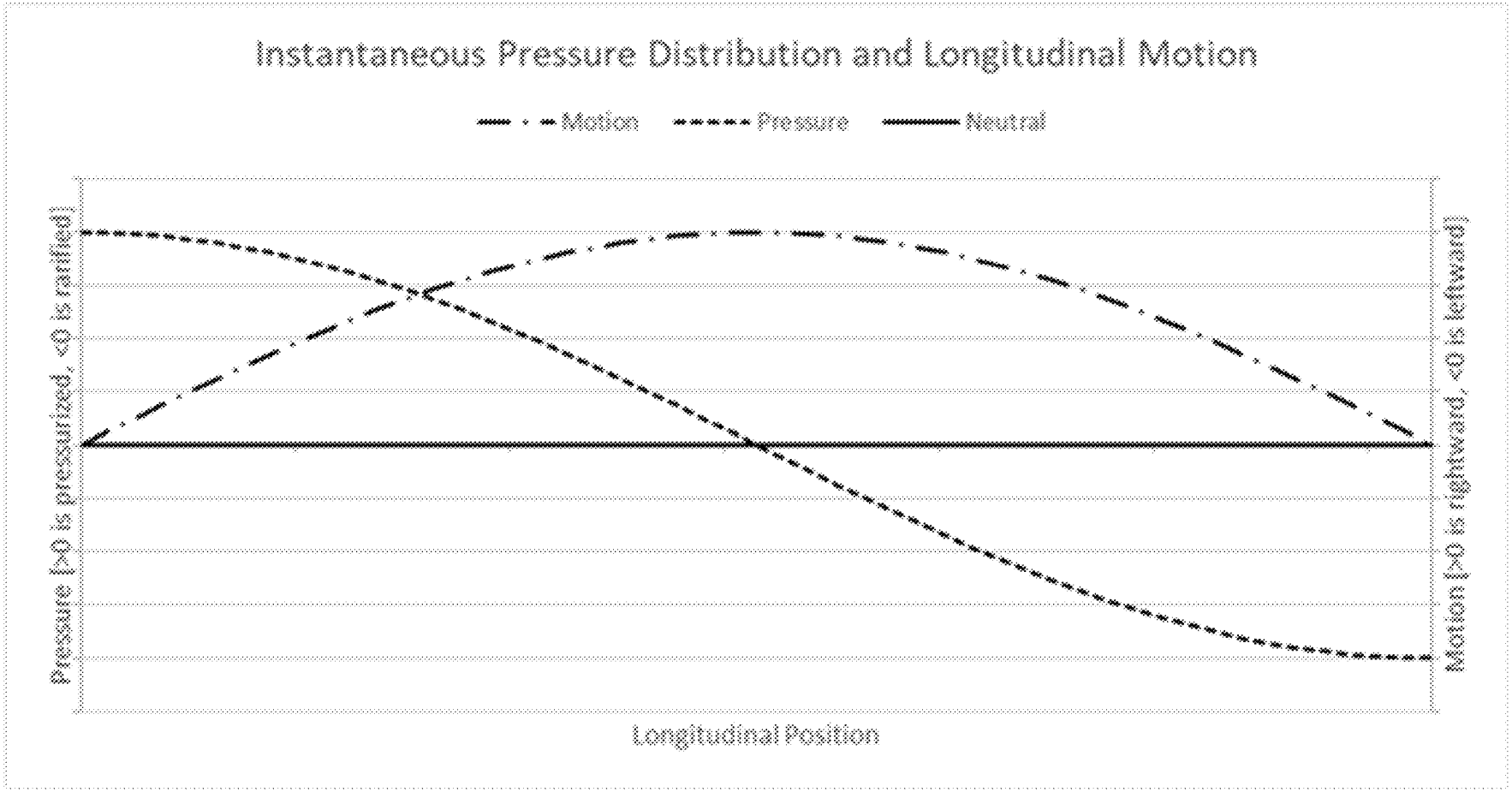
FIGS. 12A-12H show 8 diagrams depicting the instantaneous pressure distribution and longitudinal motion of gas flow in the resonating tube as influenced simultaneously by the left acoustic driver and right acoustic driver.

In FIG. 12A, starting at cycle time 0, the diaphragms of the acoustic drivers 1030L & 1030R are at their rightmost locations and temporarily motionless at their neutral positions. The pressure is maximum in the leftmost quadrant and minimum in the rightmost quadrant. The gas is traversing at maximum velocity to the right at the center of the assembly 1000. The gas is under maximum compression at the tube's far left and maximum rarefaction at its far right and is motionless at both drivers 1030L & 1030R while translating rightward at maximum velocity at center. In this way, the high temperature gas on the left is translating rightward through the left-side hot heat exchanger 1060L (from which some of its thermal energy is extracted for ultimate rejection to the surroundings) and continues to be adiabatically expand (and correspondingly drop in temperature) as it approaches the cold heat exchanger 1050 (where it is able to absorb thermal energy from the refrigerated space).

Figure 12B:
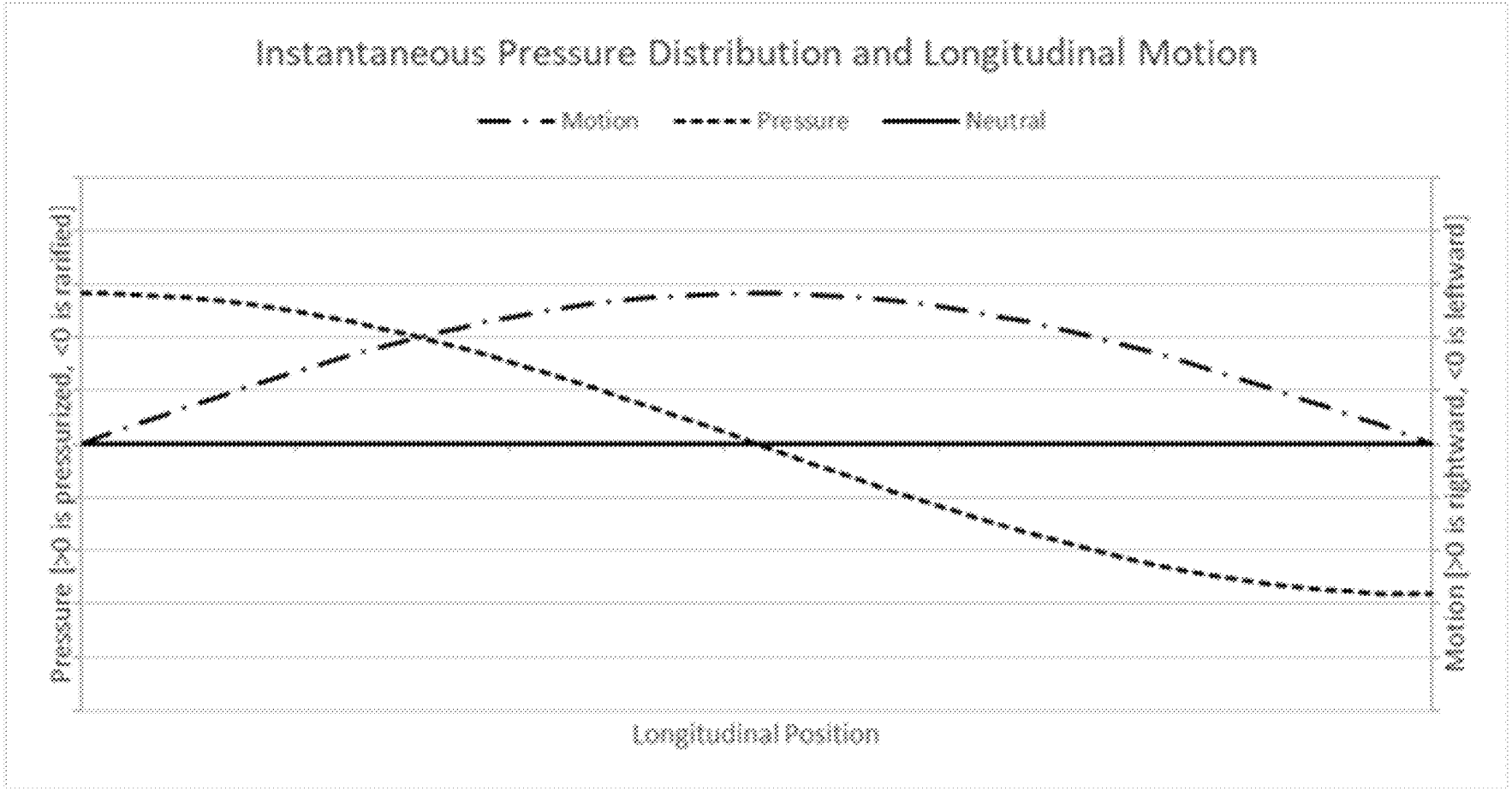

In FIG. 12B, at cycle time of ⅛ cycle, the diaphragms of the acoustic drivers 1030L & 1030R are traveling leftward and accelerating. The pressure is decreasing in the leftmost quadrant and increasing in the rightmost quadrant. The gas is traversing to the right at the center of the assembly 1000 and decelerating.

Figure 12C:
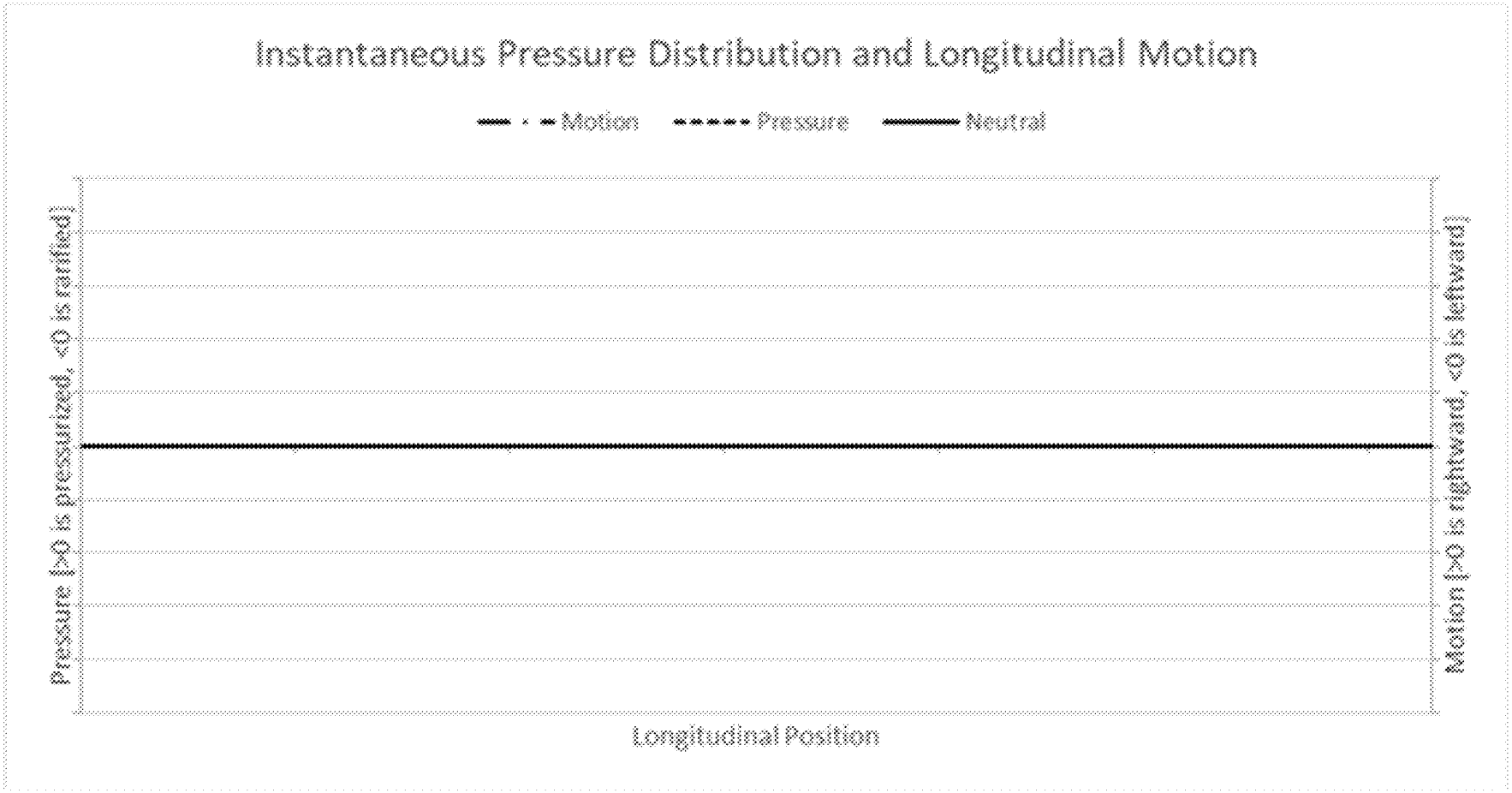

In FIG. 12C, at cycle time of ¼ cycle, the diaphragms of the acoustic drivers 1030L & 130R are at their neutral locations and traveling leftward at maximum velocity. The pressure and gas motion are temporarily neutral with no pressure gradient and no bulk motion throughout the tube 1020.

Figure 12D:
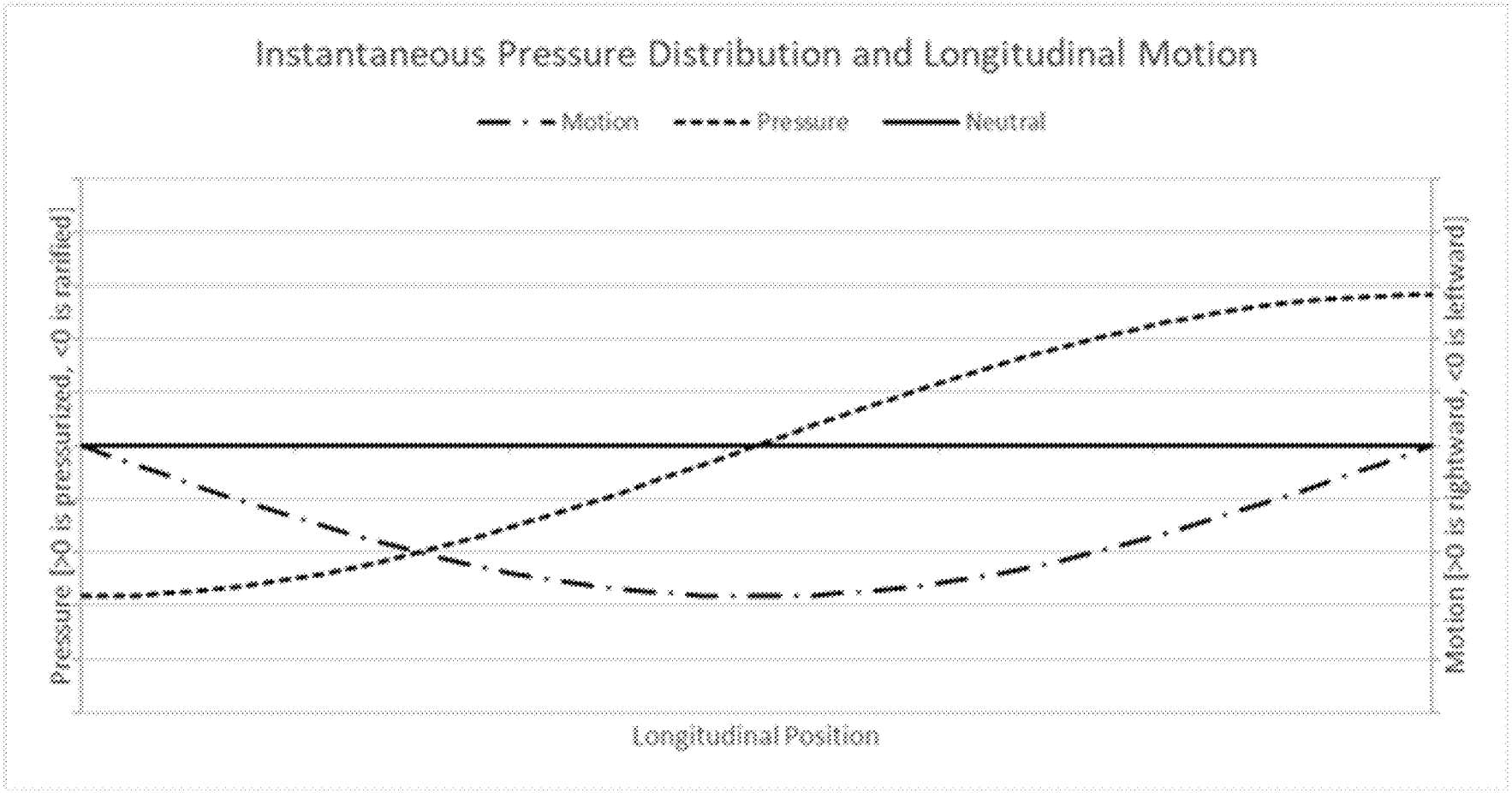

In FIG. 12D, at cycle time of ⅜ cycle, the diaphragms of the acoustic drivers 1030L & 1030R are traveling leftward and decelerating. The pressure is decreasing in the leftmost quadrant and increasing in the rightmost quadrant. The gas is traversing to the left at the center of the assembly 1000 and accelerating.

Figure 12E:
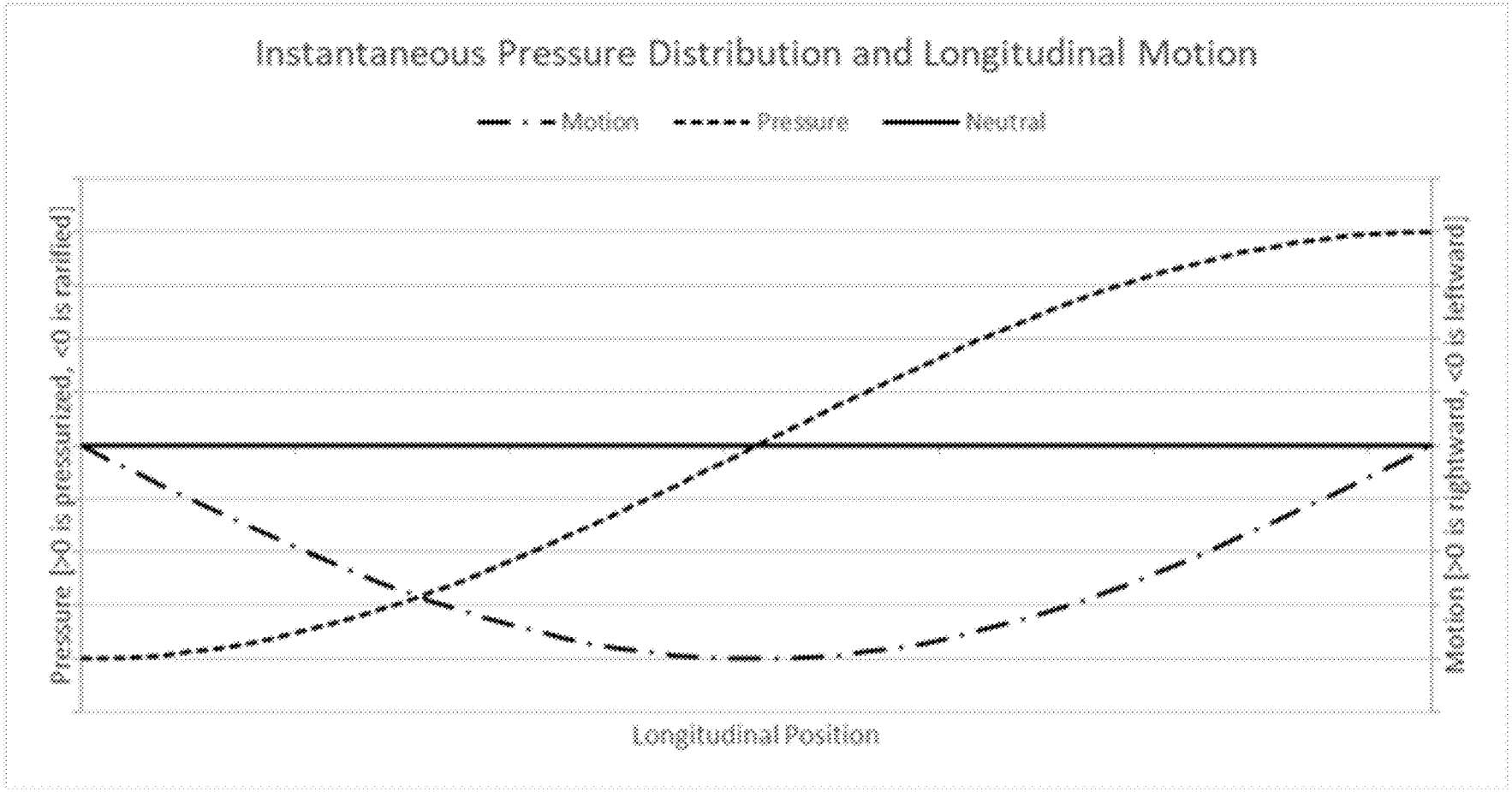

In FIG. 12E, at cycle time of ½ cycle, the diaphragms of the acoustic drivers 1030L & 130R have translated to their leftmost positions and are now temporarily motionless. Maximum rarefaction is occurring at far left and maximum compression is occurring at far right. Maximum velocity molecular displacement is occurring at the tube's center position and its direction is to the left; the gas is motionless at both drivers 1030L & 1030R. As compared to the 0 cycle state shown in FIG. 12A, the same principle of gas motion/temperature/heat exchange is occurring, but now the left side hot heat exchanger 1060L is the primary absorber of the gas's heat (again, to be rejected to the ambient environment) instead of the right side. The cold heat exchanger 1050 in the center retains its job of transferring low-temperature heat to the lower-temperature acoustically expanded gas.

Figure 12F:
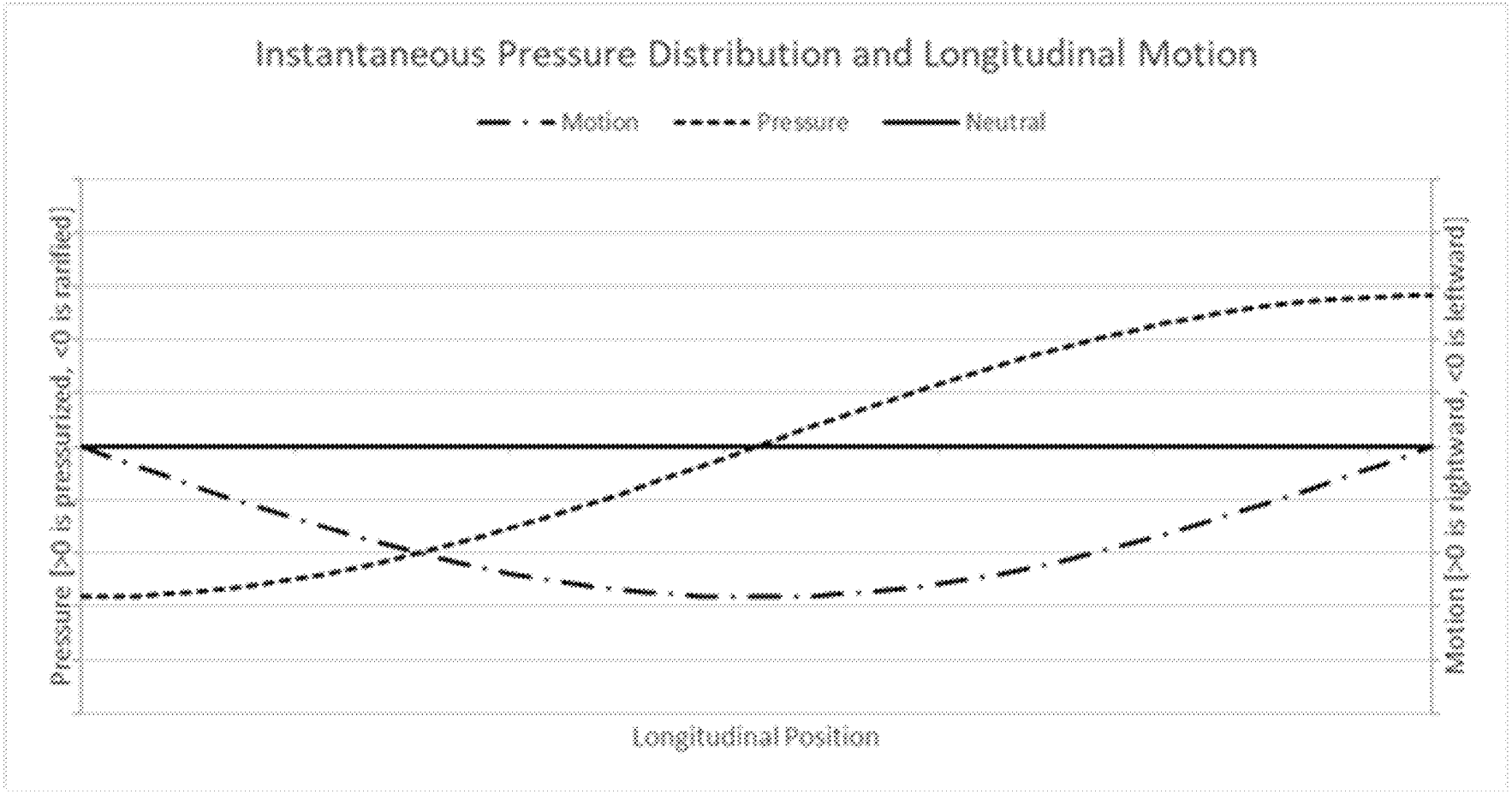

In FIG. 12F, at cycle time of ⅝ cycle, the diaphragms of the acoustic drivers 1030L & 1030R are traveling rightward and accelerating. The pressure is increasing in the leftmost quadrant and decreasing in the rightmost quadrant. The gas is traversing to the left at the center of the assembly 1000 and decelerating.

Figure 12G:
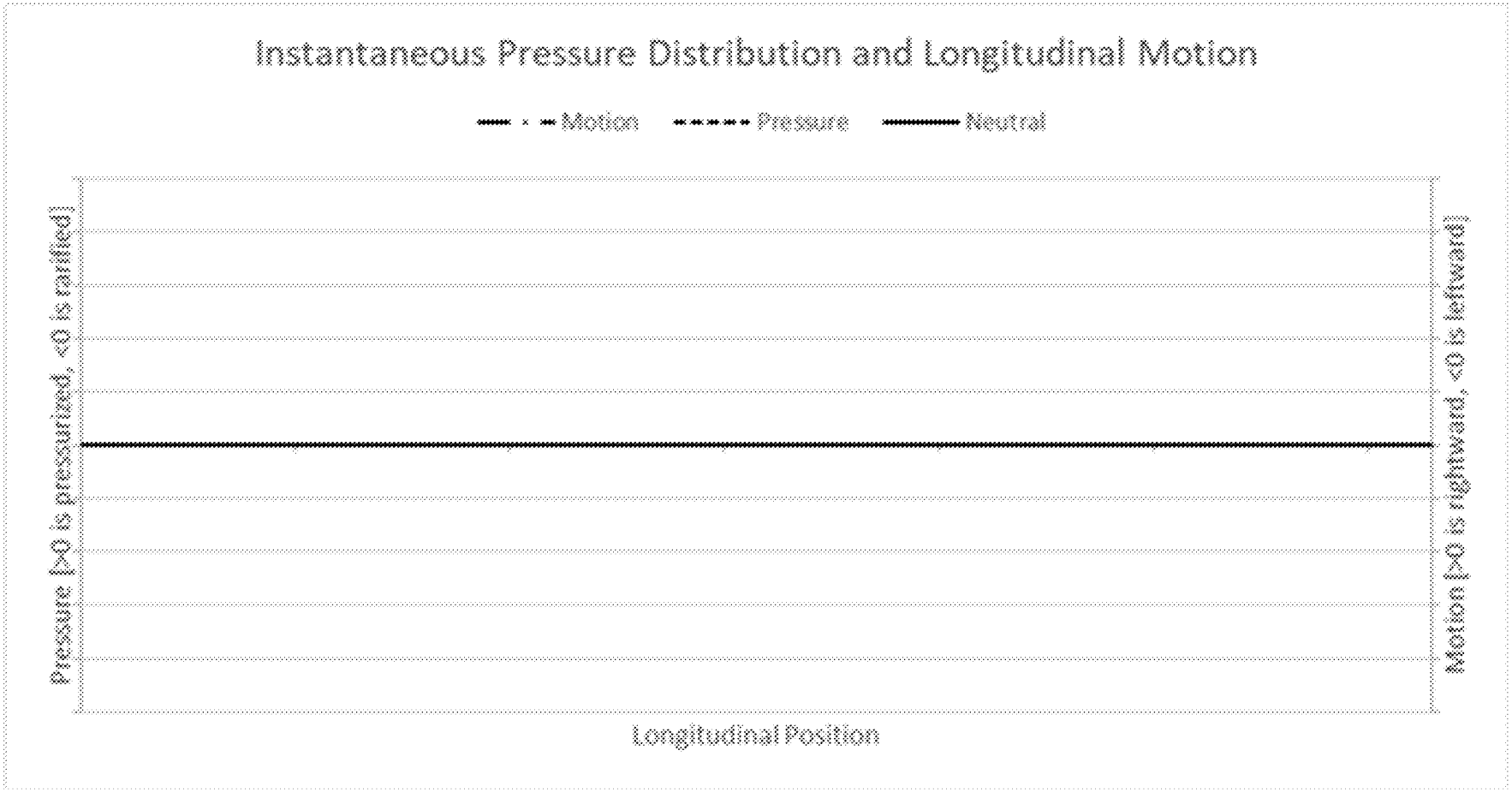

In FIG. 12G, at cycle time of % cycle, the diaphragms of the acoustic drivers 1030L & 1030R are back in their neutral positions but are now traversing rightward at maximum velocity. The pressure and gas motion are temporarily neutral throughout the tube 1020 with no pressure gradient and no translation. This is similar to the ¼ cycle state in FIG. 12C, with the exception of the diaphragms' velocity direction (rightward in FIG. 12G as opposed to leftward in FIG. 12C).

Figure 12H:
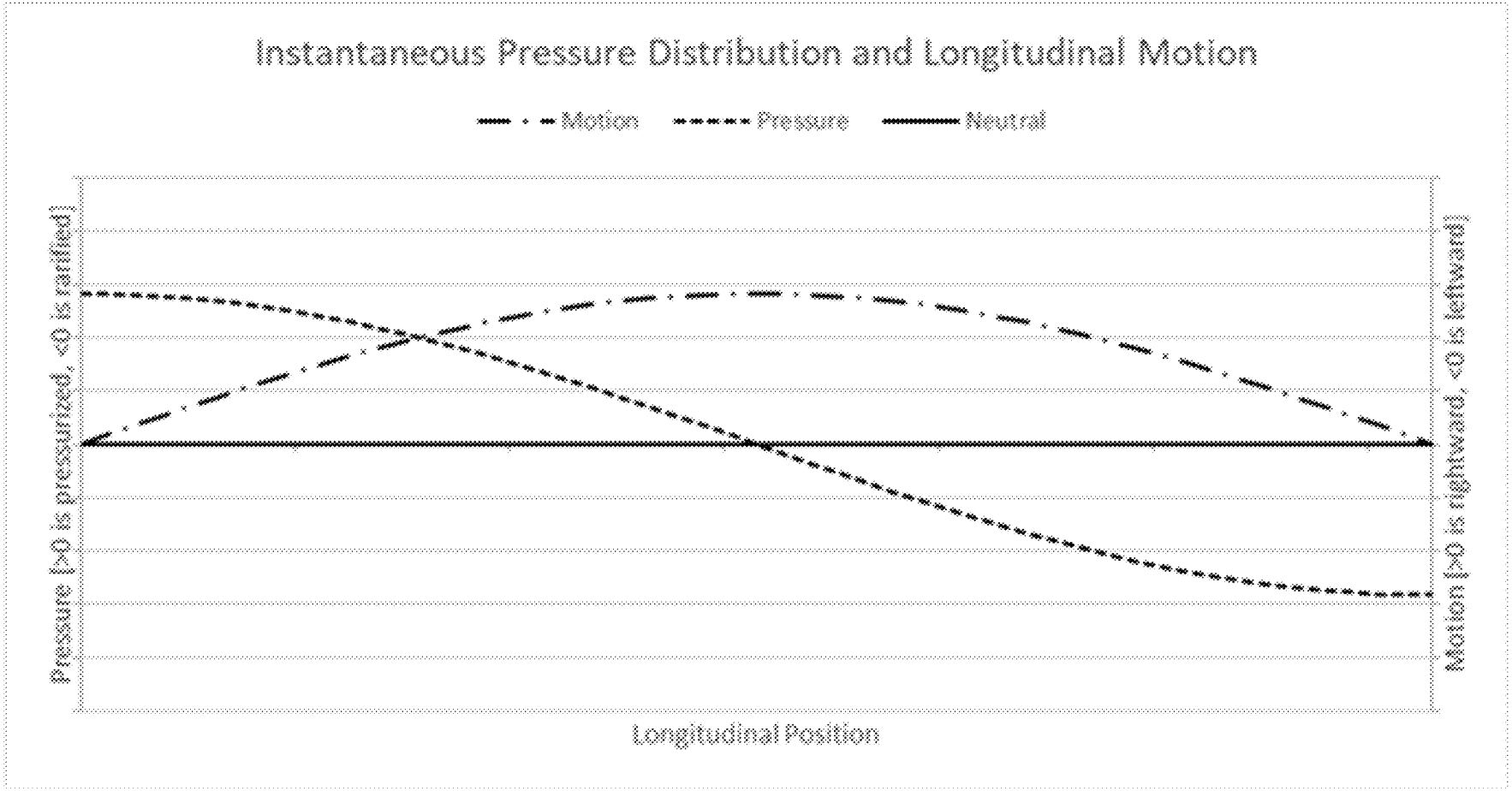

In FIG. 12H, at cycle time of ⅞ cycle, the diaphragms of the acoustic drivers 1030L & 1030R are traveling rightward and decelerating. The pressure is increasing in the leftmost quadrant and decreasing in the rightmost quadrant. The gas is traversing to the right at the center of the assembly 1000 and accelerating. The cycle now repeats back to the 0 cycle state in FIG. 12A.

Visualization of Double-Ended Symmetric Standing Wave Thermoacoustic Refrigerator Using Simple Simulator for a Resonator Length of 1 Wavelength in Clapping Mode In this clapping mode setup, the acoustic drivers 1030L & 1030R are being run in-phase with each other (both move inward/outward simultaneously) at a frequency corresponding to the natural resonant frequency of the tube 1020. In this arrangement, the pressure antinodes include one immediately inboard of each acoustic driver 1030L, 1030R and one at the center of the assembly 1000. The pressure nodes include those at one-quarter of the resonator length inboard of each acoustic driver 1030L, 1030R. The motion antinodes include those at one-quarter of the resonator length inboard of each acoustic driver 1030L, 1030R. The motion nodes include one immediately inboard of each acoustic driver 1030L, 1030R and one at the center of the assembly 1000.

FIGS. 13A-13H show 8 diagrams depicting the instantaneous pressure distribution and longitudinal motion of gas flow in the resonating tube 1020 as influenced simultaneously by the left acoustic driver 1030L and right acoustic driver 1030R. The 8 diagrams illustrate graphs from cycle time zero advancing with increments of ⅛ cycle to ⅞ cycle. They provide insight into the combined acoustic profile of the overall resonating tube in way of the stack sandwich 1010L & 1010R.

Figure 13A:
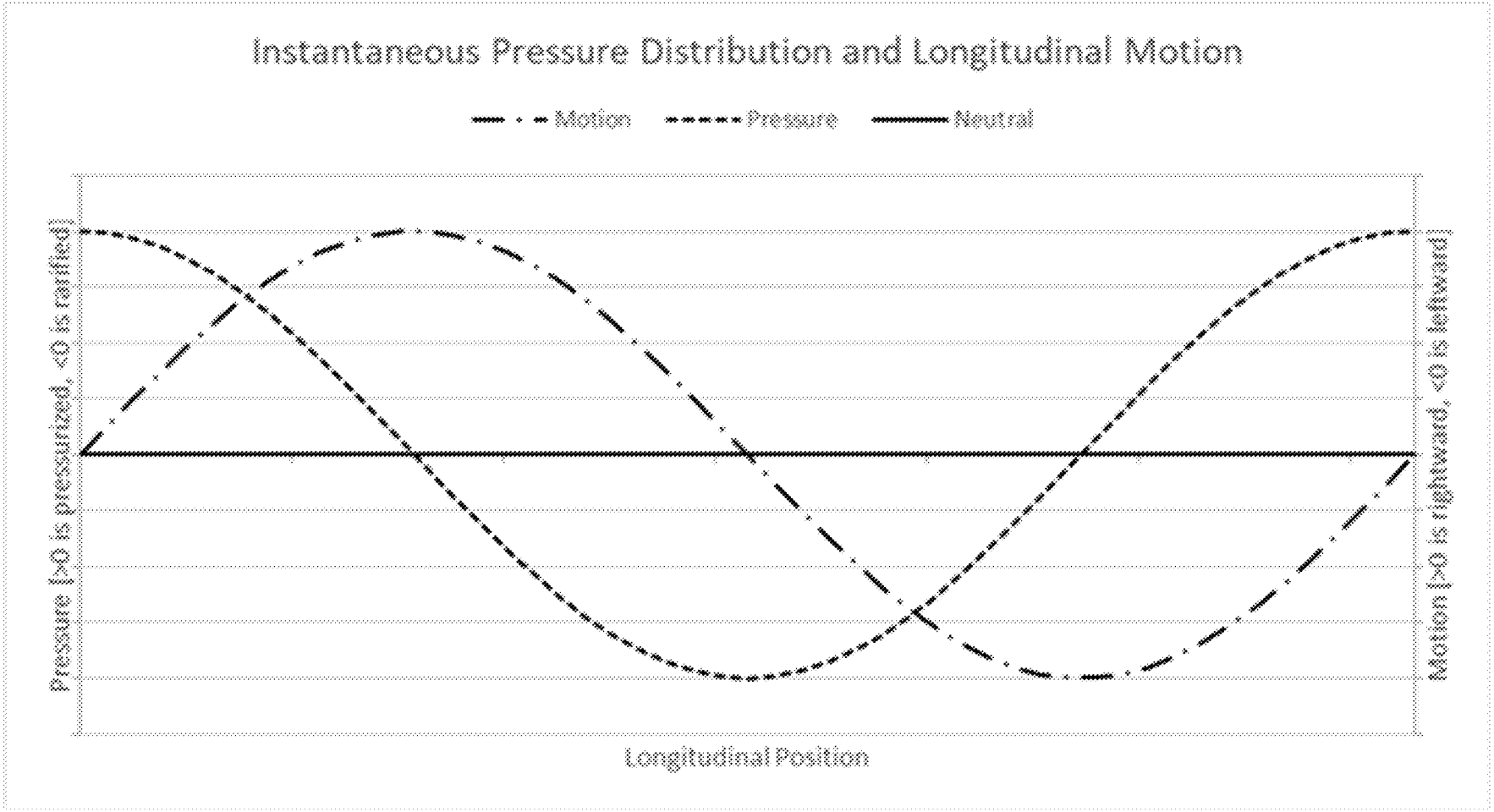
FIGS. 13A-13H show 8 diagrams depicting the instantaneous pressure distribution and longitudinal motion of gas flow in the resonating tube as influenced simultaneously by the left acoustic driver and right acoustic driver.

In FIG. 13A, starting at cycle time 0, the diaphragms of the acoustic drivers 1030L & 1030R are at their extreme or maximum inboard locations and temporarily motionless. The pressure is maximum in regions adjacent to each acoustic driver 1030L, 1030R. The pressure is minimum at the center of the assembly 1000. At the left quadrant, the gas is flowing to the right at maximum velocity. At the right quadrant, the gas is flowing to the left at maximum velocity. All gas is currently center-seeking. In this way, the high temperature gas on the left is translating rightward through the left-side hot heat exchanger 1060L (from which some of its thermal energy is extracted for ultimate rejection to the surroundings) and continues to be adiabatically expand (and correspondingly drop in temperature) as it approaches the cold heat exchanger 1050 (where it is able to absorb thermal energy from the refrigerated space).

Figure 13B:
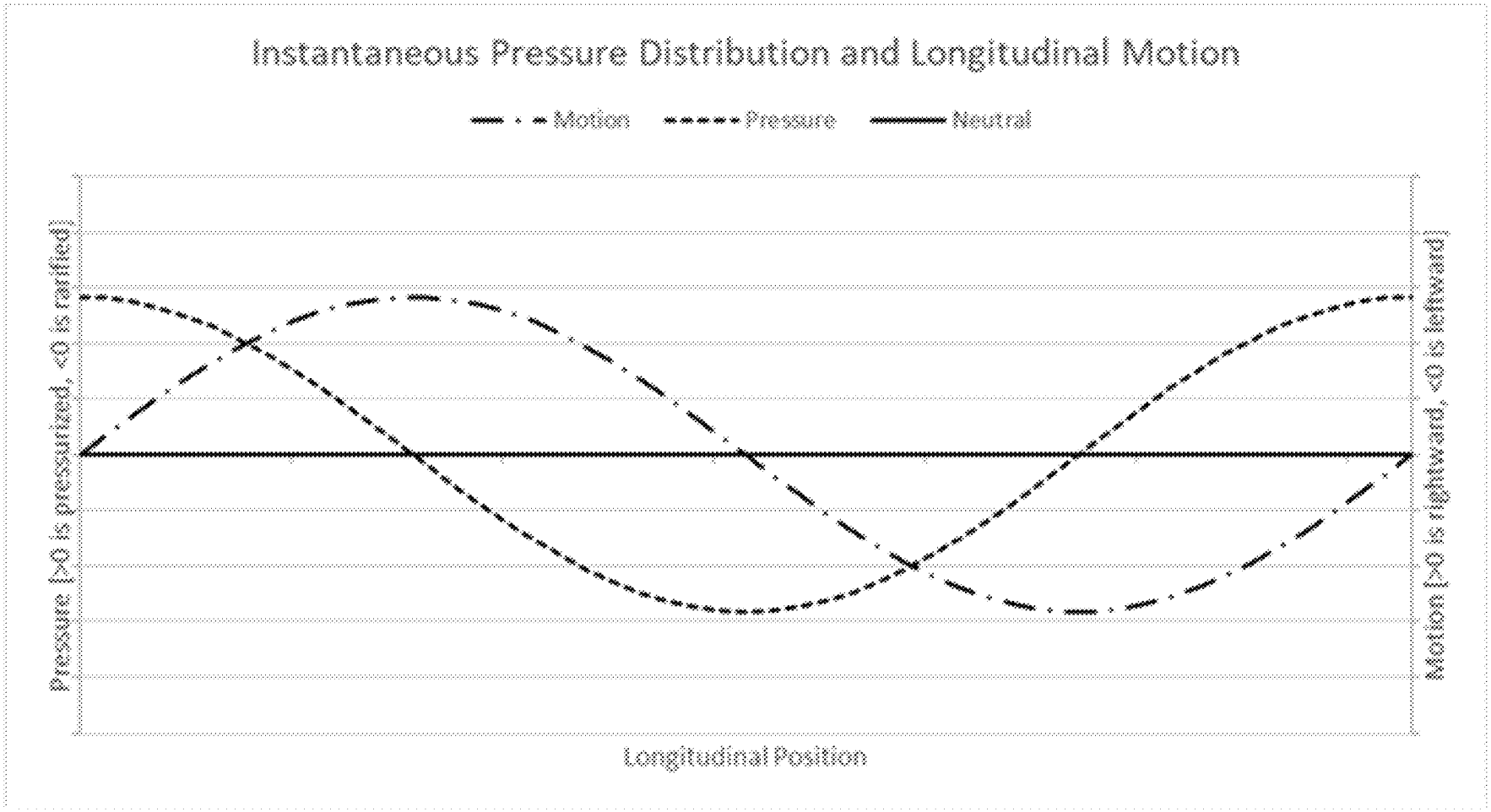

In FIG. 13B, at cycle time of ⅛ cycle, the diaphragms of the acoustic drivers 1030L & 1030R are moving away from each other and accelerating. The pressure is decreasing in the regions adjacent to each acoustic driver 1030L, 1030R. The pressure is increasing at the center of the assembly 1000. At the left quadrant, the gas is flowing to the right at a decelerating rate. At the right quadrant, the gas is flowing to the left at a decelerating rate. As such, all gas is still center-seeking but is slowing down.

Figure 13C:
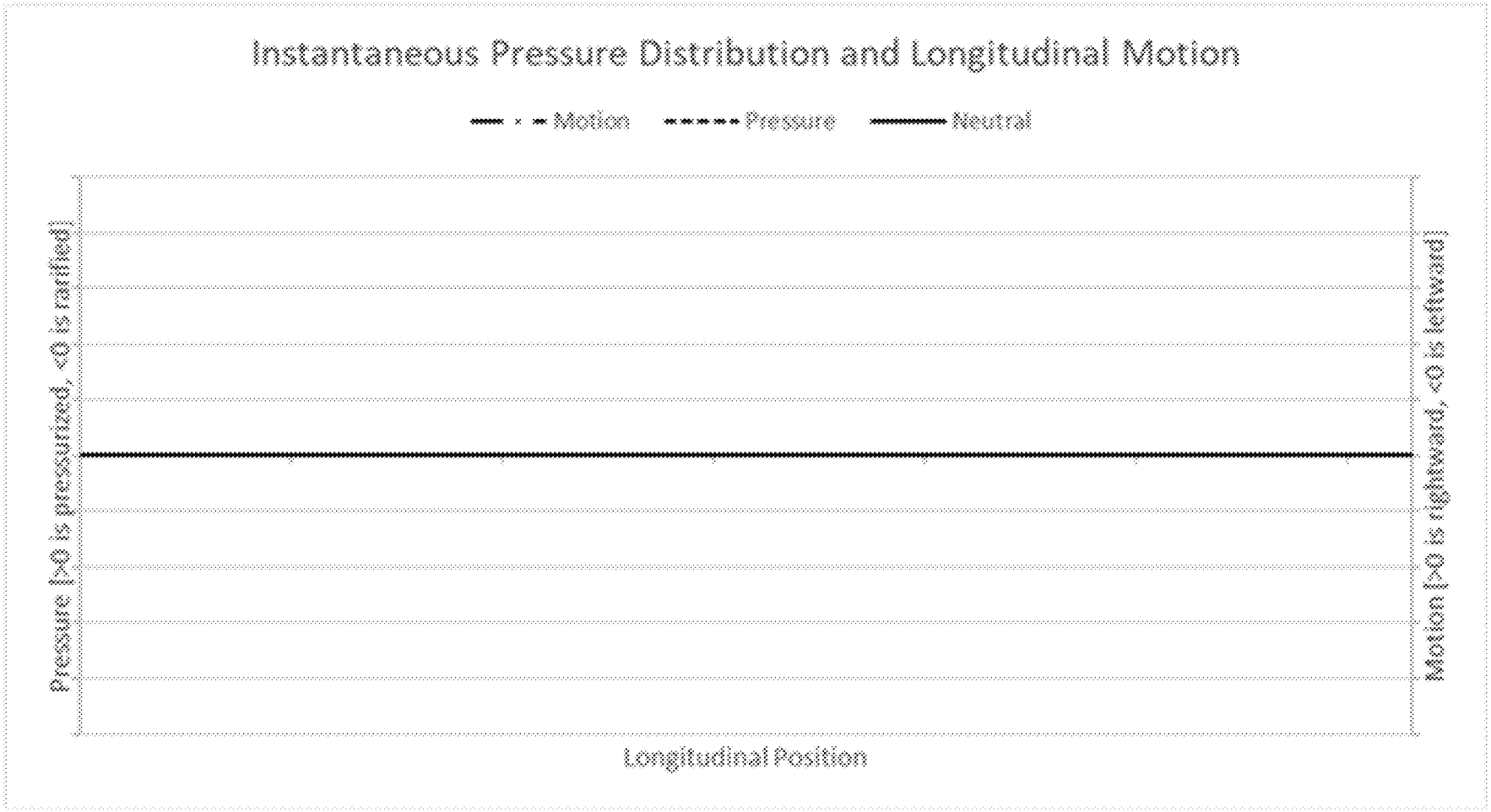

In FIG. 13C, at cycle time of ¼ cycle, the diaphragms of the acoustic drivers 1030L & 1030R have translated to their neutral positions and are moving away from each other (i.e., translating outboard) at maximum velocity. The pressure is neutral throughout the tube 1020. The pressure gradient induced by the left acoustic driver's previous cycle is being perfectly cancelled out by the pressure gradient induced by the right acoustic driver's precious cycle. There is no instantaneous motion of the gas (i.e., it is temporarily stationary).

Figure 13D:
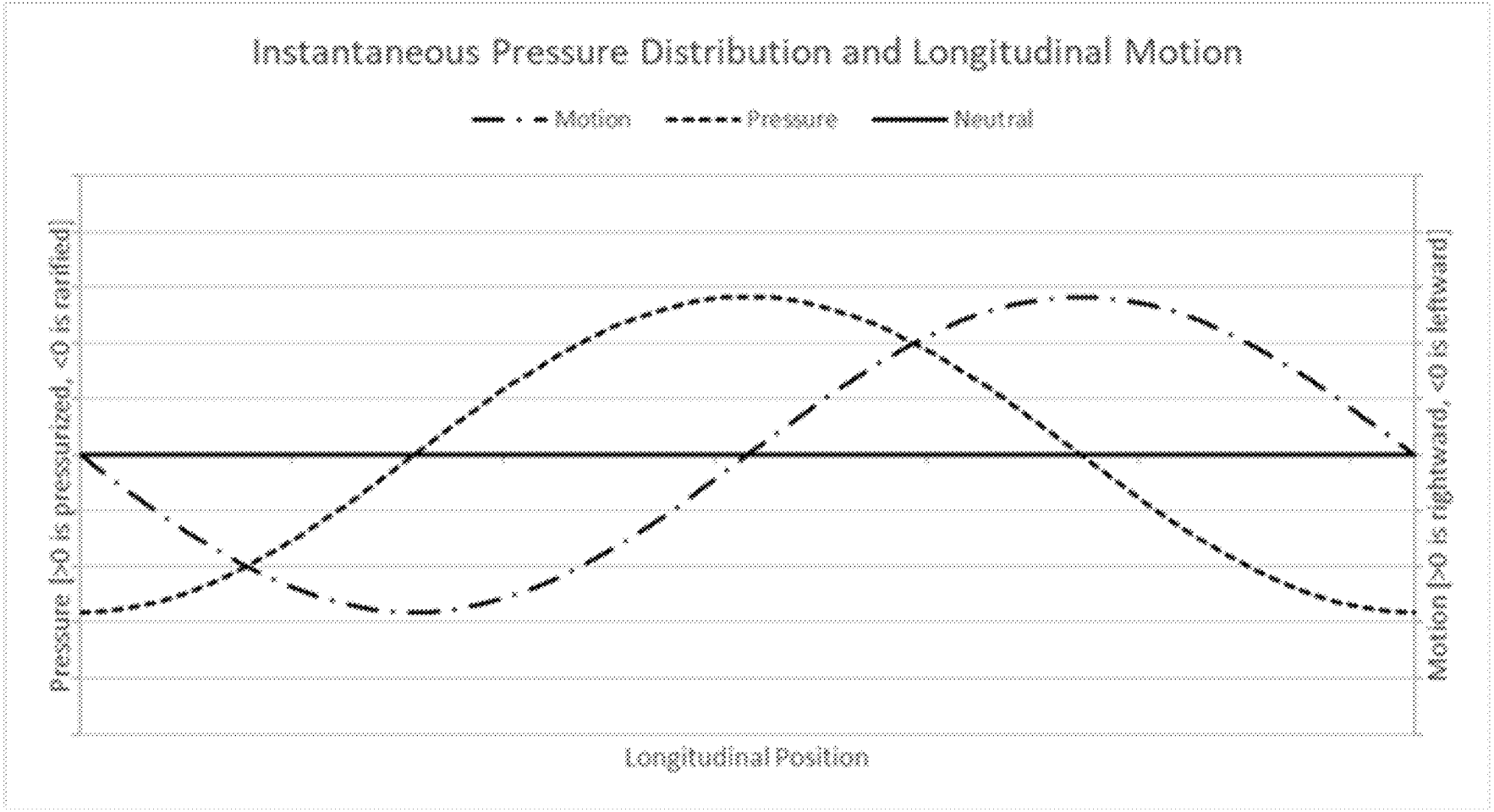

In FIG. 13D, at cycle time of ⅜ cycle, the diaphragms of the acoustic drivers 1030L & 1030R are moving away from each other and decelerating. The pressure is increasing at the center of the assembly 1000. At the left quadrant, the gas is flowing to the left and accelerating. At the right quadrant, the gas is flowing to the right and accelerating. All gas is now center-avoiding and accelerating.

Figure 13E:
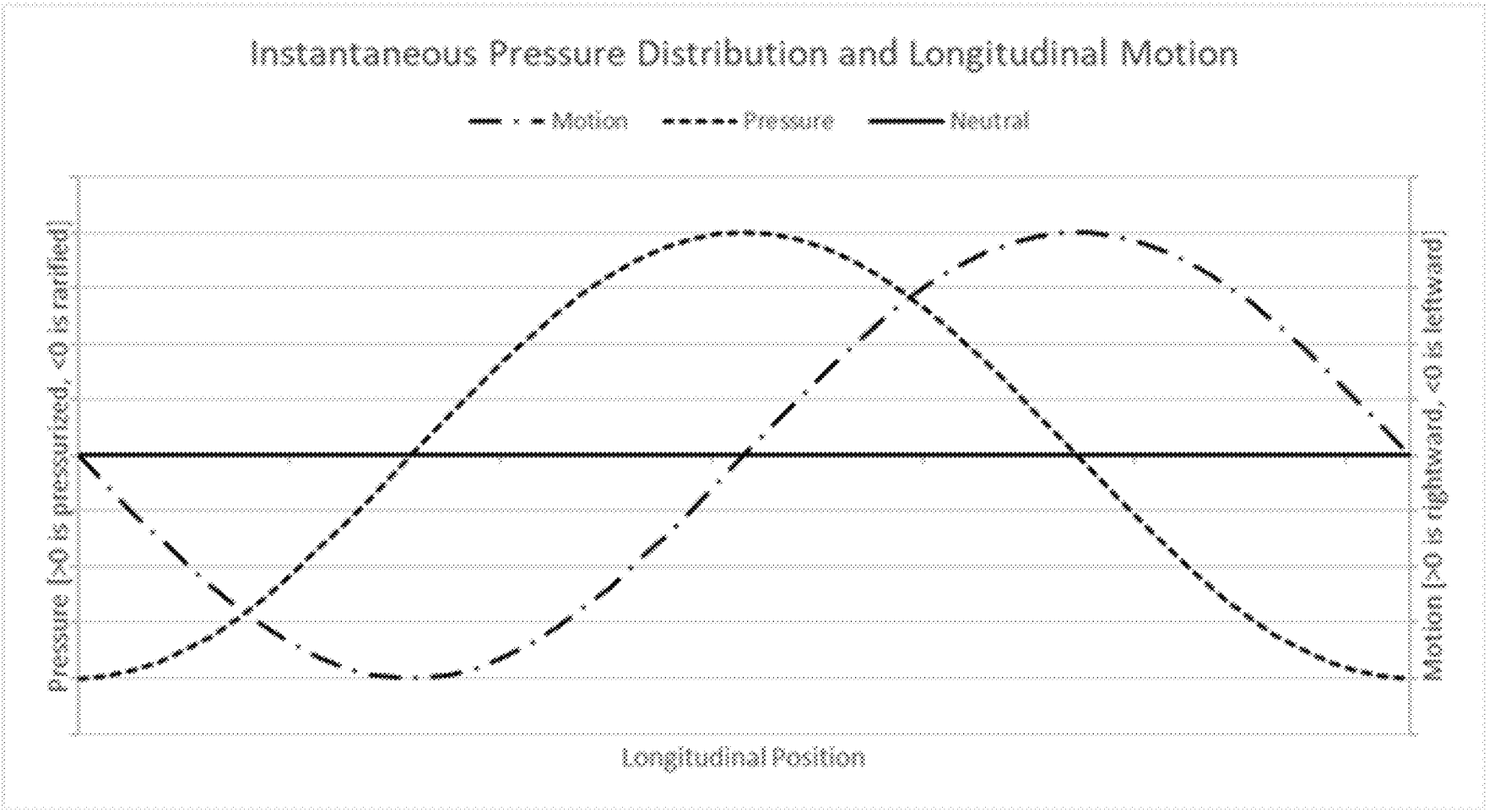

In FIG. 13E, at cycle time of ½ cycle, the diaphragms of the acoustic drivers 1030L & 1030R have translated as far outboard as they can, at their extreme outboard locations. The pressure is minimum in the regions adjacent to each acoustic driver 1030L, 1030R. At the left quadrant, the gas is flowing to the left at maximum velocity. At the right quadrant, the gas is flowing to the right at maximum velocity. All gas is center-avoiding. In this way, the outboard heat exchangers 1060L & 1060R are colder and the center heat exchanger 1050 is the hotter one. The outboard heat exchangers 1060L & 1060R will encounter the gas after it has had a chance to cool down and will therefore be cooler than the center heat exchanger 1050.

Figure 13F:
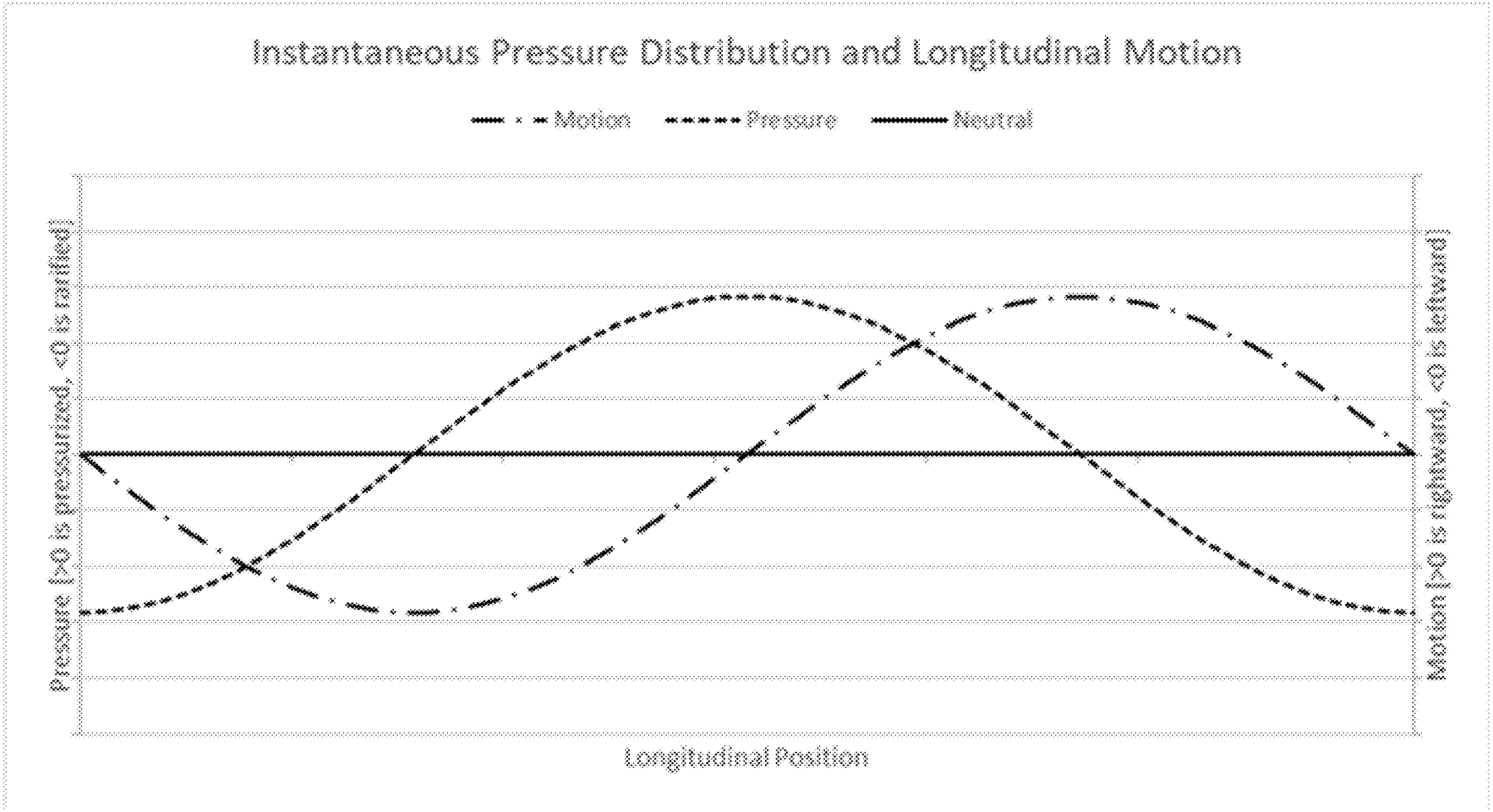

In FIG. 13F, at cycle time of ⅝ cycle, the diaphragms of the acoustic drivers 1030L & 1030R are moving toward each other and accelerating. The pressure is increasing in the regions adjacent to each acoustic driver 1030L, 1030R. The pressure is decreasing at the center of the assembly 1000. At the left quadrant, the gas is flowing to the left and decelerating. At the right quadrant, the gas is flowing to the right and decelerating. As such, all gas is still center-avoiding but decelerating.

Figure 13G:
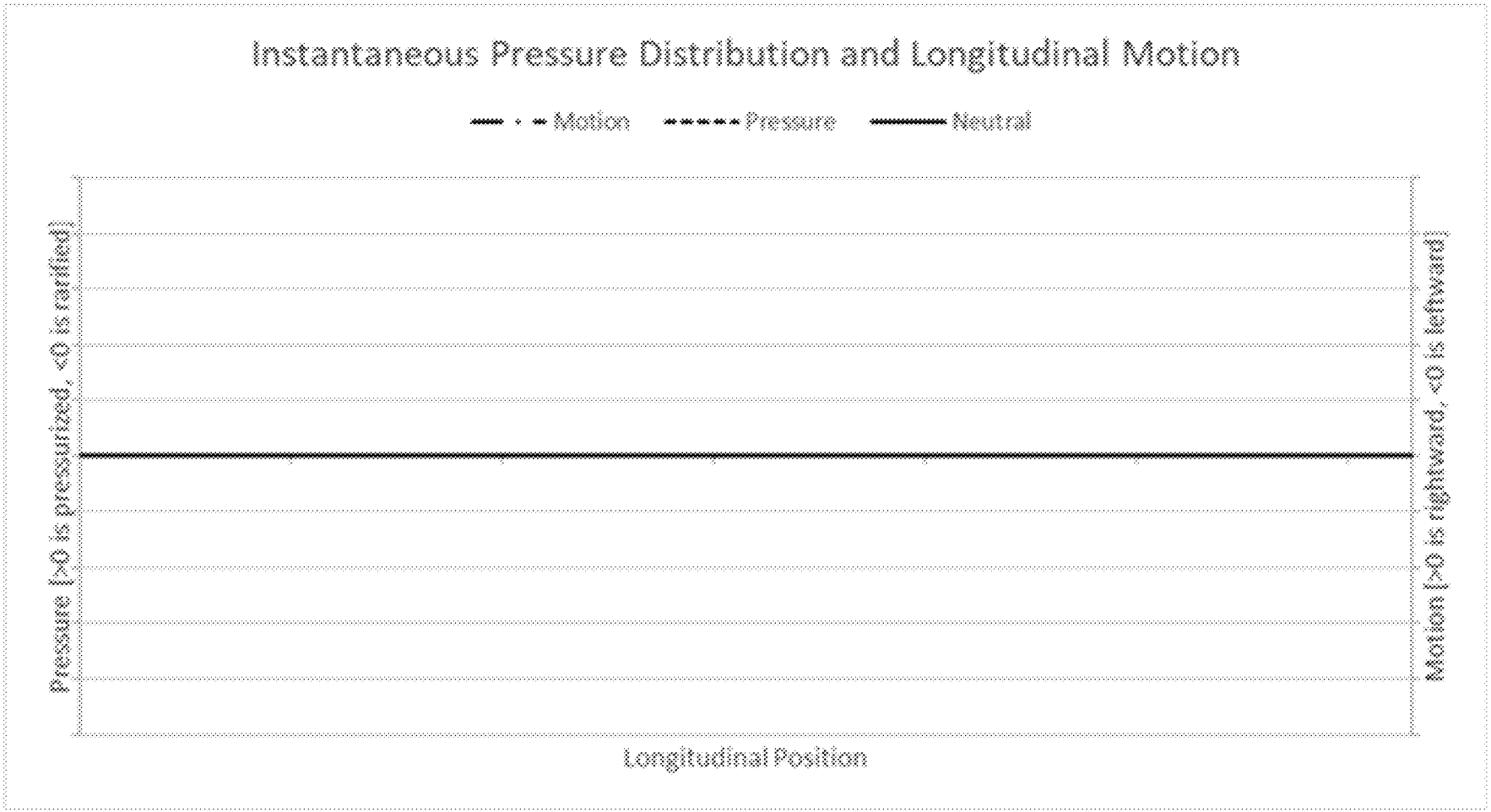

In FIG. 13G, at cycle time of % cycle, the diaphragms of the acoustic drivers 1030L & 1030R have translated to their neutral positions and are moving toward each other (i.e., translating inboard) at maximum velocity. The pressure is neutral throughout and there is no instantaneous motion of the gas (i.e., it is temporarily stationary). The tube 1020 has no pressure gradient and no translation. This is similar to the state at cycle time of ¼ cycle, with the exception of the diaphragms' velocity direction (moving toward each other at maximum velocity in FIG. 13G as opposed to moving away from each other at maximum velocity in FIG. 13C). Again, the respective pressure profiles of the drivers 1030L & 1030R cancel each other out due to symmetry.

Figure 13H:
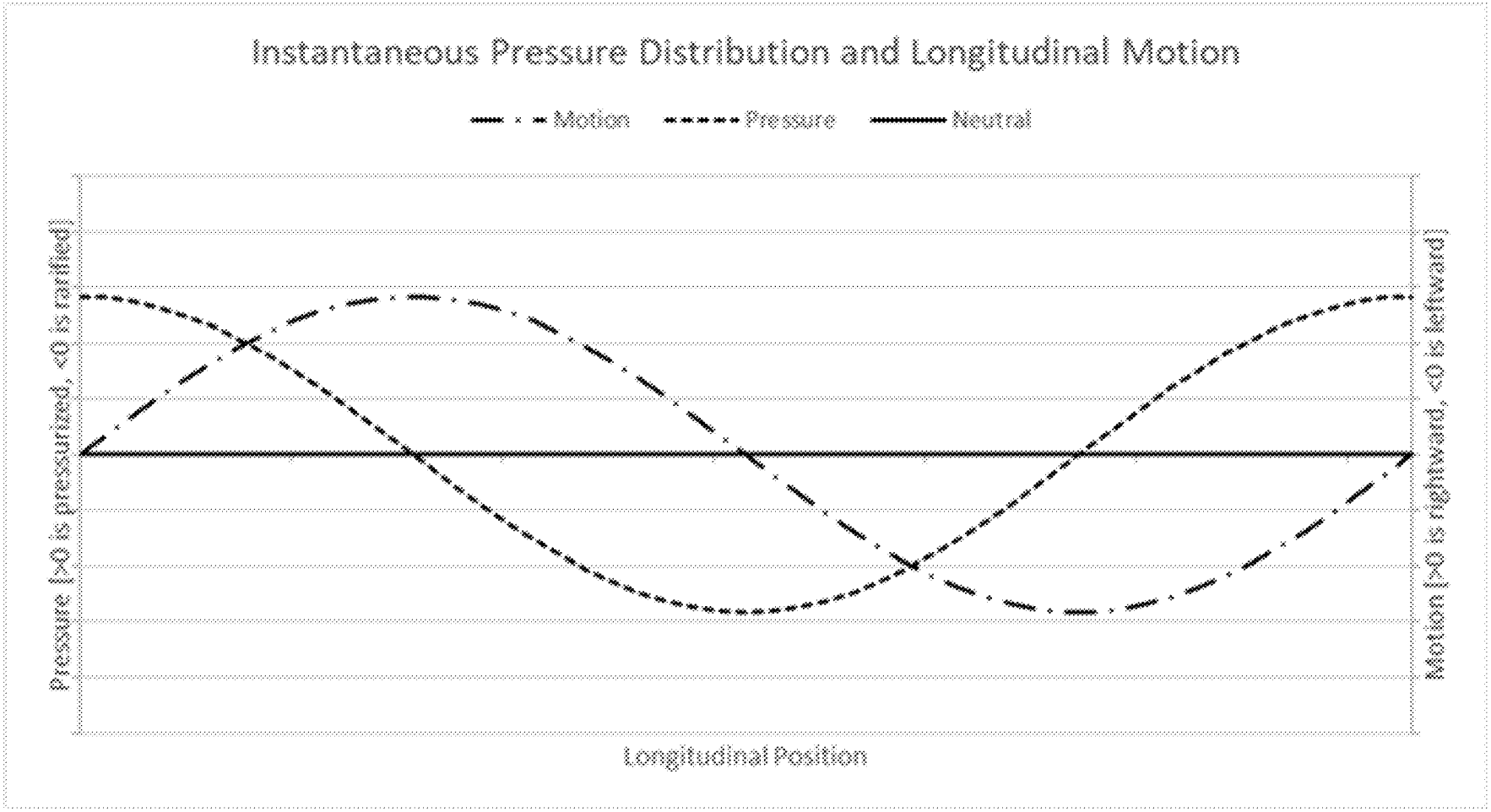

In FIG. 13H, at cycle time of ⅞ cycle, the diaphragms of the acoustic drivers 1030L & 1030R are moving toward each other and decelerating. The pressure is increasing in the regions adjacent to each acoustic driver 1030L, 1030R. The pressure is decreasing at the center of the assembly 1000. At the left quadrant, the gas is flowing to the right and accelerating. At the right quadrant, the gas is flowing to the left and accelerating. All gas is currently center-seeking and accelerating. The cycle now repeats back to the 0 cycle state in FIG. 13A.

Visualization of Double-Ended Symmetric Standing Wave Thermoacoustic Refrigerator Using Simple Simulator for a Resonator Length of 1 Wavelength in Sloshing Mode In this sloshing mode setup, the acoustic drivers 1030L & 1030R are being run 180° out-of-phase with each other (both move left simultaneously or right simultaneously) at a frequency corresponding to the natural resonant frequency of the tube. In this arrangement, the pressure antinodes include one immediately inboard of each acoustic driver 1030L, 1030R and one at the center of the assembly 1000. The pressure nodes include those at one-quarter of the resonator length inboard of each acoustic driver 1030L, 1030R. The motion antinodes include those at one-quarter of the resonator length inboard of each acoustic driver 1030L, 1030R. The motion nodes include one immediately inboard of each acoustic driver 1030L, 1030R and one at the center of the assembly 1000.

FIGS. 14A-14H show 8 diagrams depicting the instantaneous pressure distribution and longitudinal motion of gas flow in the resonating tube 1020 as influenced simultaneously by the left acoustic driver 1030L and right acoustic driver 1030R. The 8 diagrams illustrate graphs from cycle time zero advancing with increments of ⅛ cycle to ⅞ cycle. They provide insight into the combined acoustic profile of the overall resonating tube in way of the stack sandwich 1010L & 1010R.

Figure 14A:
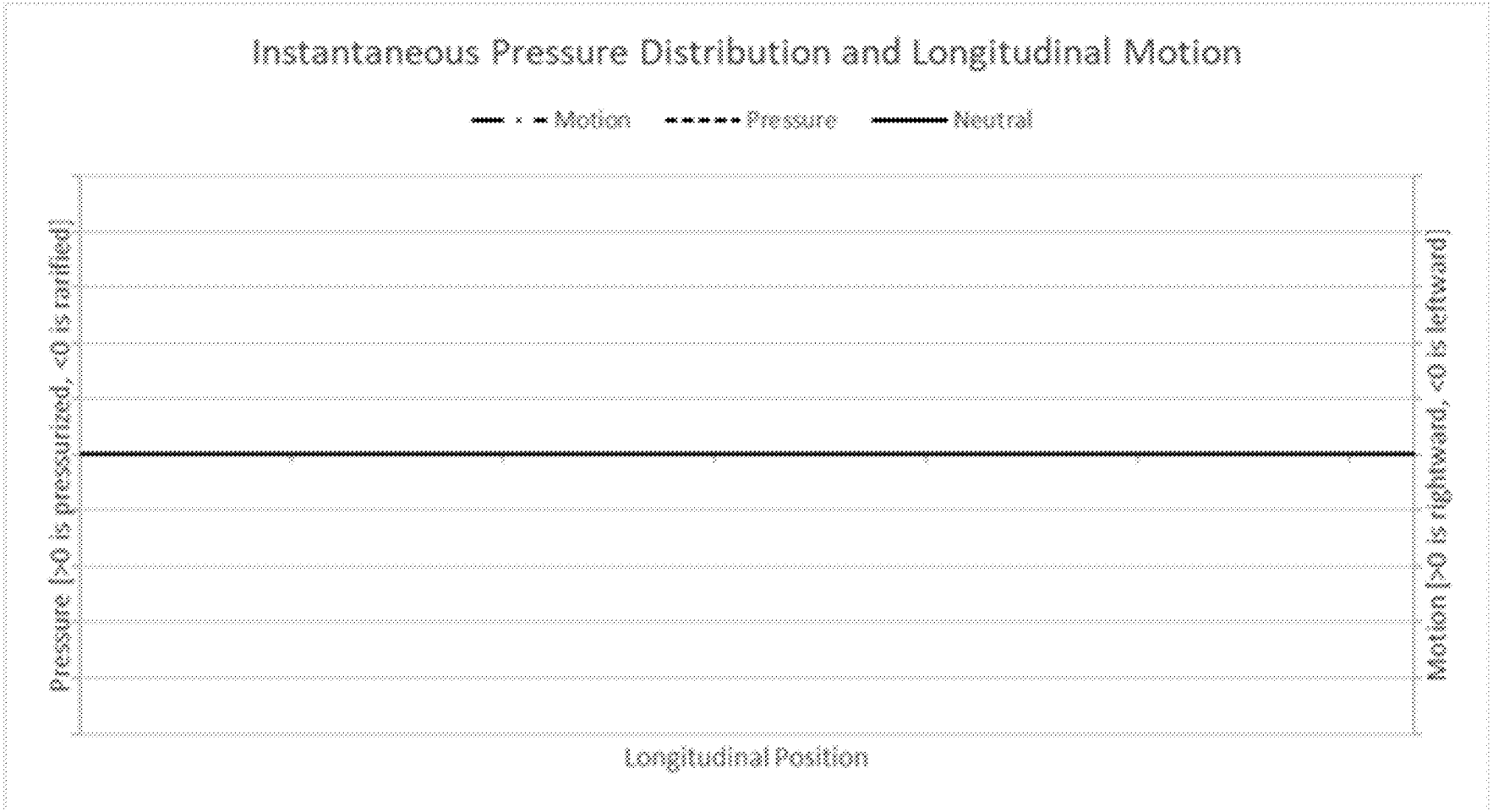
FIGS. 14A-14H show 8 diagrams depicting the instantaneous pressure distribution and longitudinal motion of gas flow in the resonating tube as influenced simultaneously by the left acoustic driver and right acoustic driver.

In FIG. 14A, starting at cycle time 0, the diaphragms of the acoustic drivers 1030L & 1030R are at their rightmost locations and temporarily motionless at their neutral positions. The pressure is neutral throughout and there is no instantaneous motion of the gas (i.e., it is temporarily stationary).

Figure 14B:
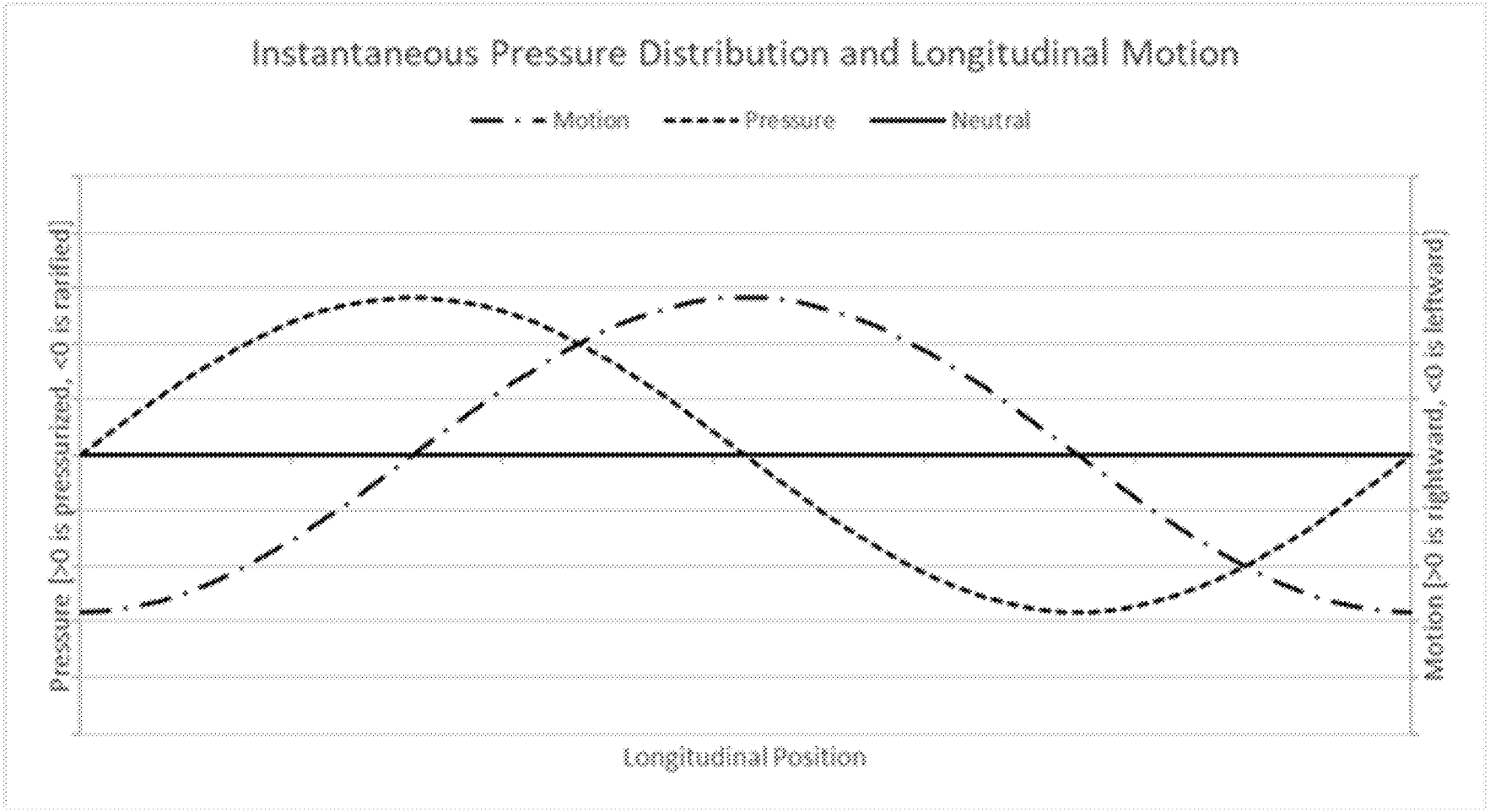

In FIG. 14B, at cycle time of ⅛ cycle, the diaphragms of the acoustic drivers 1030L & 1030R are traveling leftward and accelerating. The pressure is increasing in the leftmost quadrant and decreasing in the rightmost quadrant. The gas is moving leftward in the region adjacent to each acoustic driver 1030L, 1030R and moving rightward in the center of the assembly 1000 and accelerating.

Figure 14C:
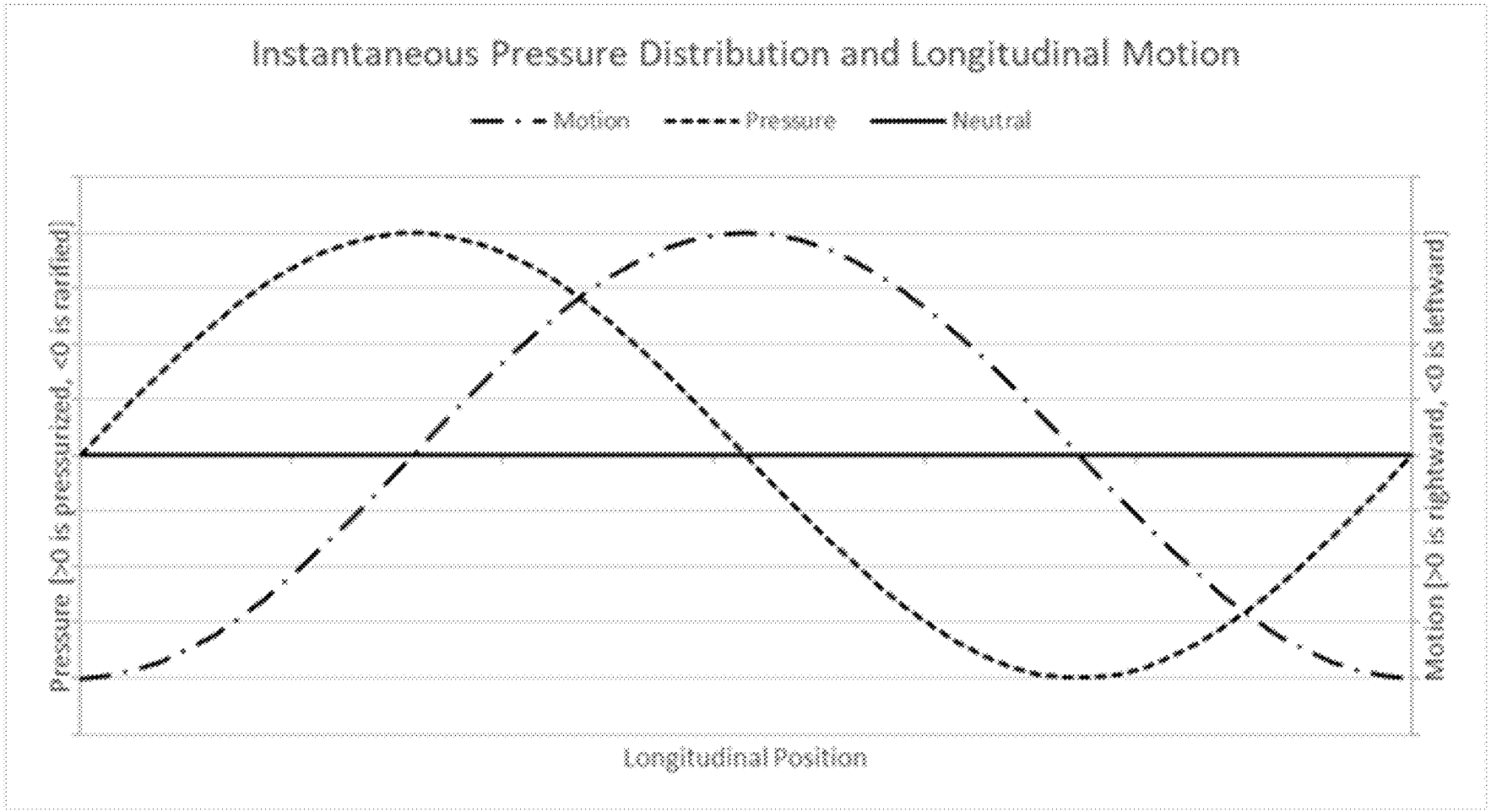

In FIG. 14C, at cycle time of ¼ cycle, the diaphragms of the acoustic drivers 1030L & 130R are at their neutral locations and traveling leftward at maximum velocity. The pressure is maximum in the left quadrant and minimum in the right quadrant. The gas is moving leftward in the region adjacent to each acoustic driver 1030L, 1030R and moving rightward at the center of the assembly 1000 at maximum velocity. The center heat exchanger 1050 is receiving expanded gas coming from the left and is therefore at a cooler temperature than the left heat exchanger 1060L, which will be warmer. The right heat exchanger 1060R may also be getting cooled by gas flowing from the left, but it will be heated later. In this way, the center heat exchanger 1050 is always cooled by the gas motion while the outboard heat exchangers 1060L and 1060R are either heated or slightly cooled, with the heated stage being the primary goal of this running configuration.

Figure 14D:
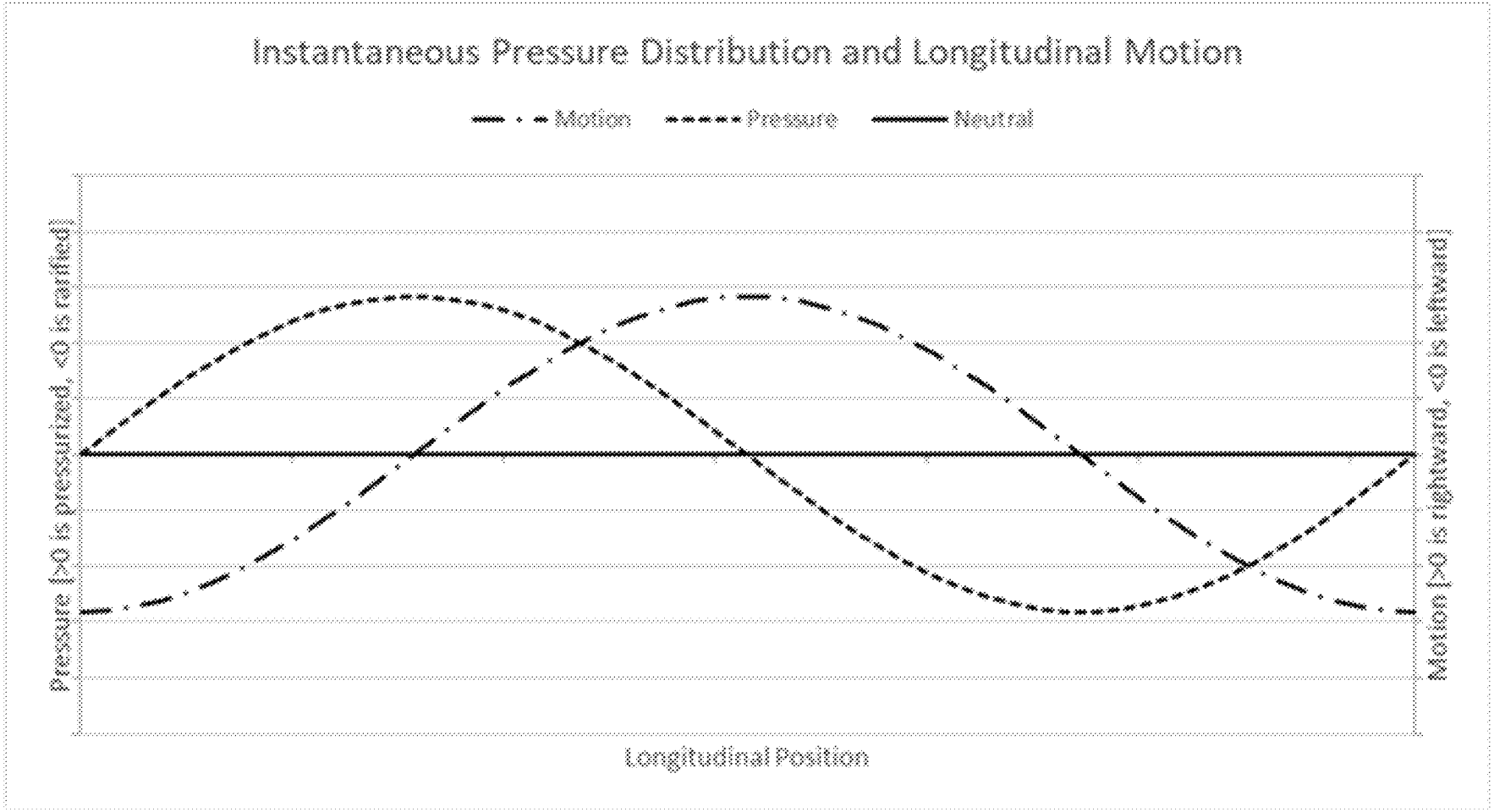

In FIG. 14D, at cycle time of ⅜ cycle, the diaphragms of the acoustic drivers 1030L & 1030R are traveling leftward and decelerating. The pressure is decreasing in the left quadrant and increasing in the right quadrant. The gas is moving leftward in the region adjacent to each acoustic driver 1030L, 1030R and moving rightward at the center of the assembly 1000 and decelerating.

Figure 14E:
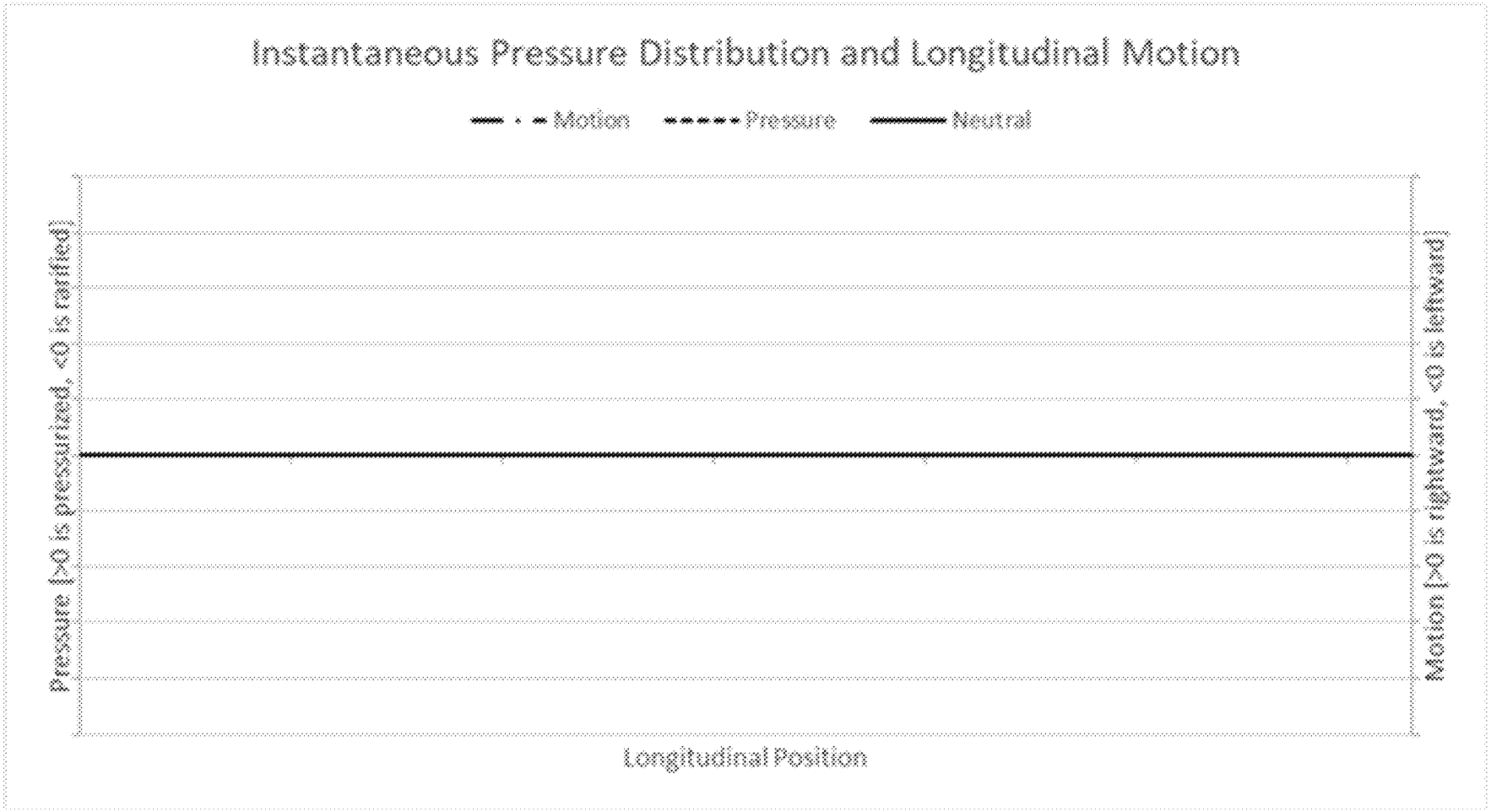

In FIG. 14E, at cycle time of ½ cycle, the diaphragms of the acoustic drivers 1030L & 130R have translated to their leftmost positions and are now temporarily motionless. The pressure is neutral throughout and there is no instantaneous motion of the gas (i.e., it is temporarily stationary). This is similar to the 0 cycle state in FIG. 14A, with the exception of the diaphragms' present position (leftmost in FIG. 14E as opposed to rightmost in FIG. 14A).

Figure 14F:
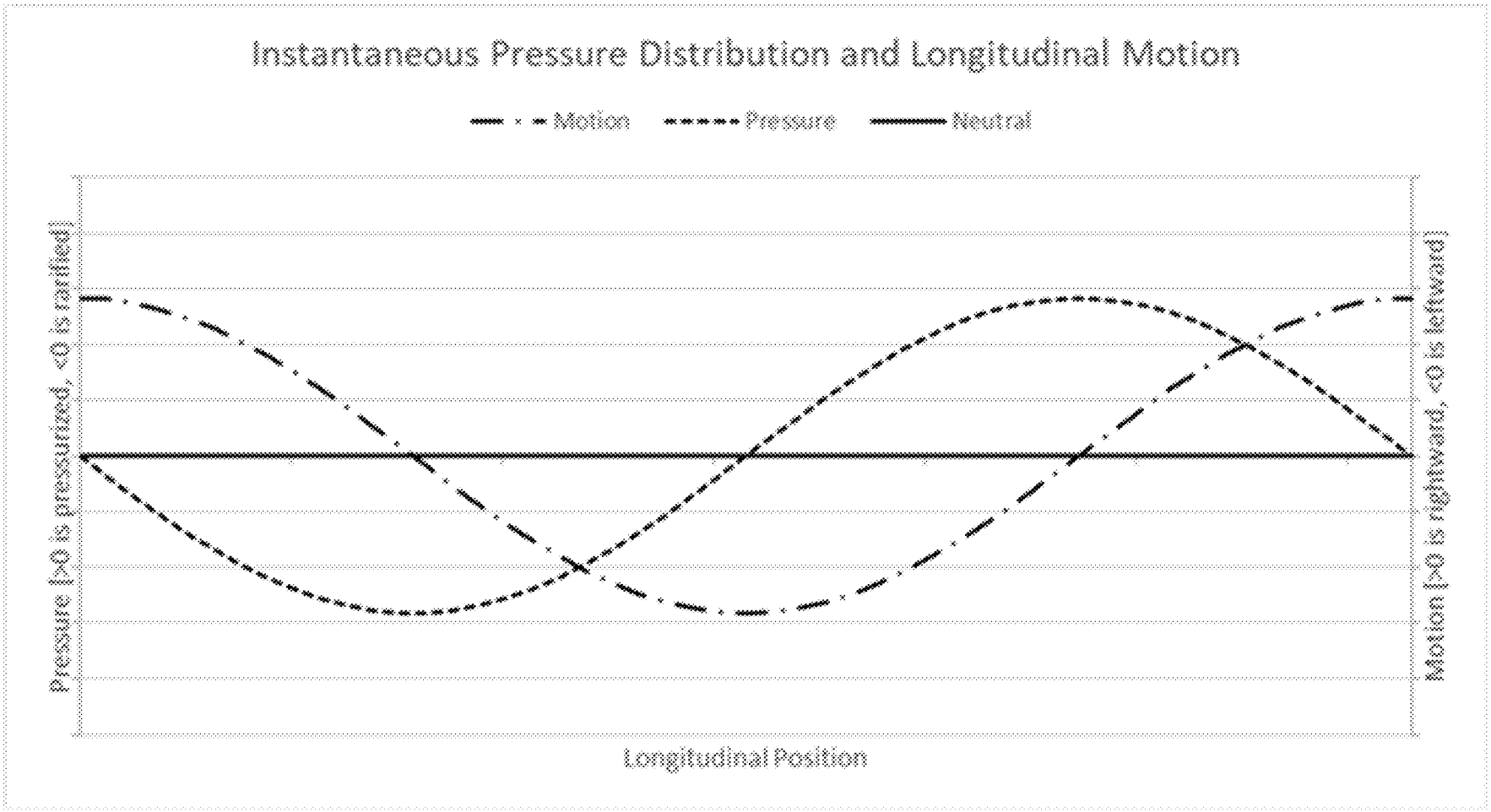

In FIG. 14F, at cycle time of ⅝ cycle, the diaphragms of the acoustic drivers 1030L & 1030R are traveling rightward and accelerating. The pressure is decreasing in the left quadrant and increasing in the right quadrant. The gas is moving rightward in the region adjacent to each acoustic driver 1030L, 1030R and moving leftward at the center of the assembly 1000 and accelerating.

Figure 14G:
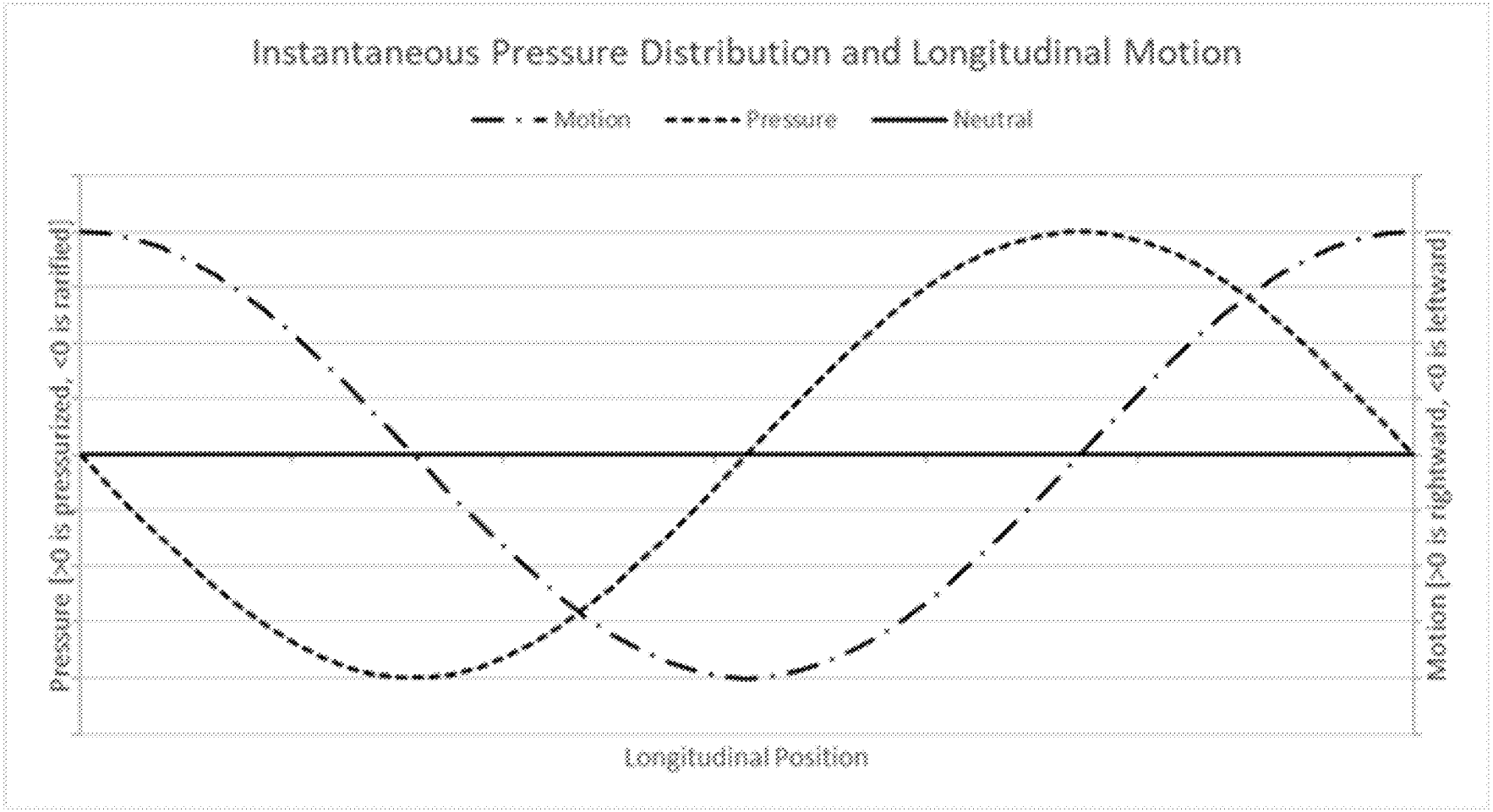

In FIG. 14G, at cycle time of % cycle, the diaphragms of the acoustic drivers 1030L & 1030R are back in their neutral positions but are now traversing rightward at maximum velocity. The pressure is minimum in the left quadrant and maximum in the right quadrant. The gas is moving rightward in the region adjacent to each acoustic driver 1030L, 1030R and moving leftward at the center of the assembly 1000 at maximum velocity. The center heat exchanger 1050 is receiving expanded gas coming from the right and is therefore at a cooler temperature than the right heat exchanger 1060R, which will be warmer. The right heat exchanger 1060R may also be getting cooled by gas flowing from the right, but it will be heated later. In this way, the center heat exchanger 1050 is always cooled by the gas motion while the outboard heat exchangers 1060L and 1060R are either heated or slightly cooled, with the heated stage being the primary goal of this running configuration.

Figure 14H:
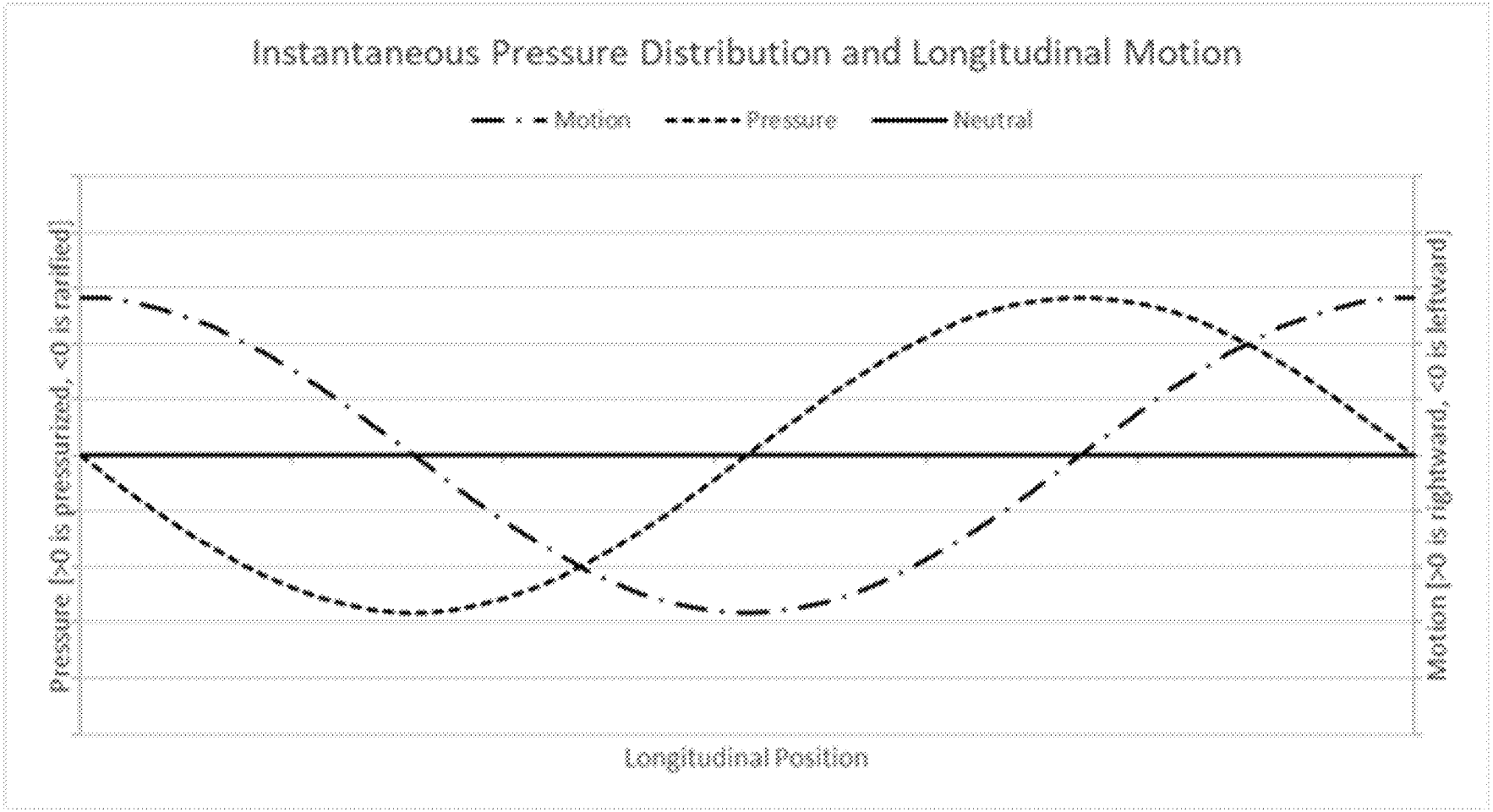

In FIG. 14H, at cycle time of ⅞ cycle, the diaphragms of the acoustic drivers 1030L & 1030R are traveling rightward and decelerating. The pressure is increasing in the left quadrant and decreasing in the right quadrant. The gas is moving rightward in the region adjacent to each acoustic driver 1030L, 1030R and moving leftward at the center of the assembly 1000 and decelerating. The cycle now repeats back to the 0 cycle state in FIG. 14A.

Performance of Prototypes of Refrigeration Assembly

Figure 15:
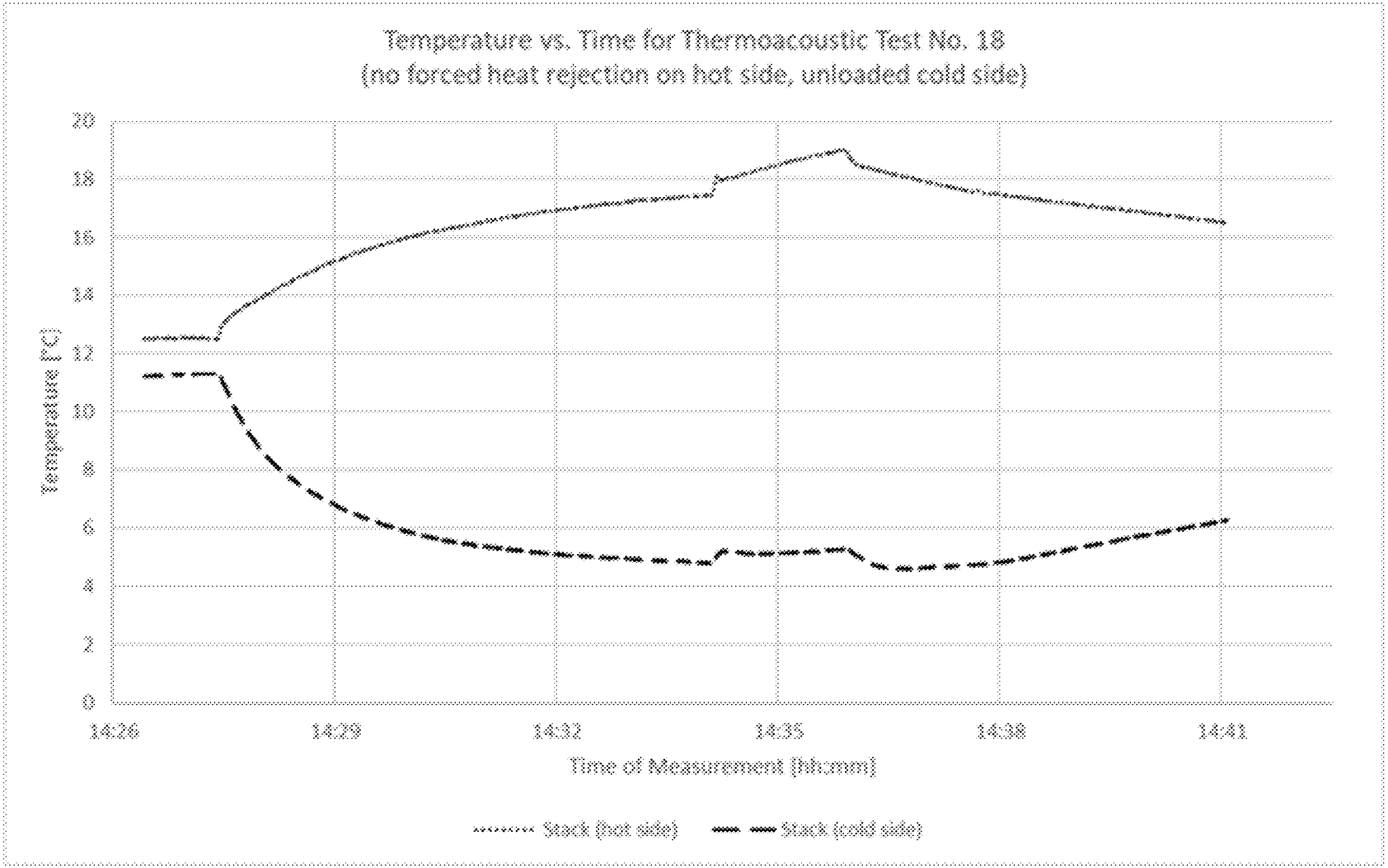
FIG. 15 is an example of a graph of actual performance from prototypes showing temperature versus time for a thermoacoustic test conducted with no forced heat rejection on the hot side and an unloaded cold side.

FIG. 15 is an example of a graph of actual performance from prototypes of the refrigeration assembly of FIGS. 9A-9B showing temperature versus time for a thermoacoustic test conducted with no forced heat rejection on the hot side (e.g., 150 in FIG. 1) and an unloaded cold side (e.g., 160 in FIG. 1) of the stack (e.g., 110 in FIG. 1). The temperature profile of the hot side of the stack rises over time. The temperature profile of the cold side of the stack drops over time. They are somewhat mirror images of one another in shape but not in magnitude.

Figure 16:
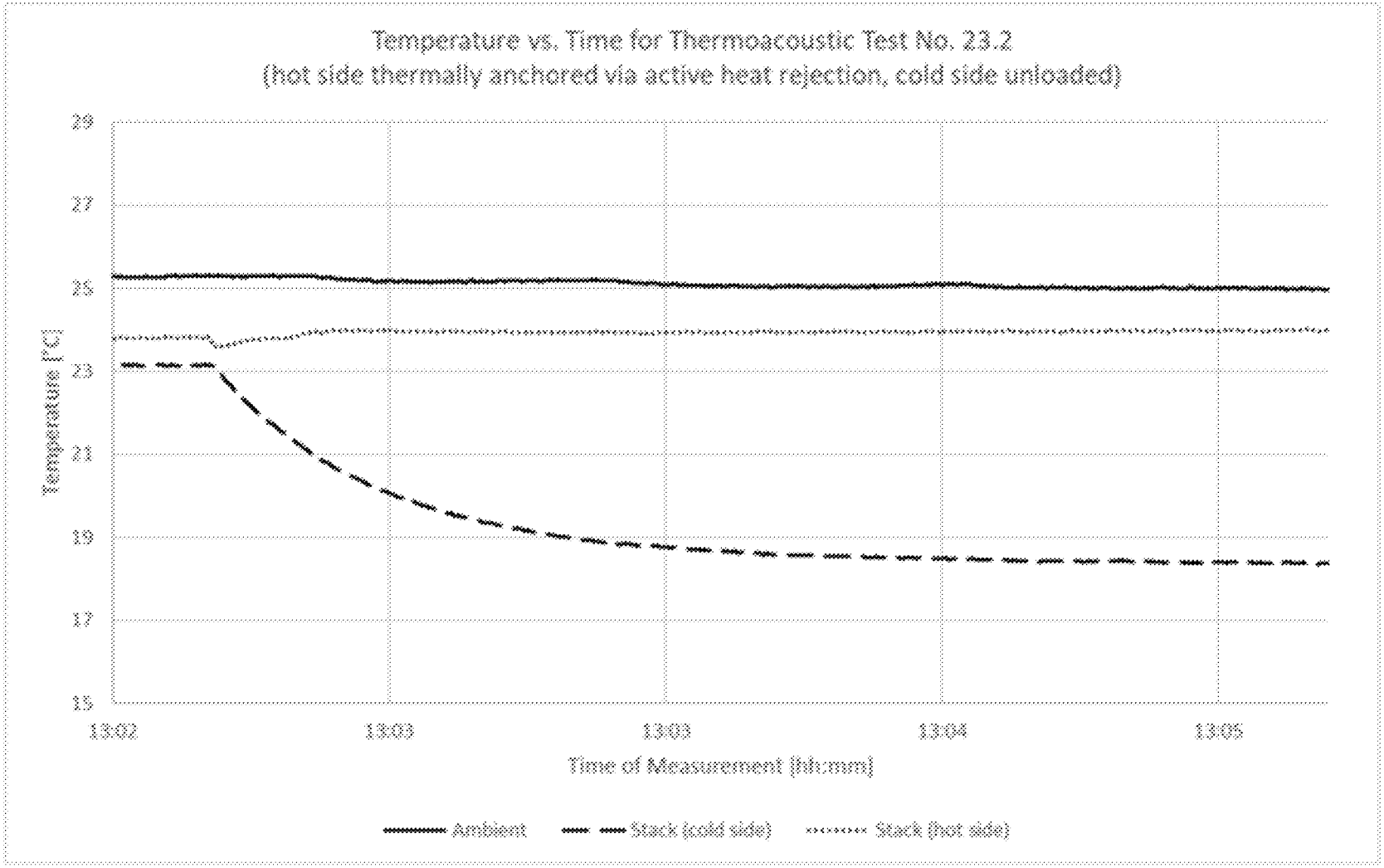
FIG. 16 is an example of a graph of actual performance from prototypes showing temperature versus time for a thermoacoustic test conducted with the hot side thermally anchored via active heat rejection and an unloaded cold side.

FIG. 16 is an example of a graph of actual performance from prototypes of the refrigerative assembly of FIGS. 9A-9B showing temperature versus time for a thermoacoustic test conducted with the hot side (e.g., 150 in FIG. 1) thermally anchored via active heat rejection and an unloaded cold side (e.g., 160 in FIG. 1). For this prototype, the temperature profile of the thermally anchored hot side remains relatively constant and slightly below the ambient temperature. The temperature profile of the unloaded cold side drops over time at a decreasing rate until it levels off to a relatively constant low temperature.

Figure 17:
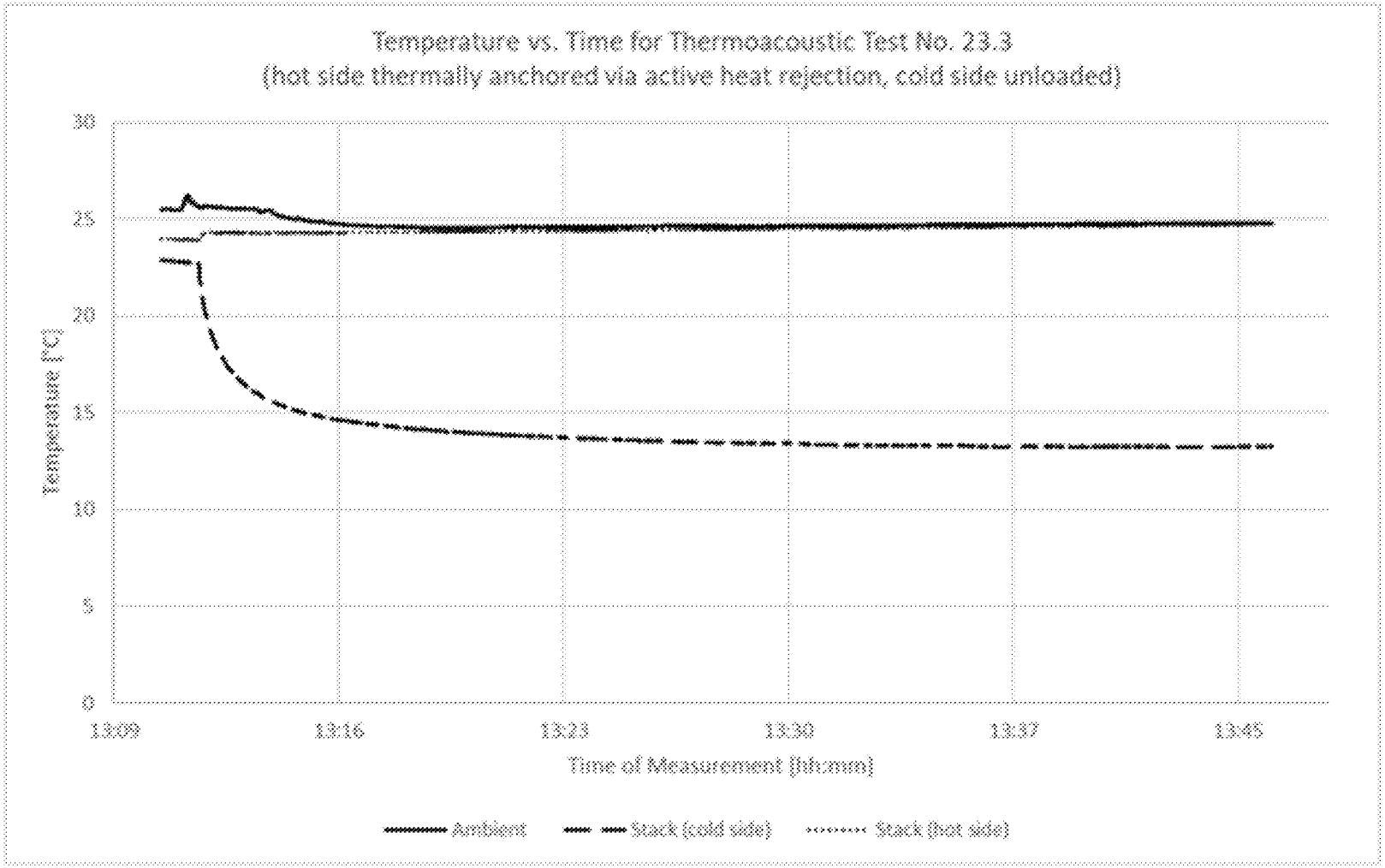
FIG. 17 is another example of a graph of actual performance from prototypes showing temperature versus time for a thermoacoustic test conducted with the hot side thermally anchored via active heat rejection and an unloaded cold side.

FIG. 17 is another example of a graph of actual performance from prototypes of the refrigerative assembly of FIGS. 9A-9B showing temperature versus time for a thermoacoustic test conducted with the hot side (e.g., 150 in FIG. 1) thermally anchored via active heat rejection and an unloaded cold side (e.g., 160 in FIG. 1). For this other prototype, the temperature profile of the thermally anchored hot side remains relatively constant and quickly merges with the ambient temperature. The temperature profile of the unloaded cold side drops over time rather sharply at a decreasing rate and quickly levels off to a relatively constant low temperature.

The inventive concepts taught by way of the examples discussed above are amenable to modification, rearrangement, and embodiment in several ways. For example, this invention may be applicable in other systems having different geometries, sizes, or arrangements of components. Accordingly, although the present disclosure has been described with reference to specific embodiments and examples, persons skilled in the art will recognize that changes may be made in form and detail without departing from the spirit and scope of the disclosure.

An interpretation under 35 U.S.C. § 112(f) is desired only where this description and/or the claims use specific terminology historically recognized to invoke the benefit of interpretation, such as "means," and the structure corresponding to a recited function, to include the equivalents thereof, as permitted to the fullest extent of the law and this written description, may include the disclosure, the accompanying claims, and the drawings, as they would be understood by one of skill in the art.

To the extent the subject matter has been described in language specific to structural features or methodological steps, it is to be understood that the subject matter defined in the appended claims is not necessarily limited to the specific features or steps described. Rather, the specific features and steps are disclosed as example forms of implementing the claimed subject matter. To the extent headings are used, they are provided for the convenience of the reader and are not be taken as limiting or restricting the systems, techniques, approaches, methods, or devices to those appearing in any section. Rather, the teachings and disclosures herein can be combined or rearranged with other portions of this disclosure and the knowledge of one of ordinary skill in the art. It is intended that this disclosure encompass and include such variation.

The indication of any elements or steps as "optional" does not indicate that all other or any other elements or steps are mandatory. The claims define the invention and form part of the specification. Limitations from the written description are not to be read into the claims.

What is claimed is:

1. A thermoacoustic refrigeration assembly comprising:

a resonating tube having a first end and a second end;

a first mechanical oscillator at the first end;

a second mechanical oscillator at the second end;

a first thermoacoustic stack disposed along a length of the resonating tube through which gas travels, the first thermoacoustic stack having a first outboard side heat exchanger disposed on a first outboard side facing away from the first mechanical oscillator and a first inboard side heat exchanger disposed on a first inboard side facing toward the first mechanical oscillator, the first inboard side heat exchanger being disposed between the first outboard side heat exchanger and the first mechanical oscillator; and a second thermoacoustic stack disposed along the length of the resonating tube and between the first thermoacoustic stack and the second mechanical oscillator, the second thermoacoustic stack having a second outboard side heat exchanger disposed on a second outboard side facing away from the second mechanical oscillator and a second inboard side heat exchanger disposed on a second inboard side facing toward the second mechanical oscillator, the second inboard side heat exchanger being disposed between the second outboard side heat exchanger and the second mechanical oscillator;

the first mechanical oscillator causing first compressible gas parcels to oscillate longitudinally through the first thermoacoustic stack and the second thermoacoustic stack due to a first acoustic standing wave and the second mechanical oscillator causing second compressible gas parcels to oscillate longitudinally through the first thermoacoustic stack and the second thermoacoustic stack due to a second acoustic standing wave;

relative phase displacement and/or frequency of the first mechanical oscillator and the second mechanical oscillator being adjustable; and the first and second mechanical oscillators being driven 180° out-of-phase with the respective first compressible gas parcels and second compressible gas parcels moving in a same direction with respect to one another.

2. The thermoacoustic refrigeration assembly of claim 1, wherein the first thermoacoustic stack and the second thermoacoustic stack are combined to form a thermoacoustic stack sandwich having a center heat exchanger formed by the first outboard side heat exchanger and the second outboard side heat exchanger and having the first inboard side heat exchanger and the second inboard side heat exchanger as two outboard heat exchangers of the thermoacoustic stack sandwich.

3. The thermoacoustic refrigeration assembly of claim 2, wherein the stack sandwich is a symmetric stack sandwich disposed at a center of the resonating tube.

4. The thermoacoustic refrigeration assembly of claim 1, wherein the first mechanical oscillator comprises a first acoustic driver and the second mechanical oscillator comprises a second acoustic driver.

5. A thermoacoustic refrigeration assembly comprising:

a resonating tube having a first end and a second end;

a first mechanical oscillator at the first end;

a second mechanical oscillator at the second end; and a thermoacoustic stack sandwich disposed along a length of the resonating tube through which gas travels, the stack sandwich including a first outboard heat exchanger on a first side of the stack sandwich facing the first mechanical oscillator, a second outboard heat exchanger on a second side of the stack sandwich facing the second mechanical oscillator, and a center heat exchanger disposed between the first outboard heat exchanger and the second outboard heat exchanger;

the first mechanical oscillator causing first compressible gas parcels to oscillate longitudinally through the stack sandwich due to a first acoustic standing wave and the second mechanical oscillator causing second compressible gas parcels to oscillate longitudinally through the stack sandwich due to a second acoustic standing wave; and the first and second mechanical oscillators being driven in-phase with the respective first compressible gas parcels and second compressible gas parcels moving in opposite directions with respect to one another.

6. The thermoacoustic refrigeration assembly of claim 5, wherein the stack sandwich is a symmetric stack sandwich disposed at a center of the resonating tube.

7. The thermoacoustic refrigeration assembly of claim 5, wherein the first mechanical oscillator comprises a first acoustic driver and the second mechanical oscillator comprises a second acoustic driver.

8. A thermoacoustic refrigeration assembly comprising:

a resonating tube having a first end and a second end;

a first mechanical oscillator at the first end;

a second mechanical oscillator at the second end; and a thermoacoustic stack sandwich disposed along a length of the resonating tube through which gas travels, the stack sandwich including a first outboard heat exchanger on a first side of the stack sandwich facing the first mechanical oscillator, a second outboard heat exchanger on a second side of the stack sandwich facing the second mechanical oscillator, and a center heat exchanger disposed between the first outboard heat exchanger and the second outboard heat exchanger;

the first mechanical oscillator causing first compressible gas parcels to oscillate longitudinally through the stack sandwich due to a first acoustic standing wave and the second mechanical oscillator causing second compressible gas parcels to oscillate longitudinally through the stack sandwich due to a second acoustic standing wave; and the first and second mechanical oscillators being driven 180° out-of-phase with the respective first compressible gas parcels and second compressible gas parcels moving in a same direction with respect to one another.

9. The thermoacoustic refrigeration assembly of claim 8, wherein the stack sandwich is a symmetric stack sandwich disposed at a center of the resonating tube.

10. The thermoacoustic refrigeration assembly of claim 8, wherein the first mechanical oscillator comprises a first acoustic driver and the second mechanical oscillator comprises a second acoustic driver.

11. A thermoacoustic method for a resonating tube having a first end and a second end and a thermoacoustic stack sandwich disposed along a length of the resonating tube through which gas travels, the stack sandwich including a first outboard heat exchanger on a first side of the stack sandwich facing the first end, a second outboard heat exchanger on a second side of the stack sandwich facing the second end, and a center heat exchanger disposed between the first outboard heat exchanger and the second outboard heat exchanger, the method comprising:

driving first compressible gas parcels from the first end of the resonating tube toward the second end through the stack sandwich;

driving second compressible gas parcels from the second end of the resonating tube toward the first end through the stack sandwich;

placing a first mechanical oscillator at the first end of the resonating tube to cause the first compressible gas parcels to oscillate longitudinally through the stack sandwich due to a first acoustic standing wave;

placing a second mechanical oscillator at the second end of the resonating tube to cause the second compressible gas parcels to oscillate longitudinally through the stack sandwich due to a second acoustic standing wave; and driving the first and second mechanical oscillators in-phase with the respective first compressible gas parcels and second compressible gas parcels moving in opposite directions with respect to one another.

12. The thermoacoustic method of claim 11, further comprising:

disposing the stack sandwich as a symmetric stack sandwich at a center of the resonating tube.

13. The thermoacoustic method of claim 11, further comprising:

adjusting at least one of relative phase displacement or frequency of the first mechanical oscillator and the second mechanical oscillator.

14. The thermoacoustic method of claim 11, further comprising:

driving the first and second mechanical oscillators at a frequency with a half wavelength equal to a resonator length of the resonating tube.

15. The thermoacoustic method of claim 11, wherein the first mechanical oscillator comprises a first acoustic driver and the second mechanical oscillator comprises a second acoustic driver.

16. A thermoacoustic method for a resonating tube having a first end and a second end and a thermoacoustic stack sandwich disposed along a length of the resonating tube through which gas travels, the stack sandwich including a first outboard heat exchanger on a first side of the stack sandwich facing the first end, a second outboard heat exchanger on a second side of the stack sandwich facing the second end, and a center heat exchanger disposed between the first outboard heat exchanger and the second outboard heat exchanger, the method comprising:

driving first compressible gas parcels from the first end of the resonating tube toward the second end through the stack sandwich;

driving second compressible gas parcels from the second end of the resonating tube toward the first end through the stack sandwich;

placing a first mechanical oscillator at the first end of the resonating tube to cause the first compressible gas parcels to oscillate longitudinally through the stack sandwich due to a first acoustic standing wave;

placing a second mechanical oscillator at the second end of the resonating tube to cause the second compressible gas parcels to oscillate longitudinally through the stack sandwich due to a second acoustic standing wave; and driving the first and second mechanical oscillators 180° out-of-phase with the respective first compressible gas parcels and second compressible gas parcels moving in a same direction with respect to one another.

17. The thermoacoustic method of claim 16, further comprising:

disposing the stack sandwich as a symmetric stack sandwich at a center of the resonating tube.

18. The thermoacoustic method of claim 16, further comprising:

adjusting at least one of relative phase displacement or frequency of the first mechanical oscillator and the second mechanical oscillator.

19. The thermoacoustic method of claim 16, further comprising:

driving the first and second mechanical oscillators at a frequency with a half wavelength equal to a resonator length of the resonating tube.

20. The thermoacoustic method of claim 16, wherein the first mechanical oscillator comprises a first acoustic driver and the second mechanical oscillator comprises a second acoustic driver.

* * * * *